US010337128B2

(12) United States Patent
Su et al.

(10) Patent No.: US 10,337,128 B2
(45) Date of Patent: Jul. 2, 2019

(54) METHODS AND COMPOSITIONS FOR COOLING YARNS AND FABRICS, AND ARTICLES COMPRISING SAME

(71) Applicant: Brrr! Inc., Atlanta, GA (US)

(72) Inventors: Hung-Yuan Su, Taoyuan (TW); Ying-Pin Wei, HsinChu County (TW)

(73) Assignee: BRRR! Inc., Atlanta, GA (US)

( * ) Notice: Subject to any disclaimer, the term of this patent is extended or adjusted under 35 U.S.C. 154(b) by 0 days.

(21) Appl. No.: 16/036,097

(22) Filed: Jul. 16, 2018

(65) Prior Publication Data

US 2019/0062957 A1 Feb. 28, 2019

Related U.S. Application Data

(60) Provisional application No. 62/659,931, filed on Apr. 19, 2018.

(30) Foreign Application Priority Data

Nov. 1, 2017 (CN) ..... 2017 1 1042927

(51) Int. Cl.
*D02G 3/02* (2006.01)
*D02G 3/36* (2006.01)
(Continued)

(52) U.S. Cl.
CPC ..... *D02G 3/36* (2013.01); *D02G 3/02* (2013.01); *D02G 3/40* (2013.01); *D03D 15/08* (2013.01);
(Continued)

(58) Field of Classification Search
CPC .. D04H 1/541; D01D 5/30; D01F 8/00; D01F 8/04; D01F 8/12; D01F 8/14
(Continued)

(56) References Cited

U.S. PATENT DOCUMENTS 2,855,758 A 5/1956 Johnson
4,343,334 A 8/1982 Schulze et al.
(Continued)

FOREIGN PATENT DOCUMENTS

WO 2012062480 5/2012

OTHER PUBLICATIONS

International Search Report issued for application PCT/US18/48901, dated Nov. 26, 2018.
(Continued)

*Primary Examiner* — Matthew D Matzek
(74) *Attorney, Agent, or Firm* — Thomas|Horstemeyer, LLP

(57) ABSTRACT

In one aspect, the disclosure relates to composite yarns having a structure comprising a core component and sheath layer, wherein each of the core component and the sheath layer independently comprise a polymer and a disclosed cooling composition. In various further aspects, the present disclosure pertains to double covered yarns comprising an elastic core comprising an elastic core; a first yarn in contact with the elastic core, and wherein the first yarn comprises a disclosed yarn comprising a core component and a sheath layer; and a second yarn in contact with the first yarn, and wherein the second yarn comprises a yarn comprising a cellulosic fiber. In still further aspects, the present disclosure pertains to a fabric, such as a denim fabric. This abstract is intended as a scanning tool for purposes of searching in the particular art and is not intended to be limiting of the present disclosure.

18 Claims, 9 Drawing Sheets

(51) Int. Cl.

| | |
|---|---|
| ***D02G 3/40*** | (2006.01) |
| ***D03D 15/08*** | (2006.01) |
| ***D03D 15/12*** | (2006.01) |
| ***D01D 5/30*** | (2006.01) |
| ***D01F 8/00*** | (2006.01) |
| ***D01F 8/04*** | (2006.01) |
| ***D01F 8/12*** | (2006.01) |
| ***D01F 8/14*** | (2006.01) |

(52) U.S. Cl.
CPC ..... *D03D 15/12* (2013.01); *D10B 2201/02* (2013.01); *D10B 2331/02* (2013.01); *D10B 2331/04* (2013.01); *D10B 2401/02* (2013.01)

(58) Field of Classification Search
USPC ..... 442/361, 364; 428/375, 373; 977/773, 977/775–777, 779
See application file for complete search history.

(56) References Cited

U.S. PATENT DOCUMENTS

| | | | | |
|---|---|---|---|---|
| 6,240,716 | B1 | 6/2001 | Yanagawase et al. | |
| 8,093,160 | B2 | 1/2012 | Tharpe, Jr. et al. | |
| 2005/0020172 | A1* | 1/2005 | Bansal | D01F 8/06 442/381 |
| 2008/0045105 | A1 | 2/2008 | Hara et al. | |
| 2008/0299855 | A1 | 12/2008 | Morihashi | |
| 2009/0068463 | A1 | 3/2009 | Mochizuki et al. | |
| 2009/0191777 | A1 | 7/2009 | Liao | |
| 2013/0133353 | A1 | 5/2013 | Araujo et al. | |
| 2014/0101825 | A1 | 4/2014 | Vedulla et al. | |
| 2015/0240389 | A1 | 8/2015 | Chen | |
| 2016/0024699 | A1* | 1/2016 | Aldridge | G01V 3/38 442/337 |

OTHER PUBLICATIONS

"FTTS-FA-019: Specified Requirements for Cool Feeling Textiles" (The Committee for Conformity Assessment of Accreditation and Certification on Functional and Technical Textiles), p. 1-6, p. 3, 2013.

"Textiles 101: Testing Moisture Management Performance" (AATCC News) p. 1-3, p. 3, 2013.

* cited by examiner

METHODS AND COMPOSITIONS FOR COOLING YARNS AND FABRICS, AND ARTICLES COMPRISING SAME

CROSS-REFERENCE TO RELATED APPLICATIONS

This application claims the benefit of U.S. Provisional Patent Application No. 62/659,931, filed on Apr. 19, 2018; Taiwan Patent Application No. 106129771, filed on Aug. 31, 2017; Taiwan Patent Application No. 106129774, filed on Aug. 31, 2017; Taiwan Patent Application No. 106213242, filed on Sep. 7, 2017; Taiwan Patent Application No. 106213241, filed on Sep. 7, 2017; China Patent Application No. 201711042927.1, filed on Nov. 1, 2017; and China Patent Application No. 201711055972.0, filed on Nov. 2, 2017; each of which is incorporated herein by reference in its entirety.

BACKGROUND

Denim is thought to have derived its name from a French fabric called "serge de Nimes" that was worn in the 16th century and has a twill weave similar to the denim fabric of today. The durability and flexible application of denim led to it becoming popular in England in the 17th century. Another fabric that gained popularity during the same time period was a cotton corduroy fabric that originated in Genoa, Italy and which was called jean, derived from its place of origin. At the time, denim was made of two different threads of cotton, one colored and one white, while jean used two threads of cotton of the same color. It seems that the two fabrics became synonymous during this period and became known by both names.

The fabric traveled to North America, and American textile factories were producing denim/jean in the late 1700s. The book, "The Weavers Draft Book and Clothiers Assistant," published in 1792, contains technical sketches of the weaving methods for a variety of denims. The popularity of denim was secured in the success of the Levi Strauss Company, who patented the riveting process to produce denim work pants in 1873 and sold them to miners in San Francisco. The pants were known for their comfort, durability and ability to hold their shape. In "Staple Cotton Fabrics" by John Hoye, published in 1942, denim was described as, "The most important fabric of the work-clothing group . . . Denims are strong and serviceable; they are particularly strong in the warp direction, where the fabric is subjected to greater wear than the filling."

The widespread appeal of denim, especially in pants, based on their comfortable shape and durability overshadows drawbacks of this material such as poor drying, lack of stretch, rough hand feel and poor thermal conductiveness. Denim enhancements have led to the combination of spandex to soften the fabric and give it stretch. Other yarns have also been added to improve the softness and hand feel of the fabric. However, little has been done to improve the wicking, drying and thermal conductivity of the fabric. Denim naturally absorbs moisture, but does not effectively remove it away from the skin. The fabric becomes "swampy"—moist and hot—when worn in warm environments or while active, holding on to the moisture and the heat generated by the person wearing the material.

Thus, despite advances in textile research, there remains an important need for yarns that can be utilized in denim that address the know shortcomings of this fabric, such as poor wicking, drying time, and thermal conductiveness, while maintaining the hand feel and function. These needs and other needs are satisfied by the present disclosure.

SUMMARY

In accordance with the purpose(s) of the disclosure, as embodied and broadly described herein, the disclosure, in one aspect, relates to composite yarns having a core component and a sheath layer, wherein each of the core component and the sheath layer independently comprise a polymer and a disclosed cooling composition. In various further aspects, the present disclosure pertains to double covered yarns comprising an elastic core comprising an elastic yarn; a first yarn in contact with the elastic core, and wherein the first yarn comprises a disclosed composite yarn comprising a core component and a sheath layer; and a second yarn in contact with the first yarn, and wherein the second yarn comprises a yarn comprising a cellulosic fiber. In still further aspects, the present disclosure pertains to a fabric, such as a denim fabric, comprising a weft yarn comprising a disclosed double covered yarn; and a warp yarn comprising a cotton fibers.

Disclosed are cooling compositions comprising a cooling material, a cooling compound, a first cooling salt, or combinations thereof.

Also disclosed are cooling polymer compositions comprising a polymer and a cooling composition comprising a cooling material, a cooling compound, a first cooling salt, or combinations thereof.

Also disclosed are composite yarn comprising a core component and a sheath layer, where: (a) the core component comprises a polyester polymer and a first cooling composition; and (b) the sheath layer comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

Also disclosed are double covered yarns comprising: (a) an elastic core comprising an elastic yarn; (b) a first yarn comprising a disclosed composite yarn comprising a core component comprising a polyester polymer and a first cooling composition, and a sheath layer comprising a polyamide polymer and a second cooling composition; and (c) a second yarn comprising a cellulosic fiber; wherein the first yarn is wound around the elastic core to form a single covered yarn; and wherein the second yarn is wound around the single covered yarn to form a double covered yarn.

Also disclosed are fabrics comprising: a weft yarn comprising a disclosed double covered yarn; and a warp yarn comprising cotton fibers.

Also disclosed are articles comprising a yarn comprising a core component and a sheath layer, where: (a) the core component comprises a polyester polymer and a first cooling composition; and (b) the sheath layer comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

Also disclosed are articles comprising a disclosed double covered yarn.

Also disclosed are articles comprising a disclosed fabric.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE FIGURES

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A shows a side on cross-sectional view of a portion of a disclosed composite yarn with a cross-sectional view of an end thereof. An enlarged view of the cross-sectional end view is highlighted. A key is shown beneath the views indicating the gray-scale colors associated with a sheath layer, a core component, and distribution of one or more cooling compositions in each of the sheath layer and core component. FIG. 1B shows a cross-sectional view of a disclosed composite yarn, 100, with aspects specified as follows: a polyester core, 110; a first cooling composition, 112; a polyamide sheath, 115; and a second cooling composition, 117. FIG. 1C shows a cross-sectional view of a disclosed composite yarn, 120, with aspects specified as follows: a polyester core, 110; a polyamide sheath, 115; and a second cooling composition, 117. FIG. 1D shows a cross-sectional view of a disclosed composite yarn, 130, with aspects specified as follows: a polyester core, 110; a first cooling composition, 112; and a polyamide sheath, 115.

FIG. 2A shows the disclosed fabric at one magnification, with a 1 mm scalar bar shown in the lower left of the image. FIG. 2B shows the disclosed fabric at a higher magnification compared to FIG. 2A, with a 200 μm scalar bar shown in the lower left of the image.

FIG. 3A shows a longitudinal view of a disclosed warp yarn comprising a cotton denim yarn at one magnification, with a 200 μm scalar bar shown in the lower left of the image. FIG. 3B shows a disclosed warp yarn comprising a cotton denim yarn at a higher magnification compared to FIG. 3A, with a 100 μm scalar bar shown in the lower left of the image.

FIG. 4A shows a longitudinal view of a disclosed weft yarn comprising a disclosed double covered yarn at one magnification, with a 200 μm scalar bar shown in the lower left of the image. FIG. 4B shows a disclosed weft yarn comprising a disclosed double covered yarn at a higher magnification compared to FIG. 4A, with a 100 μm scalar bar shown in the lower left of the image. FIG. 4C shows a cross-sectional view of a disclosed double covered yarn with the various components as labeled therein. A 100 μm scalar bar is shown in the lower right of FIG. 4C.

FIG. 6A shows a schematic cross-sectional view of a disclosed double-covered yarn comprising a cellulosic fiber (e.g., a viscose rayon), a composite yarn, and an elastic yarn (e.g., a spandex yarn). FIG. 6B shows a cross-sectional view of a disclosed double-covered yarn, 1000, with aspects specified as follows: (a) an elastic core, 200, comprising an elastic yarn; (b) a plurality of first yarns, 100*a*-100*h*, each comprising a disclosed composite yarn, such as that shown in FIG. 1B, comprising a core component comprising a polyester polymer and a first cooling composition, and a sheath layer comprising a polyamide polymer and a second cooling composition; and (c) a plurality of second yarns, 300*a*-300*h*, comprising a cellulosic fiber; such, as shown in FIG. 6B, the first yarn is wound around the elastic core to form a single covered yarn; and wherein the second yarn is wound around the single covered yarn to form a double covered yarn.

Figure 1A:
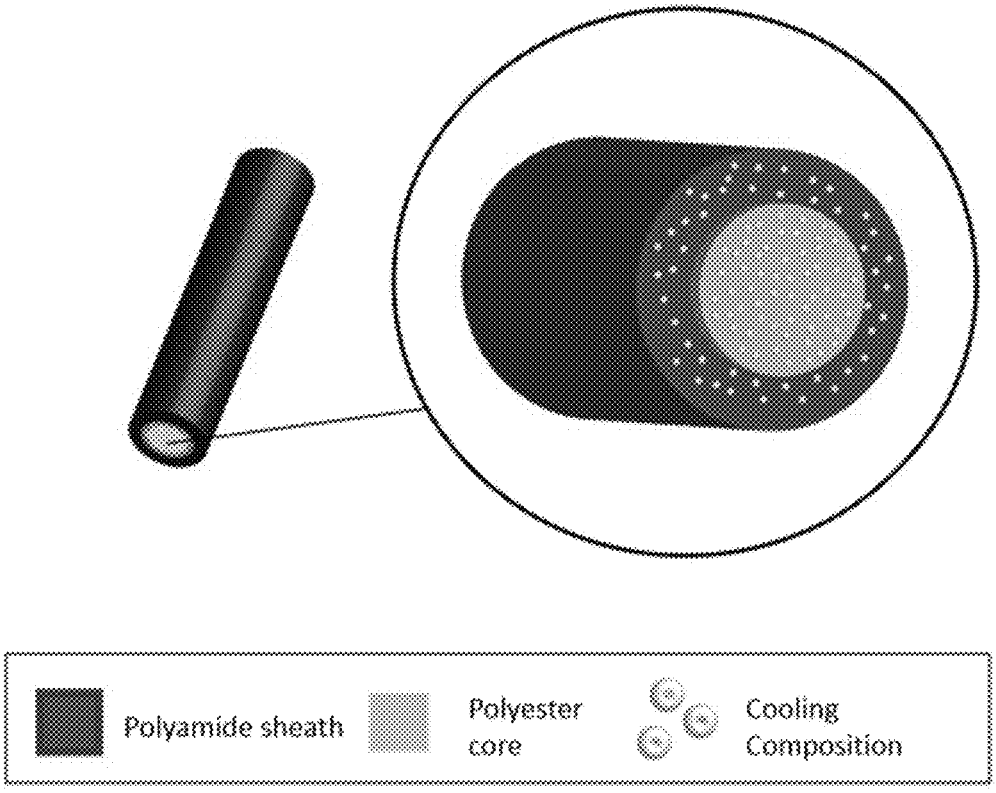
FIGS. 1A-1D show representative schematic views of disclosed composite yarns.

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Prior to describing the various aspects of the present disclosure, the following definitions are provided and should be used unless otherwise indicated. Additional terms may be defined elsewhere in the present disclosure.

A. Definitions

As used herein, "comprising" is to be interpreted as specifying the presence of the stated features, integers, steps, or components as referred to, but does not preclude the presence or addition of one or more features, integers, steps, or components, or groups thereof. Additionally, the term "comprising" is intended to include examples and aspects encompassed by the terms "consisting essentially of" and "consisting of." Similarly, the term "consisting essentially of" is intended to include examples encompassed by the term "consisting of."

As used in the specification and the appended claims, the singular forms "a," "an" and "the" include plural referents unless the context clearly dictates otherwise. Thus, for example, reference to "a polymer," "a yarn," or "a fabric," including, but not limited to, two or more such polymers, yarns, or fabrics, and the like.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about"

whether or not expressly stated to be such. It is understood that where "about," "approximate," or "at or about" is used before a quantitative value, the parameter also includes the specific quantitative value itself, unless specifically stated otherwise.

As used herein the terms "weight percent," "wt %," and "wt. %," which can be used interchangeably, indicate the percent by weight of a given component based on the total weight of a composition of which it is a component, unless otherwise specified. That is, unless otherwise specified, all wt % values are based on the total weight of the composition. It should be understood that the sum of wt % values for all components in a disclosed composition or formulation are equal to 100. Alternatively, if the wt % value is based on the total weight of a subset of components in a composition, it should be understood that the sum of wt % values the specified components in the disclosed composition or formulation are equal to 100.

As used herein, the term "effective amount" refers to an amount that is sufficient to achieve the desired modification of a physical property of the composition or material. For example, an "effective amount" of a cooling composition refers to an amount that is sufficient to achieve the desired improvement in the property modulated by the cooling composition, e.g. achieving the desired enhancement in Qmax compared to a yarn or fabric without the effective amount. The specific level in terms of wt % in a composition required as an effective amount will depend upon a variety of factors including the amount and type of polymer and yarn, fabric use, and the like.

As used herein, the terms "optional" or "optionally" means that the subsequently described event or circumstance can or cannot occur, and that the description includes instances where said event or circumstance occurs and instances where it does not.

As used herein, the term "transition metal" means an element whose atom has a partially filled d sub-shell, or which can give rise to cations with an incomplete d sub-shell, typically found in Groups 3-12 of the periodic table in Periods 4-7. Exemplary, but non-limiting, transition metals include titanium, vanadium, chromium, manganese, iron, cobalt, nickel, copper, zinc, yttrium, zirconium, silver, tungsten, platinum, and gold.

As used herein, "nanosilver" and "nano silver oxide," can be used interchangeably, and refer to silver oxide (i.e., silver (I) oxide, silver (II) oxide, or combinations thereof) in which the silver oxide is in a form comprising substantially a particulates, a powder, or combinations thereof, in which the particles and/or powder are nano-sized. That is the particles or powder, as appropriate, generally have a size of about 1 nm to about 1000 nm.

Unless otherwise specified, temperatures referred to herein are based on atmospheric pressure (i.e. one atmosphere).

B. Cooling Compositions

In one aspect, the disclosure relates to cooling compositions that can be used in manufacture of a yarn. More specifically, in one aspect, the present disclosure relates to a cooling polymer composition comprising a polymer and a cooling composition comprising a cooling material, a cooling compound, a cooling salt, or combinations thereof. Disclosed cooling polymer compositions can be fabricated in chips or pellets for use in a yarn or filament spinning apparatus or machine.

In various aspects, the polymer in a disclosed cooling polymer composition can comprise a polyester polymer, such as a polyethylene terephthalate, a polytrimethylene terephthalate, or combinations thereof. In some aspects, the polyester can comprise a polyethylene terephthalate. In further aspects, the polyester can comprise a polytrimethylene terephthalate. In still further aspects, the polyester is a polyeseter co-polymer comprising a polyethylene terephthalate, a polytrimethylene terephthalate, or combinations thereof. In a yet further aspect, the polyester can comprise a co-polymer comprising polyethylene terephthalate. In a further aspect, the polyester can comprise a co-polymer comprising polytrimethylene terephthalate.

In various aspects, the polymer in a disclosed cooling polymer composition can comprise a polyamide polymer, such as a nylon 6, nylon 4/6, nylon 6/6, nylon 6/10, nylon 6/12, nylon 11, nylon 12, or combinations thereof. In a further aspect, the polyamide can comprise a nylon 6/6. In a still further aspect, the polyamide is a polyamide co-polymer comprising nylon 6, nylon 4/6, nylon 6/6, nylon 6/10, nylon 6/12, nylon 11, nylon 12, or combinations thereof. In a yet further aspect, the polyamide is a polyamide co-polymer comprising nylon 6/6.

In an aspect, the cooling composition can be present in the cooling polymer composition present in an amount of about 0.001 wt % to about 5 wt % based on the total weight of the polymer and the cooling composition. In a further aspect, the cooling composition can be present in an amount, based on the total weight of the polymer and the cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %;

about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the cooling composition can be present in an amount of about 5.0 wt % to about 25 wt % based on the total weight of the polymer and the cooling composition. In a further aspect, the cooling composition can be present in an amount, based on the total weight of the polymer and the cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the cooling material can be present in the cooling composition in an amount of about 0.2 wt % to about 2 wt % of the cooling material; about 0.02 wt % to about 0.07 wt % of the cooling compound; about 0.001 wt % to about 0.02 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 0.5 wt % to about 1 wt % of the cooling material; about 0.03 wt % to about 0.05 wt % of the cooling compound; about 0.001 wt % to about 0.01 wt % of the cooling salt; or combinations thereof; and wherein the wt % is based on the total weight of the polymer and the cooling composition. In a yet further aspect, the cooling material can be present in the cooling composition in an amount of about 0.2 wt % to about 2 wt % of the cooling material; about 0.02 wt % to about 0.07 wt % of the cooling compound; and about 0.001 wt % to about 0.02 wt % of the cooling salt; and wherein the wt % is based on the total weight of the polymer and the cooling composition. In an even further aspect, the cooling material can be present in the cooling composition in an amount of about 0.5 wt % to about 1 wt % of the cooling material; about 0.03 wt % to about 0.05 wt % of the cooling compound; and about 0.001 wt % to about 0.01 wt % of the cooling salt; and wherein the wt % is based on the total weight of the polymer and the cooling composition.

In a further aspect, the cooling material can be present in the cooling composition in an amount of about 3.0 wt % to about 10.0 wt % of the cooling material; about 5.0 wt % to about 12.0 wt % of the cooling compound; about 0.3 wt % to about 4.0 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 4.0 wt % to about 8.0 wt % of the cooling material; about 5.5 wt % to about 11.0 wt % of the cooling compound; about 0.4 wt % to about 3.0 wt % of the cooling salt; or combinations thereof; and wherein the wt % is based on the total weight of the polymer and the cooling composition. In a yet further aspect, the cooling material can be present in the cooling composition in an amount of about 4.5 wt % to about 7.7 wt % of the cooling material; about 5.9 wt % to about 11.0 wt % of the cooling compound; and about 0.4 wt % to about 2.5 wt % of the cooling salt; and wherein the wt % is based on the total weight of the polymer and the cooling composition. In an even further aspect, the cooling material can be present in the cooling composition in an amount of about 5.0 wt % to about 7.2 wt % of the cooling material; about 6.4 wt % to about 10.5 wt % of the cooling compound; and about 0.5 wt % to about 2.1 wt % of the cooling salt; and wherein the wt % is based on the total weight of the polymer and the cooling composition. In a still further aspect, the cooling material can be present in the cooling composition in an amount of about 5.0 wt % to about 7.0 wt % of the cooling material; about 6.7 wt % to about 10.0 wt % of the cooling compound; and about 0.59 wt % to about 2.0 wt % of the cooling salt;

and wherein the wt % is based on the total weight of the polymer and the cooling composition.

In a further aspect, the cooling material can be present in the cooling composition in an amount of about 0.2 wt % to about 2 wt %; and wherein the wt % is based on the total weight of the polymer and the cooling composition. In a still further aspect, the cooling material can be present in an amount of about 0.4 wt % to about 1 wt %; and wherein the wt % is based on the total weight of the polymer and the cooling composition. In a yet further aspect, the cooling material can be present in an amount of about 0.5 wt % to about 0.9 wt %; and wherein the wt % is based on the total weight of the polymer and the cooling composition.

In a further aspect, the cooling material can be present in the cooling composition in an amount of about 3.0 wt % to about 10.0 wt %; and wherein the wt % is based on the total weight of the polymer and the cooling composition. In a still further aspect, the cooling material can be present in an amount of about 4.0 wt % to about 8.0 wt %; and wherein the wt % is based on the total weight of the polymer and the cooling composition. In a yet further aspect, the cooling material can be present in an amount of about 4.5 wt % to about 7.7 wt %; and wherein the wt % is based on the total weight of the polymer and the cooling composition. In a still further aspect, the cooling material can be present in an amount of about 5.0 wt % to about 7.2 wt %; and wherein the wt % is based on the total weight of the polymer and the cooling composition. In an even further aspect, the cooling material can be present in an amount of about 5.0 wt % to about 7.0 wt %; and wherein the wt % is based on the total weight of the polymer and the cooling composition.

In a further aspect, the cooling material can be present in the cooling composition, based on the total weight of the polymer and the cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the cooling material can be present in the cooling composition, based on the total weight of the polymer and the cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the cooling material comprises a metal, a metal alloy, a metal oxide, a carbon material, a ceramic material, a mineral, or combinations thereof.

In a further aspect, the cooling material comprises a metal oxide. Exemplary, but non-limiting, metal oxides useful for preparation of the cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the cooling material comprises a ceramic comprising aluminum oxide, aluminum titanate, zirconium oxide, aluminum nitride, silicon carbide, silicon nitride, silicon alumina nitride, or combinations thereof.

In a further aspect, the cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the cooling material, comprising a metal, a metal alloy, a metal oxide, a carbon material, a ceramic material, a mineral, or combinations thereof, can be in a form that is convenient for incorporation into the cooling polymer composition, such as a powder, a wire, a filament, a sheet, a particle, or combinations thereof. In other instances, the cooling material, comprising a metal, a metal alloy, a metal oxide, a carbon material, a ceramic material, a mineral, or combinations thereof, can be in the form of a particle, a powder, or combinations thereof. In some instances, the cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the cooling material is a metal, a metal alloy, a metal oxide, a carbon material, a ceramic material, a mineral, or combinations thereof, comprising microparticles. The microparticles in the cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the cooling compound can be present in the cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polymer and the cooling composition; and wherein the wt % is based on the total weight of the polymer and the cooling composition.

In a further aspect, the cooling compound can be present in the cooling polymer composition, based on the total weight of the polymer and the cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the cooling compound can be present in the cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polymer and the cooling composition.

In a further aspect, the cooling compound can be present in the cooling polymer composition, based on the total weight of the polymer and the cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The cooling compound can comprise a transition metal oxide, a Group 13 oxide, a Group 14 oxide, a Group 13 carbide, Group 14 carbide, or mixtures thereof. In some instances, the cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the cooling compound can comprise aluminum oxide, silicon dioxide, titanium dioxide, or combinations thereof. In a still further aspect, the cooling compound can comprise titanium dioxide. The cooling compound can be in the form of a powder, a particle, or combinations thereof. In a further aspect, the cooling compound can be in the form of a particle, such as a nanoparticle, a microparticle, or combinations thereof.

In various aspects, the cooling compound can be in a form that is convenient for incorporation into the cooling polymer composition, such as a powder, a wire, a filament, a sheet, a particle, or combinations thereof. In other instances, the cooling compound can be in the form of a particle, a powder, or combinations thereof. In some instances, the cooling compound is in the form of a particle, including forms such as a nanoparticle, a microparticle, or combinations thereof.

In various aspects, the cooling compound comprises a particle form of the cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the cooling compound comprises a particle form of the cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the cooling compound can comprise nanoparticles having a size of about 10 nm to about 100 nm. In a still further aspect, the cooling compound can comprise nanoparticles having a size of about 15 nm to about 50 nm. In a yet further aspect, the cooling compound can comprise nanoparticles having a size of about 20 nm to about 40 nm. In an even further aspect, the cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the cooling composition comprises a cooling salt present in an amount, based on the total weight of the polymer and the cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the cooling composition comprises a cooling salt present in an amount, based on the total weight of the polymer and the cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The cooling composition comprises a cooling salt comprising a transition metal salt, a Group I salt, a Group II salt, or combinations thereof. In some instances, the cooling salt is a Group I salt. In other instances, the cooling salt is a Group II salt. In further instances, the cooling salt is a transition metal salt. The cooling salt can comprise a Group I carbonate, a Group I halide, a Group I nitrate, or combinations thereof. Alternatively, the cooling salt can comprise a Group II carbonate, a Group II halide, a Group II nitrate, or combinations thereof. In further aspects, the cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the cooling salt can be in a form that is convenient for incorporation into the cooling polymer composition, such as a powder, a wire, a filament, a sheet, a particle, or combinations thereof. In other instances, the cooling salt can be in the form of a particle, a powder, or combinations thereof. In some instances, the cooling salt is in the form of a particle, including forms such as a nanoparticle, a microparticle, or combinations thereof.

The cooling salt in the cooling composition can be in the form of a powder, a particle, or combinations thereof. In some aspects, the cooling salt in the cooling composition comprises particles having a size of about 10 μm to about 1000 μm. In a further aspect, the salt in the cooling composition comprises particles having a size of about 30 μm to about 500 μm.

In various aspects, the cooling salt in the cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390 μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the cooling salt can comprise nanoparticles having a size of about 10 nm to about 100 nm. In a still further aspect, the cooling salt can comprise nanoparticles having a size of about 15 nm to about 50 nm. In a yet further aspect, the cooling salt can comprise nanoparticles having a size of about 20 nm to about 40 nm. In an even further aspect, the cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

C. Composite Yarns

In one aspect, the disclosure relates to composite yarns, comprising a core component and a sheath layer that can be used in manufacture of a double covered yarn or utilized in a woven or knit fabric. More specifically, in one aspect, the present disclosure relates to composite yarns comprising a core component and a sheath layer, where: (a) the core component comprises a polyester polymer and a first cooling composition; and (b) the sheath layer comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

In various aspects, a disclosed composite yarn comprises about 20 wt % to about 80 wt % of a polyester polymer and about 80 wt % to about 20 wt % of a polyamide polymer, based on the total weight of the composite yarn. In a further aspect, a disclosed composite yarn comprises about 50 wt % to about 70 wt % of a polyester polymer and about 50 wt % to about 30 wt % of a polyamide polymer, based on the total weight of the composite yarn. In a still further aspect, a disclosed composite yarn comprises about 55 wt % to about 65 wt % of a polyester polymer and about 45 wt % to about 35 wt % of a polyamide polymer, based on the total weight of the composite yarn. In a yet further aspect, a disclosed composite yarn comprises about 57 wt % to about 63 wt % of a polyester polymer and about 43 wt % to about 37 wt % of a polyamide polymer, based on the total weight of the composite yarn. a disclosed composite yarn comprises about 58 wt % to about 62 wt % of a polyester polymer and about 42 wt % to about 38 wt % of a polyamide polymer, based on the total weight of the composite yarn.

In a further aspect, a disclosed composite yarn comprises a polyester polymer in a weight percent amount based on the total weight of the composite yarn of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In a further aspect, a disclosed composite yarn comprises a polyamide polymer in a weight percent amount based on the total weight of the composite yarn of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In various aspects, the polyester polymer is a polyethylene terephthalate, a polytrimethylene terephthalate, or combinations thereof. In a further aspect, the polyester polymer is a polyethylene terephthalate. In a still further aspect, the polyester polymer is a polytrimethylene terephthalate.

In various aspects, the polyamide polymer can comprise a nylon 6, nylon 4/6, nylon 6/6, nylon 6/10, nylon 6/12, nylon 11, nylon 12, or combinations thereof. In a further aspect, the polyamide polymer can comprise a nylon 6, a nylon 6/6, a nylon 6/12, or combinations thereof. In a still further aspect, the polyamide polymer can comprise a nylon 6/6.

Figure 1B:
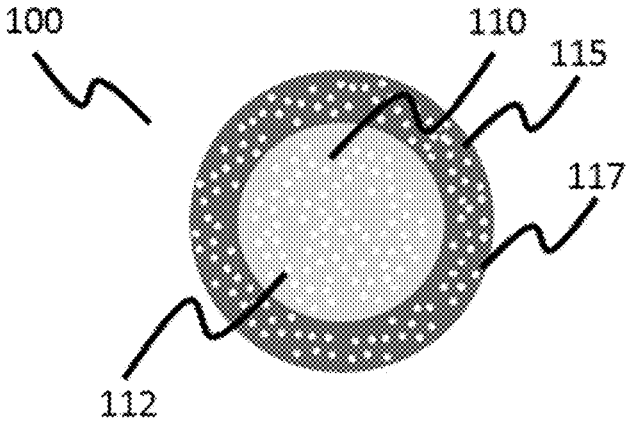
Figure 1C:
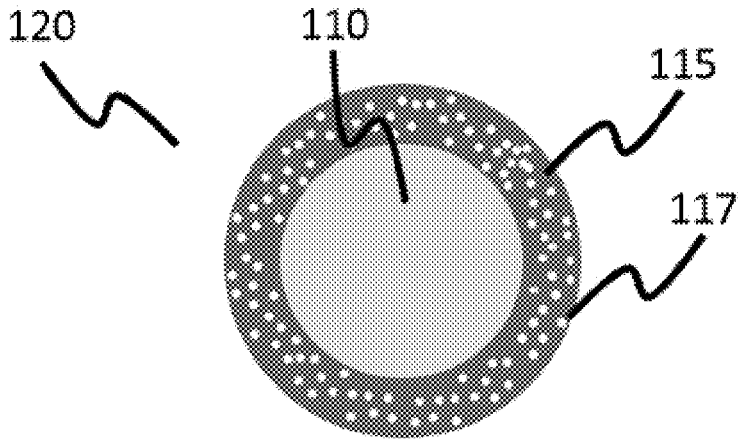
Figure 1D:
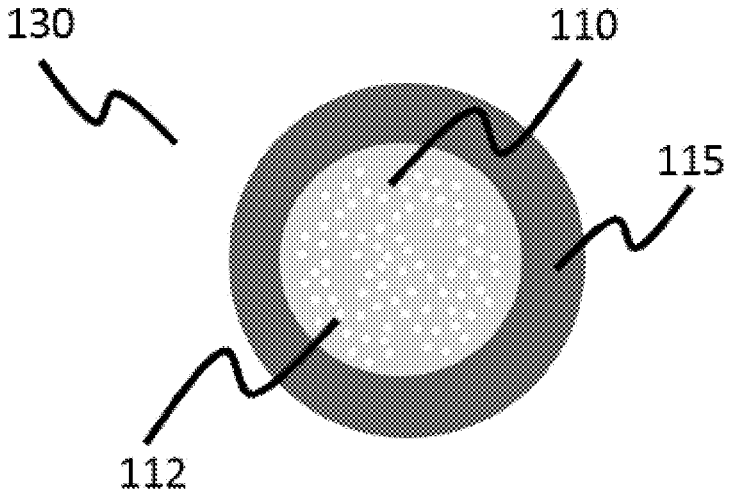

Referring now to FIGS. 1A-1D, which show representative schematic views of disclosed composite yarns. FIG. 1A shows a side on cross-sectional view of a portion of a disclosed composite yarn with a cross-sectional view of an end thereof. An enlarged view of the cross-sectional end view is highlighted. A key is shown beneath the views indicating the gray-scale colors associated with a sheath layer, a core component, and distribution of one or more cooling compositions in each of the sheath layer and core component. FIG. 1B shows a cross-sectional view of a disclosed composite yarn, 100, with aspects specified as follows: a polyester core, 110; a first cooling composition, 112; a polyamide sheath, 115; and a second cooling composition, 117. FIG. 1C shows a cross-sectional view of a disclosed composite yarn, 120, with aspects specified as follows: a polyester core, 110; a polyamide sheath, 115; and a second cooling composition, 117. FIG. 1D shows a cross-sectional view of a disclosed composite yarn, 130, with aspects specified as follows: a polyester core, 110; a first cooling composition, 112; and a polyamide sheath, 115.

In an aspect, the first cooling composition can be present in an amount of about 0.001 wt % to about 5 wt % based on the total weight of the polyester polymer and the first cooling composition. In a further aspect, the first cooling composition can be present in an amount, based on the total weight of the polyester polymer and the first cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the first cooling composition can be present in an amount of about 5.0 wt % to about 25 wt % based on the total weight of the polyester polymer and the first cooling composition. In a further aspect, the first cooling composition can be present in an amount, based on the total weight of the polyester polymer and the first cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %;

about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.2 wt % to about 2 wt % of the first cooling material; about 0.02 wt % to about 0.07 wt % of the first cooling compound; about 0.001 wt % to about 0.02 wt % of the first cooling salt; or combinations thereof; and wherein the wt % is based on the total weight of the polyester polymer and the first cooling composition. In a still further aspect, the first cooling material can be present in the first cooling composition, based on the total weight of the polyester polymer and the first cooling composition, in an amount of about 0.5 wt % to about 1 wt % of the first cooling material; about 0.03 wt % to about 0.05 wt % of the first cooling compound; about 0.001 wt % to about 0.01 wt % of the first cooling salt; or combinations thereof; and wherein the wt % is based on the total weight of the polyester polymer and the first cooling composition. In a yet further aspect, the first cooling material can be present in the first cooling composition in an amount of about 0.2 wt % to about 2 wt % of the first cooling material; about 0.02 wt % to about 0.07 wt % of the first cooling compound; and about 0.001 wt % to about 0.02 wt % of the first cooling salt; and wherein the wt % is based on the total weight of the polyester polymer and the first cooling composition. In an even further aspect, the first cooling material can be present in the first cooling composition in an amount of about 0.5 wt % to about 1 wt % of the first cooling material; about 0.03 wt % to about 0.05 wt % of the first cooling compound; and about 0.001 wt % to about 0.01 wt % of the first cooling salt; and wherein the wt % is based on the total weight of the polyester polymer and the first cooling composition.

In a further aspect, the first cooling material can be present in the first cooling composition in an amount of about 3.0 wt % to about 10.0 wt % of the first cooling material; about 5.0 wt % to about 12.0 wt % of the first cooling compound; about 0.3 wt % to about 4.0 wt % of the first cooling salt; or combinations thereof; and wherein the wt % is based on the total weight of the polyester polymer and the first cooling composition. In a still further aspect, the first cooling material can be present in the first cooling composition, based on the total weight of the polyester polymer and the first cooling composition, in an amount of about 4.0 wt % to about 8.0 wt % of the first cooling material; about 5.5 wt % to about 11.0 wt % of the first cooling compound; about 0.4 wt % to about 3.0 wt % of the first cooling salt; or combinations thereof; and wherein the wt % is based on the total weight of the polyester polymer and the first cooling composition. In a yet further aspect, the first cooling material can be present in the first cooling composition in an amount of about 4.5 wt % to about 7.7 wt % of the first cooling material; about 5.9 wt % to about 11.0 wt % of the first cooling compound; and about 0.4 wt % to about 2.5 wt % of the first cooling salt; and wherein the wt % is based on the total weight of the polyester polymer and the first cooling composition. In an even further aspect, the first cooling material can be present in the first cooling composition in an amount of about 5.0 wt % to about 7.2 wt % of the first cooling material; about 6.4 wt % to about 10.5 wt % of the first cooling compound; and about 0.5 wt % to about 2.1 wt % of the first cooling salt; and wherein the wt % is based on the total weight of the polyester polymer and the first cooling composition. In a still further aspect, the first cooling material can be present in the first cooling composition in an amount of about 5.0 wt % to about 7.0 wt % of the first cooling material; about 6.7 wt % to about 10.0 wt % of the first cooling compound; and about 0.59 wt % to about 2.0 wt % of the first cooling salt; and wherein the wt % is based on the total weight of the polyester polymer and the first cooling composition.

In a further aspect, the first cooling material can be present in the first cooling composition in an amount of about 0.2 wt % to about 2 wt %; and wherein the wt % is based on the total weight of the polyester polymer and the first cooling composition. In a still further aspect, the first cooling material can be present in an amount of about 0.4 wt % to about 1 wt %; and wherein the wt % is based on the total weight of the polyester polymer and the first cooling composition. In a yet further aspect, the first cooling material can be present in an amount of about 0.5 wt % to about 0.9 wt %; and wherein the wt % is based on the total weight of the polyester polymer and the first cooling composition.

In a further aspect, the first cooling material can be present in the first cooling composition in an amount of about 3.0 wt % to about 10.0 wt %; and wherein the wt % is based on the total weight of the polyester polymer and the first cooling composition. In a still further aspect, the first cooling material can be present in an amount of about 4.0 wt % to about 8.0 wt %; and wherein the wt % is based on the total weight of the polyester polymer and the first cooling composition. In a yet further aspect, the first cooling material can be present in an amount of about 4.5 wt % to about 7.7 wt %; and wherein the wt % is based on the total weight of the polyester polymer and the first cooling composition. In a still further aspect, the first cooling material can be present in an amount of about 5.0 wt % to about 7.2 wt %; and wherein the wt % is based on the total weight of the polyester polymer and the first cooling composition. In an even further aspect, the first cooling material can be present in an amount of about 5.0 wt % to about 7.0 wt %; and wherein the wt % is based on the total weight of the polyester polymer and the first cooling composition.

In a further aspect, the first cooling material can be present in the first cooling composition, based on the total weight of the polyester polymer and the first cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the first cooling material can be present in the first cooling composition, based on the total weight of the polyester polymer and the first cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the first cooling material comprises a metal, a metal alloy, a metal oxide, a carbon material, a ceramic material, a mineral, or combinations thereof.

In a further aspect, the first cooling material comprises a metal oxide. Exemplary, but non-limiting, metal oxides useful for preparation of the first cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the first cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the first cooling material comprises a ceramic comprising aluminum oxide, aluminum titanate, zirconium oxide, aluminum nitride, silicon carbide, silicon nitride, silicon alumina nitride, or combinations thereof.

In a further aspect, the first cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the first cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the first cooling material, comprising a metal, a metal alloy, a metal oxide, a carbon material, a ceramic material, a mineral, or combinations thereof, can be in a form that is convenient for incorporation into the first cooling polymer composition, such as a powder, a wire, a filament, a sheet, a particle, or combinations thereof. In other instances, the first cooling material, comprising a metal, a metal alloy, a metal oxide, a carbon material, a ceramic material, a mineral, or combinations thereof, can be in the form of a particle, a powder, or combinations thereof. In some instances, the first cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the first cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the first cooling material is a metal, a metal alloy, a metal oxide, a carbon material, a ceramic material, a mineral, or combinations thereof, comprising microparticles. The microparticles in the first cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the first cooling compound can be present in the first cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polyester polymer and the first cooling composition; and wherein the wt % is based on the total weight of the polyester polymer and the first cooling composition.

In a further aspect, the first cooling compound can be present in the first cooling polymer composition, based on the total weight of the polyester polymer and the first cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the first cooling compound can be present in the first cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polyester polymer and the first cooling composition.

In a further aspect, the first cooling compound can be present in the first cooling polymer composition, based on the total weight of the polyester polymer and the first cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The first cooling compound can comprise a transition metal oxide, a Group 13 oxide, a Group 14 oxide, a Group 13 carbide, Group 14 carbide, or mixtures thereof. In some instances, the first cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the first cooling compound can comprise aluminum oxide, silicon dioxide, titanium dioxide, or combinations thereof. In a still further aspect, the first cooling compound can comprise titanium dioxide. The first cooling compound can be in the form of a powder, a particle, or combinations thereof. In a further aspect, the first cooling compound can be in the form of a particle, such as a nanoparticle, a microparticle, or combinations thereof.

In various aspects, the first cooling compound can be in a form that is convenient for incorporation into the first cooling polymer composition, such as a powder, a wire, a filament, a sheet, a particle, or combinations thereof. In other instances, the first cooling compound can be in the form of a particle, a powder, or combinations thereof. In some instances, the first cooling compound is in the form of a particle, including forms such as a nanoparticle, a microparticle, or combinations thereof.

In various aspects, the first cooling compound comprises a particle form of the first cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the first cooling compound comprises a particle form of the first cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the first cooling compound can comprise nanoparticles having a size of about 10 nm to about 100 nm. In a still further aspect, the first cooling compound can comprise nanoparticles having a size of about 15 nm to about 50 nm. In a yet further aspect, the first cooling compound can comprise nanoparticles having a size of about 20 nm to about 40 nm. In an even further aspect, the first cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the first cooling composition comprises a first cooling salt present in an amount, based on the total weight of the polyester polymer and the first cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the first cooling composition comprises a first cooling salt present in an amount, based on the total weight of the polyester polymer and the first cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the first cooling composition comprises a first cooling salt present in an amount, based on the total weight of the polyester polymer and the first cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the first cooling composition comprises a first cooling salt present in an amount, based on the total weight of the polyester polymer and the first cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The first cooling composition comprises a first cooling salt comprising a transition metal salt, a Group I salt, a Group II salt, or combinations thereof. In some instances, the first cooling salt is a Group I salt. In other instances, the first cooling salt is a Group II salt. In further instances, the first cooling salt is a transition metal salt. The first cooling salt can comprise a Group I carbonate, a Group I halide, a Group I nitrate, or combinations thereof. Alternatively, the first cooling salt can comprise a Group II carbonate, a Group II halide, a Group II nitrate, or combinations thereof. In further aspects, the first cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the first cooling salt can be in a form that is convenient for incorporation into the first cooling polymer composition, such as a powder, a wire, a filament, a sheet, a particle, or combinations thereof. In other instances, the first cooling salt can be in the form of a particle, a powder, or combinations thereof. In some instances, the first cooling salt is in the form of a particle, including forms such as a nanoparticle, a microparticle, or combinations thereof.

The first cooling salt in the first cooling composition can be in the form of a powder, a particle, or combinations thereof. In some aspects, the first cooling salt in the first cooling composition comprises particles having a size of about 10 μm to about 1000 μm. In a further aspect, the salt in the first cooling composition comprises particles having a size of about 30 μm to about 500 μm.

In various aspects, the first cooling salt in the first cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390 μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the first cooling salt can comprise nanoparticles having a size of about 10 nm to about 100 nm. In a still further aspect, the first cooling salt can comprise nanoparticles having a size of about 15 nm to about 50 nm. In a yet further aspect, the first cooling salt can comprise nanoparticles having a size of about 20 nm to about 40 nm. In an even further aspect, the first cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In an aspect, the second cooling composition can be present in an amount of about 0.001 wt % to about 5 wt % based on the total weight of the polyamide polymer and the second cooling composition. In a further aspect, the second cooling composition can be present in an amount, based on the total weight of the polyamide polymer and the second cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the second cooling composition can be present in an amount of about 5.0 wt % to about 25 wt % based on the total weight of the polyamide polymer and the second cooling composition. In a further aspect, the second cooling composition can be present in an amount, based on the total weight of the polyamide polymer and the second cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.2 wt % to about 2 wt % of the second cooling material; about 0.02 wt % to about 0.07 wt % of the second cooling compound; about 0.001 wt % to about 0.02 wt % of the second cooling salt; or combinations thereof; and wherein the wt % is based on the total weight of the polyamide polymer and the second cooling composition. In a still further aspect, the second cooling material can be present in the second cooling composition, based on the total weight of the polyamide polymer and the second cooling composition, in an amount of about 0.5 wt % to about 1 wt % of the second cooling material; about 0.03 wt % to about 0.05 wt % of the second cooling compound; about 0.001 wt % to about 0.01 wt % of the second cooling salt; or combinations thereof; and wherein the wt % is based on the total weight of the polyamide polymer and the second cooling composition. In a yet further aspect, the second cooling material can be present in the second cooling composition in an amount of about 0.2 wt % to about 2 wt % of the second cooling material; about 0.02 wt % to about 0.07 wt % of the second cooling compound; and about 0.001 wt % to about 0.02 wt % of the second cooling salt; and wherein the wt % is based on the total weight of the polyamide polymer and the second cooling composition. In an even further aspect, the second cooling material can be present in the second cooling composition in an amount of about 0.5 wt % to about 1 wt % of the second cooling material; about 0.03 wt % to about 0.05 wt % of the second cooling compound; and about 0.001 wt % to about 0.01 wt % of the second cooling salt; and wherein the wt % is based on the total weight of the polyamide polymer and the second cooling composition.

In a further aspect, the second cooling material can be present in the second cooling composition in an amount of about 3.0 wt % to about 10.0 wt % of the second cooling material; about 5.0 wt % to about 12.0 wt % of the second cooling compound; about 0.3 wt % to about 4.0 wt % of the second cooling salt; or combinations thereof; and wherein the wt % is based on the total weight of the polyamide polymer and the second cooling composition. In a still further aspect, the second cooling material can be present in the second cooling composition, based on the total weight of the polyamide polymer and the second cooling composition, in an amount of about 4.0 wt % to about 8.0 wt % of the second cooling material; about 5.5 wt % to about 11.0 wt % of the second cooling compound; about 0.4 wt % to about 3.0 wt % of the second cooling salt; or combinations thereof; and wherein the wt % is based on the total weight of the polyamide polymer and the second cooling composition. In a yet further aspect, the second cooling material can be present in the second cooling composition in an amount of about 4.5 wt % to about 7.7 wt % of the second cooling material; about 5.9 wt % to about 11.0 wt % of the second cooling compound; and about 0.4 wt % to about 2.5 wt % of the second cooling salt; and wherein the wt % is based on the total weight of the polyamide polymer and the second cooling composition. In an even further aspect, the second cooling material can be present in the second cooling composition in an amount of about 5.0 wt % to about 7.2 wt % of the second cooling material; about 6.4 wt % to about 10.5 wt % of the second cooling compound; and about 0.5 wt % to about 2.1 wt % of the second cooling salt; and wherein the wt % is based on the total weight of the polyamide polymer and the second cooling composition. In a still further aspect, the second cooling material can be present in the second cooling composition in an amount of about 5.0 wt % to about 7.0 wt % of the second cooling material; about 6.7 wt % to about 10.0 wt % of the second cooling compound; and about 0.59 wt % to about 2.0 wt % of the second cooling salt; and wherein the wt % is based on the total weight of the polyamide polymer and the second cooling composition.

In a further aspect, the second cooling material can be present in the second cooling composition in an amount of about 0.2 wt % to about 2 wt %; and wherein the wt % is based on the total weight of the polyamide polymer and the second cooling composition. In a still further aspect, the second cooling material can be present in an amount of about 0.4 wt % to about 1 wt %; and wherein the wt % is based on the total weight of the polyamide polymer and the second cooling composition. In a yet further aspect, the second cooling material can be present in an amount of about 0.5 wt % to about 0.9 wt %; and wherein the wt % is based on the total weight of the polyamide polymer and the second cooling composition.

In a further aspect, the second cooling material can be present in the second cooling composition in an amount of about 3.0 wt % to about 10.0 wt %; and wherein the wt % is based on the total weight of the polyamide polymer and the second cooling composition. In a still further aspect, the second cooling material can be present in an amount of about 4.0 wt % to about 8.0 wt %; and wherein the wt % is based on the total weight of the polyamide polymer and the second cooling composition. In a yet further aspect, the second cooling material can be present in an amount of about 4.5 wt % to about 7.7 wt %; and wherein the wt % is based on the total weight of the polyamide polymer and the second cooling composition. In a still further aspect, the second cooling material can be present in an amount of about 5.0 wt % to about 7.2 wt %; and wherein the wt % is based on the total weight of the polyamide polymer and the second cooling composition. In an even further aspect, the second cooling material can be present in an amount of about 5.0 wt % to about 7.0 wt %; and wherein the wt % is based on the total weight of the polyamide polymer and the second cooling composition.

In a further aspect, the second cooling material can be present in the second cooling composition, based on the total weight of the polyamide polymer and the second cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the second cooling material can be present in the second cooling composition, based on the total weight of the polyamide polymer and the second cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the second cooling material comprises a metal, a metal alloy, a metal oxide, a carbon material, a ceramic material, a mineral, or combinations thereof.

In a further aspect, the second cooling material comprises a metal oxide. Exemplary, but non-limiting, metal oxides useful for preparation of the second cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the second cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the second cooling material comprises a ceramic comprising aluminum oxide, aluminum titanate, zirconium oxide, aluminum nitride, silicon carbide, silicon nitride, silicon alumina nitride, or combinations thereof.

In a further aspect, the second cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the second cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the second cooling material, comprising a metal, a metal alloy, a metal oxide, a carbon material, a ceramic material, a mineral, or combinations thereof, can be in a form that is convenient for incorporation into the second cooling polymer composition, such as a powder, a wire, a filament, a sheet, a particle, or combinations thereof. In other instances, the second cooling material, comprising a metal, a metal alloy, a metal oxide, a carbon material, a ceramic material, a mineral, or combinations thereof, can be in the form of a particle, a powder, or combinations thereof. In some instances, the second cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the second cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the second cooling material is a metal, a metal alloy, a metal oxide, a carbon material, a ceramic material, a mineral, or combinations thereof, comprising microparticles. The microparticles in the second cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the second cooling compound can be present in the second cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polyamide polymer and the second cooling composition; and wherein the wt % is based on the total weight of the polyamide polymer and the second cooling composition.

In a further aspect, the second cooling compound can be present in the second cooling polymer composition, based on the total weight of the polyamide polymer and the second cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the second cooling compound can be present in the second cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polyamide polymer and the second cooling composition.

In a further aspect, the second cooling compound can be present in the second cooling polymer composition, based on the total weight of the polyamide polymer and the second cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The second cooling compound can comprise a transition metal oxide, a Group 13 oxide, a Group 14 oxide, a Group 13 carbide, Group 14 carbide, or mixtures thereof. In some instances, the second cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the second cooling compound can comprise aluminum oxide, silicon dioxide, titanium dioxide, or combinations thereof. In a still further aspect, the second cooling compound can comprise titanium dioxide. The second cooling compound can be in the form of a powder, a particle, or combinations thereof. In a further aspect, the second cooling compound can be in the form of a particle, such as a nanoparticle, a microparticle, or combinations thereof.

In various aspects, the second cooling compound can be in a form that is convenient for incorporation into the second cooling polymer composition, such as a powder, a wire, a filament, a sheet, a particle, or combinations thereof. In other instances, the second cooling compound can be in the form of a particle, a powder, or combinations thereof. In some instances, the second cooling compound is in the form of a particle, including forms such as a nanoparticle, a microparticle, or combinations thereof.

In various aspects, the second cooling compound comprises a particle form of the second cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the second cooling compound comprises a particle form of the second cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the second cooling compound can comprise nanoparticles having a size of about 10 nm to about 100 nm. In a still further aspect, the second cooling compound can comprise nanoparticles having a size of about 15 nm to about 50 nm. In a yet further aspect, the second cooling compound can comprise nanoparticles having a size of about 20 nm to about 40 nm. In an even further aspect, the second cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the second cooling composition comprises a second cooling salt present in an amount, based on the total weight of the polyamide polymer and the second cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the second cooling composition comprises a second cooling salt present in an amount, based on the total weight of the polyamide polymer and the second cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the second cooling composition comprises a second cooling salt present in an amount, based on the total weight of the polyamide polymer and the second cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the second cooling composition comprises a second cooling salt present in an amount, based on the total weight of the polyamide polymer and the second cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The second cooling composition comprises a second cooling salt comprising a transition metal salt, a Group I salt, a Group II salt, or combinations thereof. In some instances, the second cooling salt is a Group I salt. In other instances, the second cooling salt is a Group II salt. In further instances, the second cooling salt is a transition metal salt. The second cooling salt can comprise a Group I carbonate, a Group I halide, a Group I nitrate, or combinations thereof. Alternatively, the second cooling salt can comprise a Group II carbonate, a Group II halide, a Group II nitrate, or combinations thereof. In further aspects, the second cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the second cooling salt can be in a form that is convenient for incorporation into the second cooling polymer composition, such as a powder, a wire, a filament, a sheet, a particle, or combinations thereof. In other instances, the second cooling salt can be in the form of a particle, a powder, or combinations thereof. In some instances, the second cooling salt is in the form of a particle, including forms such as a nanoparticle, a microparticle, or combinations thereof.

The second cooling salt in the second cooling composition can be in the form of a powder, a particle, or combinations thereof. In some aspects, the second cooling salt in the second cooling composition comprises particles having a size of about 10 μm to about 1000 μm. In a further aspect, the salt in the second cooling composition comprises particles having a size of about 30 μm to about 500 μm.

In various aspects, the second cooling salt in the second cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390 μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the second cooling salt can comprise nanoparticles having a size of about 10 nm to about 100 nm. In a still further aspect, the second cooling salt can comprise nanoparticles having a size of about 15 nm to about 50 nm. In a yet further aspect, the second cooling salt can comprise nanoparticles having a size of about 20 nm to about 40 nm. In an even further aspect, the second cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In an aspect, the first cooling composition can be present in an amount of about 0.1 wt % to about 2 wt % based on the total weight of the composite yarn. In a further aspect, the first cooling composition can be present in an amount, based on the total weight of the composite yarn of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In an aspect, the first cooling composition can be present in an amount of about 2.0 wt % to about 10 wt % based on the total weight of the composite yarn. In a further aspect, the first cooling composition can be present in an amount, based on the total weight of the composite yarn of about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.1 wt % to about 1 wt % of the first cooling material; about 0.005 wt % to about 0.07 wt % of the first cooling compound; about 0.0005 wt % to about 0.02 wt % of the first cooling salt; or combinations thereof; and wherein the wt % is based on the total weight of the composite yarn. In a still further aspect, the first cooling material can be present in the first cooling composition, based on the total weight of the composite yarn, in an amount of about 0.2 wt % to about 0.9 wt % of the first cooling material; about 0.01 wt % to about 0.06 wt % of the first cooling compound; about 0.0005 wt % to about 0.01 wt % of the first cooling salt; or combinations thereof; and wherein the wt % is based on the total weight of the composite yarn. In a yet further aspect, the first cooling material can be present in the first cooling composition in an amount of about 0.2 wt % to about 0.8 wt % of the first cooling material; about 0.01 wt % to about 0.05 wt % of the first cooling compound; and about 0.0005 wt % to about 0.015 wt % of the first cooling salt; and wherein the wt % is based on the total weight of the composite yarn. In an even further aspect, the first cooling material can be present in the first cooling composition in an amount of about 0.25 wt % to about 0.65 wt % of the first cooling material; about 0.015 wt % to about 0.40 wt % of the first cooling compound; and about 0.0005 wt % to about 0.01 wt % of the first cooling salt; and wherein the wt % is based on the total weight of the composite yarn.

In a further aspect, the first cooling material can be present in the first cooling composition in an amount of about 0.5 wt % to about 7.0 wt % of the first cooling material; about 1.0 wt % to about 10.0 wt % of the first cooling compound; about 0.05 wt % to about 3.0 wt % of the first cooling salt; or combinations thereof; and wherein the wt % is based on the total weight of the composite yarn. In a still further aspect, the first cooling material can be present in the first cooling composition, based on the total weight of the composite yarn, in an amount of about 1.0 wt % to about 6.0 wt % of the first cooling material; about 1.5 wt % to about 7.0 wt % of the first cooling compound; about 0.1 wt % to about 2.0 wt % of the first cooling salt; or combinations thereof; and wherein the wt % is based on the total weight of the composite yarn. In a yet further aspect, the first cooling material can be present in the first cooling composition in an amount of about 1.0 wt % to about 5.0 wt % of the first cooling material; about 1.5 wt % to about 6.0 wt % of the first cooling compound; and about 0.1 wt % to about 1.5 wt % of the first cooling salt; and wherein the wt % is based on the total weight of the composite yarn. In an even further aspect, the first cooling material can be present in the first cooling composition in an amount of about 1.0 wt % to about 4.0 wt % of the first cooling material; about 2.0 wt % to about 5.0 wt % of the first cooling compound; and about 0.1 wt % to about 1.0 wt % of the first cooling salt; and wherein the wt % is based on the total weight of the composite yarn. In a still further aspect, the first cooling material can be present in the first cooling composition in an amount of about 1.5 wt % to about 3.0 wt % of the first cooling material; about 2.0 wt % to about 4.0 wt % of the first cooling compound; and about 0.15 wt % to about 1.0 wt % of the first cooling salt; and wherein the wt % is based on the total weight of the composite yarn.

In a further aspect, the first cooling material can be present in the first cooling composition in an amount of about 0.1 wt % to about 1 wt %; and wherein the wt % is based on the total weight of the composite yarn. In a still further aspect, the first cooling material can be present in an amount of about 0.2 wt % to about 0.9 wt %; and wherein the wt % is based on the total weight of the composite yarn. In a yet further aspect, the first cooling material can be present in an amount of about 0.2 wt % to about 0.8 wt %; and wherein the wt % is based on the total weight of the composite yarn. In an even further aspect, the first cooling material can be present in an amount of about 0.25 wt % to about 0.65 wt %; and wherein the wt % is based on the total weight of the composite yarn.

In a further aspect, the first cooling material can be present in the first cooling composition, based on the total weight of the composite yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.5 wt % to about 7.0 wt %; and wherein the wt % is based on the total weight of the composite yarn. In a still further aspect, the first cooling material can be present in an amount of about 1.0 wt % to about 6.0 wt %; and wherein the wt % is based on the total weight of the composite yarn. In a yet further aspect, the first cooling material can be present in an amount of about 1.0 wt % to about 5.0 wt %; and wherein the wt % is based on the total weight of the composite yarn. In a still further aspect, the first cooling material can be present in an amount of about 1.0 wt % to about 4.0 wt %; and wherein the wt % is based on the total weight of the composite yarn. In an even further aspect, the first cooling material can be present in an amount of about 1.5 wt % to about 3.0 wt %; and wherein the wt % is based on the total weight of the composite yarn.

In a further aspect, the first cooling material can be present in the first cooling composition, based on the total weight of the composite yarn, in an amount of about 1.0 wt %, about 1.1 wt %; about 1.2 wt %; about 1.3 wt %; about 1.4 wt %; about 1.5 wt %; about 1.6 wt %; about 4.7 wt %; about 4.8 wt %; about 4.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In a further aspect, the first cooling compound can be present in the first cooling composition in an amount of about 0.005 wt % to about 0.07 wt %; about 0.01 wt % to about 0.06 wt %; about 0.01 wt % to about 0.05 wt %; about 0.015 wt % to about 0.40 wt %; and wherein the wt % is based on the total weight of the composite yarn; and wherein the wt % is based on the total weight of the composite yarn.

In a further aspect, the first cooling compound can be present in the first cooling composition, based on the total weight of the composite yarn, in an amount of about 0.0050 wt %; about 0.0051 wt %; about 0.0052 wt %; about 0.0053 wt %; about 0.0054 wt %; about 0.0055 wt %; about 0.0056 wt %; about 0.0057 wt %; about 0.0058 wt %; about 0.0059 wt %; about 0.0060 wt %; about 0.0061 wt %; about 0.0062 wt %; about 0.0063 wt %; about 0.0064 wt %; about 0.0065 wt %; about 0.0066 wt %; about 0.0067 wt %; about 0.0068 wt %; about 0.0069 wt %; about 0.0070 wt %; about 0.0071 wt %; about 0.0072 wt %; about 0.0073 wt %; about 0.0074 wt %; about 0.0075 wt %; about 0.0076 wt %; about 0.0077 wt %; about 0.0078 wt %; about 0.0079 wt %; about 0.0080 wt %; about 0.0081 wt %; about 0.0082 wt %; about 0.0083 wt %; about 0.0084 wt %; about 0.0085 wt %; about 0.0086 wt %; about 0.0087 wt %; about 0.0088 wt %; about 0.0089 wt %; about 0.0090 wt %; about 0.0091 wt %; about 0.0092 wt %; about 0.0093 wt %; about 0.0094 wt %; about 0.0095 wt %; about 0.0096 wt %; about 0.0097 wt %; about 0.0098 wt %; about 0.0099 wt %; about 0.0100 wt %; about 0.0110 wt %; about 0.0120 wt %; about 0.0130 wt %; about 0.0140 wt %; about 0.0150 wt %; about 0.0160 wt %; about 0.0170 wt %; about 0.0180 wt %; 0.0190 wt %; about 0.0200 wt %; about 0.0210 wt %; about 0.0220 wt %; about 0.0230 wt %; about 0.0240 wt %; about 0.0250 wt %; about 0.0260 wt %; about 0.0270 wt %; about 0.0280 wt %; 0.0290 wt %; about 0.0300 wt %; about 0.0310 wt %; about 0.0320 wt %; about 0.0330 wt %; about 0.0340 wt %; about 0.0350 wt %; about 0.0360 wt %; about 0.0370 wt %; about 0.0380 wt %; 0.0390 wt %; about 0.0400 wt %; about 0.0410 wt %; about 0.0420 wt %; about 0.0430 wt %; about 0.0440 wt %; about 0.0450 wt %; about 0.0460 wt %; about 0.0470 wt %; about 0.0480 wt %; 0.0490 wt %; about 0.0500 wt %; about 0.0510 wt %; about 0.0520 wt %; about 0.0530 wt %; about 0.0540 wt %; about 0.0550 wt %; about 0.0560 wt %; about 0.0570 wt %; about 0.0580 wt %; 0.0590 wt %; about 0.0600 wt %; about 0.0610 wt %; about 0.0620 wt %; about 0.0630 wt %; about 0.0640 wt %; about 0.06570 wt %; a range utilizing any of the foregoing values; a sub-range with a range utilizing any of the foregoing values; or any set of values utilizing the foregoing values.

In a further aspect, the first cooling compound can be present in the first cooling composition in an amount of about 1.0 wt % to about 10.0 wt %; about 1.5 wt % to about 7.0 wt %; about 1.5 wt % to about 6.0 wt %; about 2.0 wt % to about 5.0 wt %; about 2.0 wt % to about 4.0 wt %; and wherein the wt % is based on the total weight of the composite yarn.

In a further aspect, the first cooling compound can be present in the first cooling composition, based on the total weight of the composite yarn, in an amount of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the composite yarn, in an amount of about 0.0005 wt %; about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.02 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the composite yarn, in an amount of about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; about 0.0051 wt %; about 0.0052 wt %; about 0.0053 wt %; about 0.0054 wt %; about 0.0055 wt %; about 0.0056 wt %; about 0.0057 wt %; about 0.0058 wt %; about 0.0059 wt %; about 0.0060 wt %; about 0.0061 wt %; about 0.0062 wt %; about 0.0063 wt %; about 0.0064 wt %; about 0.0065 wt %; about 0.0066 wt %; about 0.0067 wt %; about 0.0068 wt %; about 0.0069 wt %; about 0.0070 wt %; about 0.0071 wt %; about 0.0072 wt %; about 0.0073 wt %; about 0.0074 wt %; about 0.0075 wt %; about 0.0076 wt %; about 0.0077 wt %; about 0.0078 wt %; about 0.0079 wt %; about 0.0080 wt %; about 0.0081 wt %; about 0.0082 wt %; about 0.0083 wt %; about 0.0084 wt %; about 0.0085 wt %; about 0.0086 wt %; about 0.0087 wt %; about 0.0088 wt %; about 0.0089 wt %; about 0.0090 wt %; about 0.0091 wt %; about 0.0092 wt %; about 0.0093 wt %; about 0.0094 wt %; about 0.0095 wt %; about 0.0096 wt %; about 0.0097 wt %; about 0.0098 wt %; about 0.0099 wt %; about 0.0100 wt %; about 0.0101 wt %; about 0.0102 wt %; about 0.0103 wt %; about 0.0104 wt %; about 0.0105 wt %; about 0.0106 wt %; about 0.0107 wt %; about 0.0108 wt %; about 0.0109 wt %; about 0.0110 wt %; about 0.0111 wt %; about 0.0112 wt %; about 0.0113 wt %; about 0.0114 wt %; about 0.0115 wt %; about 0.0116 wt %; about 0.0117 wt %; about 0.0118 wt %; about 0.0119 wt %; about 0.0120 wt %; about 0.0121 wt %; about 0.0122 wt %; about 0.0123 wt %; about 0.0124 wt %; about 0.0125 wt %; about 0.0126 wt %; about 0.0127 wt %; about 0.0128 wt %; about 0.0129 wt %; about 0.0130 wt %; about 0.0131 wt %; about 0.0132 wt %; about 0.0133 wt %; about 0.0134 wt %; about 0.0135 wt %; about 0.0136 wt %; about 0.0137 wt %; about 0.0138 wt %; about 0.0139 wt %; about 0.0140 wt %; about 0.0141 wt %; about 0.0142 wt %; about 0.0143 wt %; about 0.0144 wt %; about 0.0145 wt %; about 0.0146 wt %; about 0.0147 wt %; about 0.0148 wt %; about 0.0149 wt %; about 0.0150 wt %; about 0.0151 wt %; about 0.0152 wt %; about 0.0153 wt %; about 0.0154 wt %; about 0.0155 wt %; about 0.0156 wt %; about 0.0157 wt %; about 0.0158 wt %; about 0.0159 wt %; about 0.0160 wt %; about 0.0161 wt %; about 0.0162 wt %; about 0.0163 wt %; about 0.0164 wt %; about 0.0165 wt %; about 0.0166 wt %; about 0.0167 wt %; about 0.0168 wt %; about 0.0169 wt %; about 0.0170 wt %; about 0.0171 wt %; about 0.0172 wt %; about 0.0173 wt %; about 0.0174 wt %; about 0.0175 wt %; about 0.0176 wt %; about 0.0177 wt %; about 0.0178 wt %; about 0.0179 wt %; about 0.0180 wt %; about 0.0181 wt %; about 0.0182 wt %; about 0.0183 wt %; about 0.0184 wt %; about 0.0185 wt %; about 0.0186 wt %; about 0.0187 wt %; about 0.0188 wt %; about 0.0189 wt %; about 0.0190 wt %; about 0.0191 wt %; about 0.0192 wt %; about 0.0193 wt %; about 0.0194 wt %; about 0.0195 wt %; about 0.0196 wt %; about 0.0197 wt %; about 0.0198 wt %; about 0.0199 wt %; about 0.0200 wt %; a range utilizing any of the foregoing values; a sub-range with a range utilizing any of the foregoing values; or any set of values utilizing the foregoing values.

In various aspects, the first cooling salt can be present in the first cooling composition, based on the total weight of the composite yarn, in an amount of about 0.05 wt % to about 3.0 wt %; about 0.1 wt % to about 2.0 wt %; about 0.1 wt % to about 1.5 wt %; about 0.1 wt % to about 1.0 wt %; about 0.15 wt % to about 1.0 wt %; or a sub-range within any of the foregoing ranges.

In a further aspect, the first cooling salt can be present in the first cooling composition, based on the total weight of the composite yarn, in an amount of about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.00 wt %; about 1.01 wt %; about 1.02 wt %, about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %; about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

In an aspect, the second cooling composition can be present in an amount of about 0.1 wt % to about 2 wt % based on the total weight of the composite yarn. In a further aspect, the second cooling composition can be present in an amount, based on the total weight of the composite yarn of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In an aspect, the second cooling composition can be present in an amount of about 2.0 wt % to about 10 wt % based on the total weight of the composite yarn. In a further aspect, the second cooling composition can be present in an amount, based on the total weight of the composite yarn of about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.1 wt % to about 1 wt % of the second cooling material; about 0.005 wt % to about 0.07 wt % of the second cooling compound; about 0.0005 wt % to about 0.02 wt % of the second cooling salt; or combinations thereof; and wherein the wt % is based on the total weight of the composite yarn. In a still further aspect, the second cooling material can be present in the second cooling composition, based on the total weight of the composite yarn, in an amount of about 0.2 wt % to about 0.9 wt % of the second cooling material; about 0.01 wt % to about 0.06 wt % of the second cooling compound; about 0.0005 wt % to about 0.01 wt % of the second cooling salt; or combinations thereof; and wherein the wt % is based on the total weight of the composite yarn. In a yet further aspect, the second cooling material can be present in the second cooling composition in an amount of about 0.2 wt % to about 0.8 wt % of the second cooling material; about 0.01 wt % to about 0.05 wt % of the second cooling compound; and about 0.0005 wt % to about 0.015 wt % of the second cooling salt; and wherein the wt % is based on the total weight of the composite yarn. In an even further aspect, the second cooling material can be present in the second cooling composition in an amount of about 0.25 wt % to about 0.65 wt % of the second cooling material; about 0.015 wt % to about 0.40 wt % of the second cooling compound; and about 0.0005 wt % to about 0.01 wt % of the second cooling salt; and wherein the wt % is based on the total weight of the composite yarn.

In a further aspect, the second cooling material can be present in the second cooling composition in an amount of about 0.5 wt % to about 7.0 wt % of the second cooling material; about 1.0 wt % to about 10.0 wt % of the second cooling compound; about 0.05 wt % to about 3.0 wt % of the second cooling salt; or combinations thereof; and wherein the wt % is based on the total weight of the composite yarn. In a still further aspect, the second cooling material can be present in the second cooling composition, based on the total weight of the composite yarn, in an amount of about 1.0 wt % to about 6.0 wt % of the second cooling material; about 1.5 wt % to about 7.0 wt % of the second cooling compound; about 0.1 wt % to about 2.0 wt % of the second cooling salt; or combinations thereof; and wherein the wt % is based on the total weight of the composite yarn. In a yet further aspect, the second cooling material can be present in the second cooling composition in an amount of about 1.0 wt % to about 5.0 wt % of the second cooling material; about 1.5 wt % to about 6.0 wt % of the second cooling compound; and about 0.1 wt % to about 1.5 wt % of the second cooling salt; and wherein the wt % is based on the total weight of the composite yarn. In an even further aspect, the second cooling material can be present in the second cooling composition in an amount of about 1.0 wt % to about 4.0 wt % of the second cooling material; about 2.0 wt % to about 5.0 wt % of the second cooling compound; and about 0.1 wt % to about 1.0 wt % of the second cooling salt; and wherein the wt % is based on the total weight of the composite yarn. In a still further aspect, the second cooling material can be present in the second cooling composition in an amount of about 1.5 wt % to about 3.0 wt % of the second cooling material; about 2.0 wt % to about 4.0 wt % of the second cooling compound; and about 0.15 wt % to about 1.0 wt % of the second cooling salt; and wherein the wt % is based on the total weight of the composite yarn.

In a further aspect, the second cooling material can be present in the second cooling composition in an amount of about 0.1 wt % to about 1 wt %; and wherein the wt % is based on the total weight of the composite yarn. In a still further aspect, the second cooling material can be present in an amount of about 0.2 wt % to about 0.9 wt %; and wherein the wt % is based on the total weight of the composite yarn. In a yet further aspect, the second cooling material can be present in an amount of about 0.2 wt % to about 0.8 wt %; and wherein the wt % is based on the total weight of the composite yarn. In an even further aspect, the second cooling material can be present in an amount of about 0.25 wt % to about 0.65 wt %; and wherein the wt % is based on the total weight of the composite yarn.

In a further aspect, the second cooling material can be present in the second cooling composition, based on the total weight of the composite yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.5 wt % to about 7.0 wt %; and wherein the wt % is based on the total weight of the composite yarn. In a still further aspect, the second cooling material can be present in an amount of about 1.0 wt % to about 6.0 wt %; and wherein the wt % is based on the total weight of the composite yarn. In a yet further aspect, the second cooling material can be present in an amount of about 1.0 wt % to about 5.0 wt %; and wherein the wt % is based on the total weight of the composite yarn. In a still further aspect, the second cooling material can be present in an amount of about 1.0 wt % to about 4.0 wt %; and wherein the wt % is based on the total weight of the composite yarn. In an even further aspect, the second cooling material can be present in an amount of about 1.5 wt % to about 3.0 wt %; and wherein the wt % is based on the total weight of the composite yarn.

In a further aspect, the second cooling material can be present in the second cooling composition, based on the total weight of the composite yarn, in an amount of about 1.0 wt %, about 1.1 wt %; about 1.2 wt %; about 1.3 wt %; about 1.4 wt %; about 1.5 wt %; about 1.6 wt %; about 4.7 wt %; about 4.8 wt %; about 4.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In a further aspect, the second cooling compound can be present in the second cooling composition in an amount of about 0.005 wt % to about 0.07 wt %; about 0.01 wt % to about 0.06 wt %; about 0.01 wt % to about 0.05 wt %; about 0.015 wt % to about 0.40 wt %; and wherein the wt % is based on the total weight of the composite yarn; and wherein the wt % is based on the total weight of the composite yarn.

In a further aspect, the second cooling compound can be present in the second cooling composition, based on the total weight of the composite yarn, in an amount of about 0.0050 wt %; about 0.0051 wt %; about 0.0052 wt %; about 0.0053 wt %; about 0.0054 wt %; about 0.0055 wt %; about 0.0056 wt %; about 0.0057 wt %; about 0.0058 wt %; about 0.0059 wt %; about 0.0060 wt %; about 0.0061 wt %; about 0.0062 wt %; about 0.0063 wt %; about 0.0064 wt %; about 0.0065 wt %; about 0.0066 wt %; about 0.0067 wt %; about 0.0068 wt %; about 0.0069 wt %; about 0.0070 wt %; about 0.0071 wt %; about 0.0072 wt %; about 0.0073 wt %; about 0.0074 wt %; about 0.0075 wt %; about 0.0076 wt %; about 0.0077 wt %; about 0.0078 wt %; about 0.0079 wt %; about 0.0080 wt %; about 0.0081 wt %; about 0.0082 wt %; about 0.0083 wt %; about 0.0084 wt %; about 0.0085 wt %; about 0.0086 wt %; about 0.0087 wt %; about 0.0088 wt %; about 0.0089 wt %; about 0.0090 wt %; about 0.0091 wt %; about 0.0092 wt %; about 0.0093 wt %; about 0.0094 wt %; about 0.0095 wt %; about 0.0096 wt %; about 0.0097 wt %; about 0.0098 wt %; about 0.0099 wt %; about 0.0100 wt %; about 0.0110 wt %; about 0.0120 wt %; about 0.0130 wt %; about 0.0140 wt %; about 0.0150 wt %; about 0.0160 wt %; about 0.0170 wt %; about 0.0180 wt %; 0.0190 wt %; about 0.0200 wt %; about 0.0210 wt %; about 0.0220 wt %; about 0.0230 wt %; about 0.0240 wt %; about 0.0250 wt %; about 0.0260 wt %; about 0.0270 wt %; about 0.0280 wt %; 0.0290 wt %; about 0.0300 wt %; about 0.0310 wt %; about 0.0320 wt %; about 0.0330 wt %; about 0.0340 wt %; about 0.0350 wt %; about 0.0360 wt %; about 0.0370 wt %; about 0.0380 wt %; 0.0390 wt %; about 0.0400 wt %; about 0.0410 wt %; about 0.0420 wt %; about 0.0430 wt %; about 0.0440 wt %; about 0.0450 wt %; about 0.0460 wt %; about 0.0470 wt %; about 0.0480 wt %; 0.0490 wt %; about 0.0500 wt %; about 0.0510 wt %; about 0.0520 wt %; about 0.0530 wt %; about 0.0540 wt %; about 0.0550 wt %; about 0.0560 wt %; about 0.0570 wt %; about 0.0580 wt %; 0.0590 wt %; about 0.0600 wt %; about 0.0610 wt %; about 0.0620 wt %; about 0.0630 wt %; about 0.0640 wt %; about 0.06570 wt %; a range utilizing any of the foregoing values; a sub-range with a range utilizing any of the foregoing values; or any set of values utilizing the foregoing values.

In a further aspect, the second cooling compound can be present in the second cooling composition in an amount of about 1.0 wt % to about 10.0 wt %; about 1.5 wt % to about 7.0 wt %; about 1.5 wt % to about 6.0 wt %; about 2.0 wt % to about 5.0 wt %; about 2.0 wt % to about 4.0 wt %; and wherein the wt % is based on the total weight of the composite yarn.

In a further aspect, the second cooling compound can be present in the second cooling composition, based on the total weight of the composite yarn, in an amount of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the composite yarn, in an amount of about 0.0005 wt %; about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.02 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the composite yarn, in an amount of about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; about 0.0051 wt %; about 0.0052 wt %; about 0.0053 wt %; about 0.0054 wt %; about 0.0055 wt %; about 0.0056 wt %; about 0.0057 wt %; about 0.0058 wt %; about 0.0059 wt %; about 0.0060 wt %; about 0.0061 wt %; about 0.0062 wt %; about 0.0063 wt %; about 0.0064 wt %; about 0.0065 wt %; about 0.0066 wt %; about 0.0067 wt %; about 0.0068 wt %; about 0.0069 wt %; about 0.0070 wt %; about 0.0071 wt %; about 0.0072 wt %; about 0.0073 wt %; about 0.0074 wt %; about 0.0075 wt %; about 0.0076 wt %; about 0.0077 wt %; about 0.0078 wt %; about 0.0079 wt %; about 0.0080 wt %; about 0.0081 wt %; about 0.0082 wt %; about 0.0083 wt %; about 0.0084 wt %; about 0.0085 wt %; about 0.0086 wt %; about 0.0087 wt %; about 0.0088 wt %; about 0.0089 wt %; about 0.0090 wt %; about 0.0091 wt %; about 0.0092 wt %; about 0.0093 wt %; about 0.0094 wt %; about 0.0095 wt %; about 0.0096 wt %; about 0.0097 wt %; about 0.0098 wt %; about 0.0099 wt %; about 0.0100 wt %; about 0.0101 wt %; about 0.0102 wt %; about 0.0103 wt %; about 0.0104 wt %; about 0.0105 wt %; about 0.0106 wt %; about 0.0107 wt %; about 0.0108 wt %; about 0.0109 wt %; about 0.0110 wt %; about 0.0111 wt %; about 0.0112 wt %; about 0.0113 wt %; about 0.0114 wt %; about 0.0115 wt %; about 0.0116 wt %;

about 0.0117 wt %; about 0.0118 wt %; about 0.0119 wt %; about 0.0120 wt %; about 0.0121 wt %; about 0.0122 wt %; about 0.0123 wt %; about 0.0124 wt %; about 0.0125 wt %; about 0.0126 wt %; about 0.0127 wt %; about 0.0128 wt %; about 0.0129 wt %; about 0.0130 wt %; about 0.0131 wt %; about 0.0132 wt %; about 0.0133 wt %; about 0.0134 wt %; about 0.0135 wt %; about 0.0136 wt %; about 0.0137 wt %; about 0.0138 wt %; about 0.0139 wt %; about 0.0140 wt %; about 0.0141 wt %; about 0.0142 wt %; about 0.0143 wt %; about 0.0144 wt %; about 0.0145 wt %; about 0.0146 wt %; about 0.0147 wt %; about 0.0148 wt %; about 0.0149 wt %; about 0.0150 wt %; about 0.0151 wt %; about 0.0152 wt %; about 0.0153 wt %; about 0.0154 wt %; about 0.0155 wt %; about 0.0156 wt %; about 0.0157 wt %; about 0.0158 wt %; about 0.0159 wt %; about 0.0160 wt %; about 0.0161 wt %; about 0.0162 wt %; about 0.0163 wt %; about 0.0164 wt %; about 0.0165 wt %; about 0.0166 wt %; about 0.0167 wt %; about 0.0168 wt %; about 0.0169 wt %; about 0.0170 wt %; about 0.0171 wt %; about 0.0172 wt %; about 0.0173 wt %; about 0.0174 wt %; about 0.0175 wt %; about 0.0176 wt %; about 0.0177 wt %; about 0.0178 wt %; about 0.0179 wt %; about 0.0180 wt %; about 0.0181 wt %; about 0.0182 wt %; about 0.0183 wt %; about 0.0184 wt %; about 0.0185 wt %; about 0.0186 wt %; about 0.0187 wt %; about 0.0188 wt %; about 0.0189 wt %; about 0.0190 wt %; about 0.0191 wt %; about 0.0192 wt %; about 0.0193 wt %; about 0.0194 wt %; about 0.0195 wt %; about 0.0196 wt %; about 0.0197 wt %; about 0.0198 wt %; about 0.0199 wt %; about 0.0200 wt %; a range utilizing any of the foregoing values; a sub-range with a range utilizing any of the foregoing values; or any set of values utilizing the foregoing values.

In various aspects, the second cooling salt can be present in the second cooling composition, based on the total weight of the composite yarn, in an amount of about 0.05 wt % to about 3.0 wt %; about 0.1 wt % to about 2.0 wt %; about 0.1 wt % to about 1.5 wt %; about 0.1 wt % to about 1.0 wt %; about 0.15 wt % to about 1.0 wt %; or a sub-range within any of the foregoing ranges.

In a further aspect, the second cooling salt can be present in the second cooling composition, based on the total weight of the composite yarn, in an amount of about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.00 wt %; about 1.01 wt %; about 1.02 wt %, about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %; about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

D. Double-Covered Yarns

In one aspect, the disclosure relates to double covered yarns that can be utilized in a woven or knit fabric. More specifically, in one aspect, the present disclosure relates to double covered yarn comprising: (a) an elastic core comprising an elastic yarn; (b) a first yarn comprising a disclosed composite yarn; and (c) a second yarn comprising a cellulosic fiber; wherein the first yarn is wound around the elastic core to form a single covered yarn; and wherein the second yarn is wound around the single covered yarn to form a double covered yarn.

In various aspects, a disclosed double-covered yarn comprises about 1 wt % to about 15 wt % of an elastic yarn; about 35 wt % to about 55 wt % of first yarn comprising a disclosed composite yarn; and about 35 wt % to about 60 wt % of a second yarn comprising a cellulosic fiber; and wherein the weight percent is based upon the total weight of the double-covered yarn, and provided that the total weight percent of the elastic yarn, the first yarn, and the second yarn is from about 90 wt % to about 100 wt %. In a further aspect, a disclosed double-covered yarn comprises about 3 wt % to about 12 wt % of an elastic yarn; about 38 wt % to about 52 wt % of first yarn comprising a disclosed composite yarn; and about 40 wt % to about 50 wt % of a second yarn comprising a cellulosic fiber; and wherein the weight percent is based upon the total weight of the double-covered yarn, and provided that the total weight percent of the elastic yarn, the first yarn, and the second yarn is from about 90 wt % to about 100 wt %. In a still further aspect, a disclosed double-covered yarn comprises about 5 wt % to about 10 wt % of an elastic yarn; about 40 wt % to about 50 wt % of first yarn comprising a disclosed composite yarn; and about 42 wt % to about 48 wt % of a second yarn comprising a cellulosic fiber; and wherein the weight percent is based upon the total weight of the double-covered yarn, and provided that the total weight percent of the elastic yarn, the first yarn, and the second yarn is from about 90 wt % to about 100 wt %.

In a further aspect, a double-covered yarn comprises an elastic yarn in a weight percent amount based on the total weight of the double-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; a range utilizing any of the foregoing values; a sub-range with a range utilizing any of the foregoing values; or any set of values utilizing the foregoing values, and provided that the total weight percent of the elastic yarn, the first yarn, and the second yarn is from about 90 wt % to about 100 wt %.

In a further aspect, a double-covered yarn comprises a first yarn in a weight percent amount based on the total weight of the double-covered yarn of about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; a range utilizing any of the foregoing values; a sub-range with a range utilizing any of the foregoing values; or any set of values utilizing the foregoing values, and provided that the total weight percent of the elastic yarn, the first yarn, and the second yarn is from about 90 wt % to about 100 wt %.

In a further aspect, a double-covered yarn comprises a second yarn in a weight percent amount based on the total weight of the double-covered yarn of about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; a range utilizing any of the foregoing values; a sub-range with a range utilizing any of the foregoing values; or any set of values utilizing the foregoing values, and provided that the total weight percent of the elastic yarn, the first yarn, and the second yarn is from about 90 wt % to about 100 wt %.

In a further aspect, the elastic core of the double covered yarn comprises an elastic yarn such as a spandex yarn, a polyester yarn, or combinations thereof. The polyester yarn in the elastic core of the double covered yarn can comprise polyethylene terephthalate, a polytrimethylene terephthalate, or combinations thereof. In some aspects, the elastic core of the double covered yarn can comprise a composite filament of polyethylene terephthalate and polytrimethylene terephthalate; and wherein the filament has the polyethylene terephthalate and polytrimethylene terephthalate arranged side-by-side.

In a further aspect, the elastic core of the double covered yarn can comprise a spandex yarn and a polyester yarn comprising polyethylene terephthalate, a polytrimethylene terephthalate, or combinations thereof.

Figure 6A:
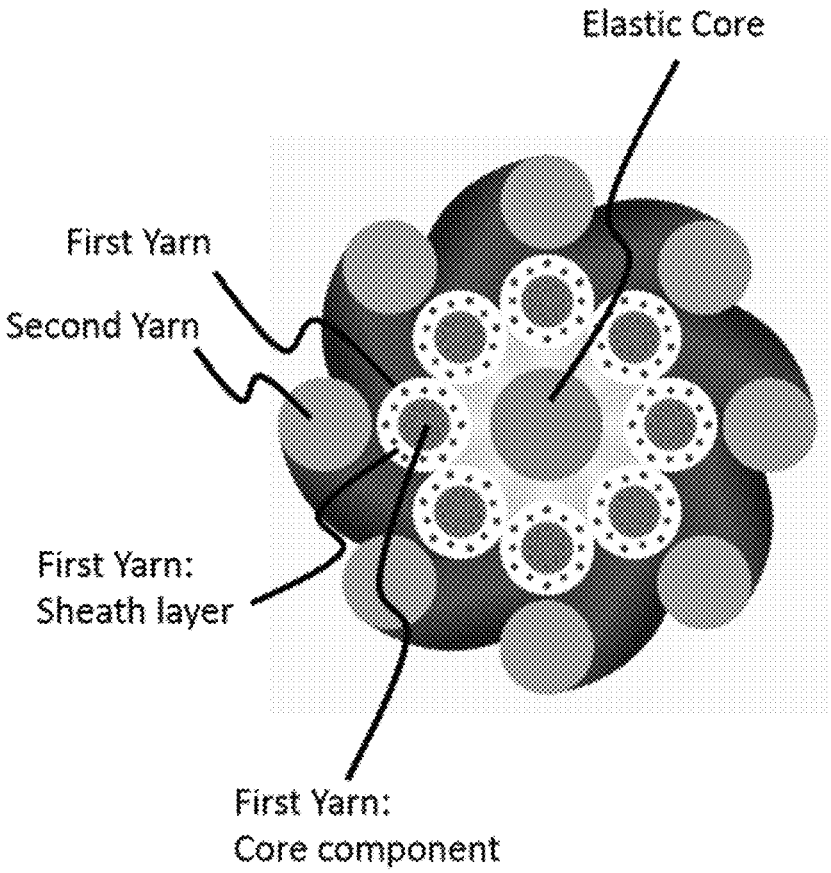
FIGS. 6A-6B show a representative cross-sectional views of disclosed double-covered yarns.
Figure 6B:
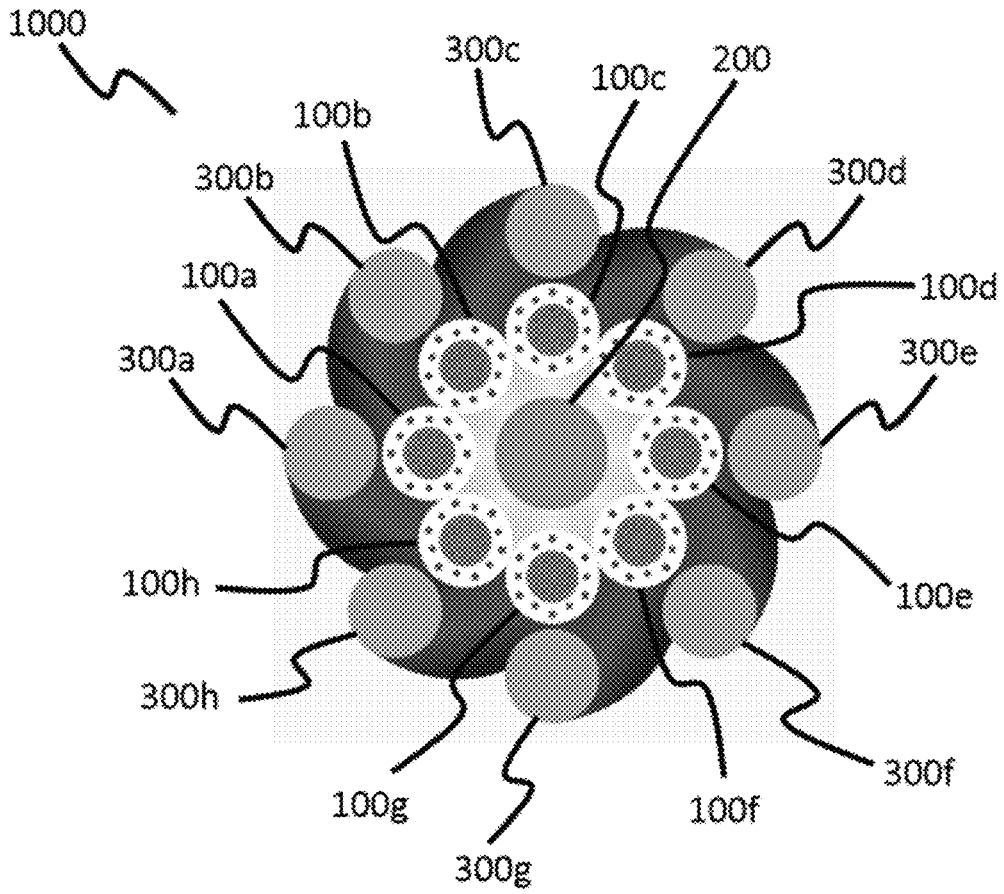

Referring now to FIGS. 6A-6B, which show representative cross-sectional views of disclosed double-covered yarns. FIG. 6A shows a schematic cross-sectional view of a disclosed double-covered yarn comprising a viscose rayon, a composite yarn, and a spandex yarn. FIG. 6B shows a cross-sectional view of a disclosed double-covered yarn, 1000, with aspects specified as follows: (a) an elastic core, 200, comprising an elastic yarn; (b) a plurality of first yarns, 100*a*-100*h*, each comprising a disclosed composite yarn, such as that shown in FIG. 1B, comprising a core component comprising a polyester polymer and a first cooling composition, and a sheath layer comprising a polyamide polymer and a second cooling composition; and (c) a plurality of second yarns, 300*a*-300*h*, comprising a cellulosic fiber; such, as shown in FIG. 6B, the first yarn is wound around the elastic core to form a single covered yarn; and wherein the second yarn is wound around the single covered yarn to form a double covered yarn.

In various aspects, the elastic yarn in the elastic corn of the double covered yarn has a weight of about 30 denier to about 50 denier; about 35 denier to about 45 denier; about 36 denier to about 44 denier; about 37 denier to about 43 denier; about 38 denier to about 42 denier; about 39 denier to about 41 denier; or a sub-range within any of the foregoing ranges.

In a further aspect, the elastic yarn in the elastic corn of the double covered yarn has a stretch rate is about 2.5 to about 5; about 3 to about 4; about 3.2 to about 3.8; or a sub-range within any of the foregoing ranges.

The cellulosic fiber of the double covered yarn can comprise a viscose fiber, including, but not limited to, a viscose rayon, a viscose silk, or combinations thereof. In some instances, cellulosic fiber of the double covered yarn is a viscose rayon.

In various aspects, the second yarn of the double covered yarn has a weight of about 105 d/20 f to about 130 d/40 f; about 110 d/20 f to about 130 d/40 f; about 115 d/20 f to about 130 d/40 f; about 105 d/20 f to about 130 d/35 f; about 110 d/35 f to about 130 d/35 f; about 115 d/20 f to about 130 d/35 f; about 105 d/20 f to about 130 d/30 f; about 110 d/20 f to about 130 d/30 f; about 115 d/20 f to about 130 d/30 f; or a sub-range within the foregoing ranges.

In a further aspect, the second yarn of the double covered yarn has a weight of about 120 d/20 f±10%; about 120 d/20 f±5%; about 120 d/20 f±3%; 121 d/20 f±10%; about 121 d/20 f±5%; about 121 d/20 f±3%; 122 d/20 f±10%; about 122 d/20 f±5%; about 122 d/20 f±3%; 123 d/20 f±10%; about 123 d/20 f±5%; about 123 d/20 f±3%; 124 d/20 f±10%; about 124 d/20 f±5%; about 124 d/20 f±3%; 125 d/20 f±10%; about 125 d/20 f±5%; about 125 d/20 f±3%; 126 d/20 f±10%; about 126 d/20 f±5%; about 126 d/20 f±3%; 127 d/20 f±10%; about 127 d/20 f±5%; about 127 d/20 f±3%; 128 d/20 f±10%; about 128 d/20 f±5%; about 128 d/20 f±3%; 129 d/20 f±10%; about 129 d/20 f±5%; about 129 d/20 f±3%; 130 d/20 f±10%; about 130 d/20 f±5%; about 130 d/20 f±3%; about 120 d/25 f±10%; about 120 d/25 f±5%; about 120 d/25 f±3%; 121 d/25 f±10%; about 121 d/25 f±5%; about 121 d/25 f±3%; 122 d/25 f±10%; about 122 d/25 f±5%; about 122 d/25 f±3%; 123 d/25 f±10%; about 123 d/25 f±5%; about 123 d/25 f±3%; 124 d/25 f±10%; about 124 d/25 f±5%; about 124 d/25 f±3%; 125 d/25 f±10%; about 125 d/25 f±5%; about 125 d/25 f±3%; 126 d/25 f±10%; about 126 d/25 f±5%; about 126 d/25 f±3%; 127 d/25 f±10%; about 127 d/25 f±5%; about 127 d/25 f±3%; 128 d/25 f±10%; about 128 d/25 f±5%; about 128 d/25 f±3%; 129 d/25 f±10%; about 129 d/25 f±5%; about 129 d/25 f±3%; 130 d/25 f±10%; about 130 d/25 f±5%; about 130 d/25 f±3%; about 120 d/30 f±10%; about 120 d/30 f±5%; about 120 d/30 f±3%; 121 d/30 f±10%; about 121 d/30 f±5%; about 121 d/30 f±3%; 122 d/30 f±10%; about 122 d/30 f±5%; about 122 d/30 f±3%; 123 d/30 f±10%; about 123 d/30 f±5%; about 123 d/30 f±3%; 124 d/30 f±10%; about 124 d/30 f±5%; about 124 d/30 f±3%; 125 d/30 f±10%; about 125 d/30 f±5%; about 125 d/30 f±3%; 126 d/30 f±10%; about 126 d/30 f±5%; about 126 d/30 f±3%; 127 d/30 f±10%; about 127 d/30 f±5%; about 127 d/30 f±3%; 128 d/30 f±10%; about 128 d/30 f±5%; about 128 d/30 f±3%; 129 d/30 f±10%; about 129 d/30 f±5%; about 129 d/30 f±3%; 130 d/30 f±10%; about 130 d/30 f±5%; about 130 d/30 f±3%; about 120 d/35 f±10%; about 120 d/35 f±5%; about 120 d/35 f±3%; 121 d/35 f±10%; about 121 d/35 f±5%; about 121 d/35 f±3%; 122 d/35 f±10%; about 122 d/35 f±5%; about 122 d/35 f±3%; 123 d/35 f±10%; about 123 d/35 f±5%; about 123 d/35 f±3%; 124 d/35 f±10%; about 124 d/35 f±5%; about 124 d/35 f±3%; 125 d/35 f±10%; about 125 d/35 f±5%; about 125 d/35 f±3%; 126 d/35 f±10%; about 126 d/35 f±5%; about 126 d/35 f±3%; 127 d/35 f±10%; about 127 d/35 f±5%; about 127 d/35 f±3%; 128 d/35 f±10%; about 128 d/35 f±5%; about 128 d/35 f±3%; 129 d/35 f±10%; about 129 d/35 f±5%; about 129 d/35 f±3%; 130 d/35 f±10%; about 130 d/35 f±5%; about 130 d/35 f±3%; about 120 d/40 f±10%; about 120 d/40 f±5%; about 120 d/40 f±3%; 121 d/40 f±10%; about 121 d/40 f±5%; about 121 d/40 f±3%; 122 d/40 f±10%; about 122 d/40 f±5%; about 122 d/40 f±3%; 123 d/40 f±10%; about 123 d/40 f±5%; about 123 d/40 f±3%; 124 d/40 f±10%; about 124 d/40 f±5%; about 124 d/40 f±3%; 125 d/40 f±10%; about 125 d/40 f±5%; about 125 d/40 f±3%; 126 d/40 f±10%; about 126 d/40 f±5%; about 126 d/40 f±3%; 127 d/40 f±10%; about 127 d/40 f±5%; about 127 d/40 f±3%; 128 d/40 f±10%; about 128 d/40 f±5%; about 128 d/40 f±3%; 129 d/40 f±10%; about 129 d/40 f±5%; about 129 d/40 f±3%; 130 d/40 f±10%; about 130 d/40 f±5%; about 130 d/40 f±3%; a range encompassing any of the foregoing value; or any combination of the foregoing values.

In various aspects, the double covered yarn has a weight of about 250 denier to about 370 denier; about 260 denier to about 370 denier; about 270 denier to about 370 denier; about 280 denier to about 370 denier; about 290 denier to about 370 denier; about 300 denier to about 370 denier; about 310 denier to about 370 denier; about 320 denier to about 370 denier; about 330 denier to about 370 denier; about 340 denier to about 370 denier; about 350 denier to about 370 denier; about 355 denier to about 370 denier; about 360 denier to about 370 denier; about 250 denier to about 360 denier; about 260 denier to about 360 denier; about 270 denier to about 360 denier; about 280 denier to about about 360 denier; about 290 denier to about 360 denier; about 300 denier to about 360 denier; about 310 denier to about 360 denier; about 320 denier to about 360 denier; about 330 denier to about 360 denier; about 340 denier to about 360 denier; about 350 denier to about 360 denier; about 250 denier to about 350 denier; about 260 denier to about 350 denier; about 270 denier to about 350 denier; about 280 denier to about 350 denier; about 290 denier to about 350 denier; about 300 denier to about 350 denier; about 310 denier to about 350 denier; about 320 denier to about 350 denier; about 330 denier to about 350 denier; about 340 denier to about 350 denier; about 250 denier to about 340 denier; about 260 denier to about 340 denier; about 270 denier to about 340 denier; about 280 denier to about 340 denier; about 290 denier to about 340 denier; about 300 denier to about 340 denier; about 310 denier to about 340 denier; about 320 denier to about 340 denier; about 330 denier to about 340 denier; about 250 denier to about 330 denier; about 260 denier to about 330 denier; about 270 denier to about 330 denier; about 280 denier to about 330 denier; about 285 denier to about 330 denier; about 290 denier to about 330 denier; about 300 denier to about 330 denier; about 310 denier to about 330 denier; about 320 denier to about 330 denier; about 250 denier to about 320 denier; about 260 denier to about 320 denier; about 270 denier to about 320 denier; about 280 denier to about 320 denier; about 290 denier to about 320 denier; about 300 denier to about 320 denier; about 310 denier to about 320 denier; about 250 denier to about 310 denier; about 260 denier to about 310 denier; about 270 denier to about 310 denier; about 280 denier to about 310 denier; about 290 denier to about 310 denier; about 300 denier to about 310 denier; about 250 denier to about 300 denier; about 260 denier to about 300 denier; about 270 denier to about 300 denier; about 280 denier to about 300 denier; about 290 denier to about 300 denier; or a value, set of values, or sub-range within any of the foregoing ranges.

In a further aspect, the double covered yarn has a weight of about 270 denier±10%; 270 denier±5%; about 270 denier±3%; about 271 denier±10%; 271 denier±5%; about 271 denier±3%; about 272 denier±10%; 272 denier±5%; about 272 denier±3%; about 273 denier±10%; 273 denier±5%; about 273 denier±3%; about 274 denier±10%; 274 denier±5%; about 274 denier±3%; about 275 denier±10%; 275 denier±5%; about 275 denier±3%; about 276 denier±10%; 276 denier±5%; about 276 denier±3%; about 277 denier±10%; 277 denier±5%; about 277 denier±3%; about 278 denier±10%; 278 denier±5%; about 278 denier±3%; about 279 denier±10%; 279 denier±5%; about 279 denier±3%; about 280 denier±10%; 280 denier±5%; about 280 denier±3%; about 281 denier±10%; 281 denier±5%; about 281 denier±3%; about 282 denier±10%; 282 denier±5%; about 282 denier±3%; about 283 denier±10%; 283 denier±5%; about 283 denier±3%; about 284 denier±10%; 284 denier±5%; about 284 denier±3%; about 285 denier±10%; 285 denier±5%; about 285 denier±3%; about 286 denier±10%; 286 denier±5%; about 286 denier±3%; about 287 denier±10%; 287 denier±5%; about 287 denier±3%; about 288 denier±10%; 288 denier±5%; about 288 denier±3%; about 289 denier±10%; 289 denier±5%; about 289 denier±3%; about 290 denier±10%; 290 denier±5%; about 290 denier±3%; about 291 denier±10%; 291 denier±5%; about 291 denier±3%; about 292 denier±10%; 292 denier±5%; about 292 denier±3%; about 293 denier±10%; 293 denier±5%; about 293 denier±3%; about 294 denier±10%; 294 denier±5%; about 294 denier±3%; about 295 denier±10%; 295 denier±5%; about 295 denier±3%; about 296 denier±10%; 296 denier±5%; about 296 denier±3%; about 297 denier±10%; 297 denier±5%; about 297 denier±3%; about 298 denier±10%; 298 denier±5%; about 298 denier±3%; about 299 denier±10%; 299 denier±5%; about 299 denier±3%; about 300 denier±10%; 300 denier±5%; about 300 denier±3%; about 301 denier±10%; 301 denier±5%; about 301 denier±3%; about 302 denier±10%; 302 denier±5%; about 302 denier±3%; about 303 denier±10%; 303 denier±5%; about 303 denier±3%; about 304 denier±10%; 304 denier±5%; about 304 denier±3%; about 305 denier±10%; 305 denier±5%; about 305 denier±3%; about 306 denier±10%; 306 denier±5%; about 306 denier±3%; about 307 denier±10%; 307 denier±5%; about 307 denier±3%; about 308 denier±10%; 308 denier±5%; about 308 denier±3%; about 309 denier±10%; 309 denier±5%; about 309 denier±3%; about 310 denier±10%; 310 denier±5%; about 310 denier±3%; about 311 denier±10%; 311 denier±5%; about 311 denier±3%; about 312 denier±10%; 312 denier±5%; about 312 denier±3%; about 313 denier±10%; 313 denier±5%; about 313 denier±3%; about 314 denier±10%; 314 denier±5%; about 314 denier±3%; about 315 denier±10%; 315 denier±5%; about 315 denier±3%; about 316 denier±10%; 316 denier±5%; about 316 denier±3%; about 317 denier±10%; 317 denier±5%; about 317 denier±3%; about 318 denier±10%; 318 denier±5%; about 318 denier±3%; about 319 denier±10%; 319 denier±5%; about 319 denier±3%; about 320 denier±10%; 320 denier±5%; about 320 denier±3%; about 321 denier±10%; 321 denier±5%; about 321 denier±3%; about 322 denier±10%; 322 denier±5%; about 322 denier±3%; about 323 denier±10%; 323 denier±5%; about 323 denier±3%; about 324 denier±10%; 324 denier±5%; about 324 denier±3%; about 325 denier±10%; 325 denier±5%; about 325 denier±3%; about 326 denier±10%; 326 denier±5%; about 326 denier±3%; about 327 denier±10%; 327 denier±5%; about 327 denier±3%; about 328 denier±10%; 328 denier±5%; about 328 denier±3%; about 329 denier±10%; 329 denier±5%; about 329 denier±3%; about 330 denier±10%; 330 denier±5%; about 330 denier±3%; about 331 denier±10%; 331 denier±5%; about 331 denier±3%; about 332 denier±10%; 332 denier±5%; about 332 denier±3%; about 333 denier±10%; 333 denier±5%; about 333 denier±3%; about 334 denier±10%; 334 denier±5%; about 334 denier±3%; about 335 denier±10%; 335 denier±5%; about 335 denier±3%; about 336 denier±10%; 336 denier±5%; about 336 denier±3%; about 337 denier±10%; 337 denier±5%; about 337 denier±3%; about 338 denier±10%; 338 denier±5%; about 338 denier±3%; about 339 denier±10%; 339 denier±5%; about 339 denier±3%; about 340 denier±10%; 340 denier±5%; about 340 denier±3%; about 341 denier±10%; 341 denier±5%; about 341 denier±3%; about 342 denier±10%; 342 denier±5%; about 342 denier±3%; about 343 denier±10%; 343 denier±5%; about 343 denier±3%; about 344 denier±10%; 344 denier±5%; about 344 denier±3%; about 345 denier±10%; 345 denier±5%; about 345 denier±3%; about 346 denier±10%; 346 denier±5%; about 346 denier±3%; about 347 denier±10%; 347 denier±5%; about 347 denier±3%; about 348 denier±10%; 348 denier±5%; about 348 denier±3%; about 349 denier±10%; 349 denier±5%; about 349 denier±3%; about 350 denier±10%; 350 denier±5%; about 350 denier±3%; about 351 denier±10%; 351 denier±5%; about 351 denier±3%; about 352 denier±10%; 352 denier±5%; about 352 denier±3%; about 353 denier±10%; 353 denier±5%; about 353 denier±3%; about 354 denier±10%; 354 denier±5%; about 354 denier±3%; about 355 denier±10%; 355 denier±5%; about 355 denier±3%; about 356 denier±10%; 356 denier±5%; about 356 denier±3%; about 357 denier±10%; 357 denier±5%; about 357 denier±3%; about 358 denier±10%; 358 denier±5%; about 358 denier±3%; about 359 denier±10%; 359 denier±5%; about 359 denier±3%; about 360 denier±10%; 360 denier±5%; about 360 denier±3%; about 361 denier±10%; 361 denier±5%; about 361 denier±3%; about 362 denier±10%; 362 denier±5%; about 362 denier±3%; about 363 denier±10%; 363 denier±5%; about 363 denier±3%; about 364 denier±10%; 364 denier±5%; about 364 denier±3%; about 365 denier±10%; 365 denier±5%; about 365 denier±3%; about 366 denier±10%; 366 denier±5%; about 366 denier±3%; about 367 denier±10%; 367 denier±5%; about 367 denier±3%; about 368 denier±10%; 368 denier±5%; about 368 denier±3%; about 369 denier±10%; about 369 denier±5%; about 369 denier±3%; about 370 denier±10%; 370 denier±5%; about 370 denier±3%; about 371 denier±10%; 371 denier±5%; about 371 denier±3%; about 372 denier±10%; 372 denier±5%; about 372 denier±3%; about 373 denier±10%; 373 denier±5%; about 373 denier±3%; about 374 denier±10%; 374 denier±5%; about 374 denier±3%; about 375 denier±10%; 375 denier±5%; about 375 denier±3%; about 376 denier±10%; 376 denier±5%; about 376 denier±3%; about 377 denier±10%; 377 denier±5%; about 377 denier±3%; about 378 denier±10%; 378 denier±5%; about 378 denier±3%; about 379 denier±10%; about 379 denier±5%; about 379 denier±3%; about 380 denier±10%; about 380 denier±5%; about 380 denier±3%; a range encompassing any of the foregoing values; or any combination of the foregoing values.

In an aspect, the first cooling composition can be present in an amount of about 0.01 wt % to about 1 wt % based on the total weight of the double-covered yarn. In a further aspect, the first cooling composition can be present in an amount, based on the total weight of the double-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %;

about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In an aspect, the first cooling composition can be present in an amount of about 1.0 wt % to about 5 wt % based on the total weight of the double-covered yarn. In a further aspect, the first cooling composition can be present in an amount, based on the total weight of the double-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.01 wt % to about 0.9 wt % of the first cooling material; about 0.001 wt % to about 0.05 wt % of the first cooling compound; about 0.0001 wt % to about 0.005 wt % of the first cooling salt; or combinations thereof; and wherein the wt % is based on the total weight of the double-covered yarn. In a still further aspect, the first cooling material can be present in the first cooling composition, based on the total weight of the double-covered yarn, in an amount of about 0.05 wt % to about 0.9 wt % of the first cooling material; about 0.005 wt % to about 0.03 wt % of the first cooling compound; about 0.0003 wt % to about 0.003 wt % of the first cooling salt; or combinations thereof; and wherein the wt % is based on the total weight of the double-covered yarn. In a yet further aspect, the first cooling material can be present in the first cooling composition in an amount of about 0.07 wt % to about 0.5 wt % of the first cooling material; about 0.007 wt % to about 0.03 wt % of the first cooling compound; and about 0.0001 wt % to about 0.004 wt % of the first cooling salt; and wherein the wt % is based on the total weight of the double-covered yarn. In an even further aspect, the first cooling material can be present in the first cooling composition in an amount of about 0.19 wt % to about 0.3 wt % of the first cooling material; about 0.007 wt % to about 0.20 wt % of the first cooling compound; and about 0.0001 wt % to about 0.003 wt % of the first cooling salt; and wherein the wt % is based on the total weight of the double-covered yarn.

In a further aspect, the first cooling material can be present in the first cooling composition in an amount of about 0.1 wt % to about 4.0 wt % of the first cooling material; about 0.1 wt % to about 5.0 wt % of the first cooling compound; about 0.01 wt % to about 2.0 wt % of the first cooling salt; or combinations thereof; and wherein the wt % is based on the total weight of the double-covered yarn. In a still further aspect, the first cooling material can be present in the first cooling composition, based on the total weight of the double-covered yarn, in an amount of about 0.1 wt % to about 3.0 wt % of the first cooling material; about 0.1 wt % to about 4.0 wt % of the first cooling compound; about 0.01 wt % to about 1.0 wt % of the first cooling salt; or combinations thereof; and wherein the wt % is based on the total weight of the double-covered yarn. In a yet further aspect, the first cooling material can be present in the first cooling composition in an amount of about 0.1 wt % to about 2.5 wt % of the first cooling material; about 0.1 wt % to about 3.0 wt % of the first cooling compound; and about 0.01 wt % to about 0.75 wt % of the first cooling salt; and wherein the wt % is based on the total weight of the double-covered yarn. In an even further aspect, the first cooling material can be present in the first cooling composition in an amount of about 0.3 wt % to about 2.0 wt % of the first cooling material; about 0.1 wt % to about 2.5 wt % of the first cooling compound; and about 0.05 wt % to about 0.5 wt % of the first cooling salt; and wherein the wt % is based on the total weight of the double-covered yarn. In a still further aspect, the first cooling material can be present in the first cooling composition in an amount of about 0.5 wt % to about 2.0 wt % of the first cooling material; about 0.5 wt % to about 2.2 wt % of the first cooling compound; and about 0.07 wt % to about 0.45 wt % of the first cooling salt; and wherein the wt % is based on the total weight of the double-covered yarn.

In a further aspect, the first cooling material can be present in the first cooling composition in an amount of about 0.01 wt % to about 0.9 wt %; and wherein the wt % is based on the total weight of the double-covered yarn. In a still further aspect, the first cooling material can be present in an amount of 0.05 wt % to about 0.9 wt %; and wherein the wt % is based on the total weight of the double-covered yarn. In a yet further aspect, the first cooling material can be present in an amount of about 0.07 wt % to about 0.5 wt %; and wherein the wt % is based on the total weight of the double-covered yarn. In an even further aspect, the first cooling material can be present in an amount of about 0.19 wt % to about 0.3 wt %; and wherein the wt % is based on the total weight of the double-covered yarn.

In a further aspect, the first cooling material can be present in the first cooling composition, based on the total weight of the double-covered yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.1 wt % to about 4.0 wt %; and wherein the wt % is based on the total weight of the double-covered yarn. In a still further aspect, the first cooling material can be present in an amount of about 0.1 wt % to about 4.0 wt %; and wherein the wt % is based on the total weight of the double-covered yarn. In a yet further aspect, the first cooling material can be present in an amount of about 0.1 wt % to about 2.5 wt %; and wherein the wt % is based on the total weight of the double-covered yarn. In a still further aspect, the first cooling material can be present in an amount of about 0.3 wt % to about 2.0 wt % of the first cooling material; and wherein the wt % is based on the total weight of the double-covered yarn. In an even further aspect, the first cooling material can be present in an amount of about 0.5 wt % to about 2.0 wt %; and wherein the wt % is based on the total weight of the double-covered yarn.

In a further aspect, the first cooling material can be present in the first cooling composition, based on the total weight of the double-covered yarn, in an amount of about 0.0 wt %, about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, a sub-range with a range utilizing any of the foregoing values; or any set of values utilizing the foregoing values.

In a further aspect, the first cooling compound can be present in the first cooling polymer composition in an amount of about 0.001 wt % to about 0.05 wt %; about 0.005 wt % to about 0.03 wt %; about 0.007 wt % to about 0.03 wt %; about 0.007 wt % to about 0.20 wt %; and wherein the wt % is based on the total weight of the double-covered yarn.

In a further aspect, the first cooling compound can be present in the first cooling polymer composition, based on the total weight of the double-covered yarn, in an amount of about 0.001 wt %; about 0.002 wt %; about 0.003 wt %; about 0.004 wt %; about 0.005 wt %; about 0.010 wt %; about 0.015 wt %; about 0.020 wt %; about 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; about 0.075 wt %; about 0.080 wt %; about 0.085 wt %; about 0.090 wt %; about 0.090 wt %; about 0.095 wt %; about 0.100 wt %; about 0.110 wt %; about 0.115 wt %; about 0.120 wt %; about 0.125 wt %; about 0.130 wt %; about 0.135 wt %; about 0.140 wt %; about 0.145 wt %; about 0.150 wt %; about 0.155 wt %; about 0.160 wt %; about 0.165 wt %; about 0.170 wt %; about 0.175 wt %; about 0.180 wt %; about 0.185 wt %; about 0.190 wt %; about 0.190 wt %; about 0.195 wt %; about 0.200 wt %; a range utilizing any of the foregoing values; a sub-range with a range utilizing any of the foregoing values; or any set of values utilizing the foregoing values.

In a further aspect, the first cooling compound can be present in the first cooling polymer composition in an amount of about 0.1 wt % to about 5.0 wt %; about 0.1 wt % to about 4.0 wt %; about 0.1 wt % to about 3.0 wt %; about 0.1 wt % to about 2.5 wt %; about 0.5 wt % to about 2.2 wt %; and wherein the wt % is based on the total weight of the double-covered yarn.

In a further aspect, the first cooling compound can be present in the first cooling polymer composition, based on the total weight of the double-covered yarn, in an amount of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the first cooling composition comprises a first cooling salt present in an amount, based on the total weight of the double-covered yarn, of about 0.0001 wt % to about 0.005 wt %; about 0.0003 wt % to about 0.003 wt %; about 0.007 wt % to about 0.03 wt %; about 0.0001 wt % to about 0.003 wt %; a range utilizing any of the foregoing values; a sub-range with a range utilizing any of the foregoing values; or any set of values utilizing the foregoing values.

In a further aspect, the first cooling composition comprises a first cooling salt present in an amount, based on the total weight of the double-covered yarn, of about 0.0001 wt %; about 0.0002 wt %; about 0.0003 wt %; about 0.0004 wt %; about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; a range utilizing any of the foregoing values; a sub-range with a range utilizing any of the foregoing values; or any set of values utilizing the foregoing values.

In various aspects, the first cooling composition comprises a first cooling salt present in an amount, based on the total weight of the double-covered yarn, of about 0.01 wt % to about 2.0 wt %; about 0.01 wt % to about 1.0 wt %; about 0.01 wt % to about 0.75 wt %; about 0.05 wt % to about 0.5 wt %; about 0.07 wt % to about 0.45 wt %; or a sub-range within any of the foregoing ranges.

In a further aspect, the first cooling composition comprises a first cooling salt present in an amount, based on the total weight of the double-covered yarn, of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.000 wt %; about 1.01 wt %; about 1.02 wt %; about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %; about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

In an aspect, the second cooling composition can be present in an amount of about 0.01 wt % to about 1 wt % based on the total weight of the double-covered yarn. In a further aspect, the second cooling composition can be present in an amount, based on the total weight of the double-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In an aspect, the second cooling composition can be present in an amount of about 1.0 wt % to about 5 wt % based on the total weight of the double-covered yarn. In a further aspect, the second cooling composition can be present in an amount, based on the total weight of the double-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.01 wt % to about 0.9 wt % of the second cooling material; about 0.001 wt % to about 0.05 wt % of the second cooling compound; about 0.0001 wt % to about 0.005 wt % of the second cooling salt; or combinations thereof; and wherein the wt % is based on the total weight of the double-covered yarn. In a still further aspect, the second cooling material can be present in the second cooling composition, based on the total weight of the double-covered yarn, in an amount of about 0.05 wt % to about 0.9 wt % of the second cooling material; about 0.005 wt % to about 0.03 wt % of the second cooling compound; about 0.0003 wt % to about 0.003 wt % of the second cooling salt; or combinations thereof; and wherein the wt % is based on the total weight of the double-covered yarn. In a yet further aspect, the second cooling material can be present in the second cooling composition in an amount of about 0.07 wt % to about 0.5 wt % of the second cooling material; about 0.007 wt % to about 0.03 wt % of the second cooling compound; and about 0.0001 wt % to about 0.004 wt % of the second cooling salt; and wherein the wt % is based on the total weight of the double-covered yarn. In an even further aspect, the second cooling material can be present in the second cooling composition in an amount of about 0.19 wt % to about 0.3 wt % of the second cooling material; about 0.007 wt % to about 0.20 wt % of the second cooling compound; and about 0.0001 wt % to about 0.003 wt % of the second cooling salt; and wherein the wt % is based on the total weight of the double-covered yarn.

In a further aspect, the second cooling material can be present in the second cooling composition in an amount of about 0.1 wt % to about 4.0 wt % of the second cooling material; about 0.1 wt % to about 5.0 wt % of the second cooling compound; about 0.01 wt % to about 2.0 wt % of the second cooling salt; or combinations thereof; and wherein the wt % is based on the total weight of the double-covered yarn. In a still further aspect, the second cooling material can be present in the second cooling composition, based on the total weight of the double-covered yarn, in an amount of about 0.1 wt % to about 3.0 wt % of the second cooling material; about 0.1 wt % to about 4.0 wt % of the second cooling compound; about 0.01 wt % to about 1.0 wt % of the second cooling salt; or combinations thereof; and wherein the wt % is based on the total weight of the double-covered yarn. In a yet further aspect, the second cooling material can be present in the second cooling composition in an amount of about 0.1 wt % to about 2.5 wt % of the second cooling material; about 0.1 wt % to about 3.0 wt % of the second cooling compound; and about 0.01 wt % to about 0.75 wt % of the second cooling salt; and wherein the wt % is based on the total weight of the double-covered yarn. In an even further aspect, the second cooling material can be present in the second cooling composition in an amount of about 0.3 wt % to about 2.0 wt % of the second cooling material; about 0.1 wt % to about 2.5 wt % of the second cooling compound; and about 0.05 wt % to about 0.5 wt % of the second cooling salt; and wherein the wt % is based on the total weight of the double-covered yarn. In a still further aspect, the second cooling material can be present in the second cooling composition in an amount of about 0.5 wt % to about 2.0 wt % of the second cooling material; about 0.5 wt % to about 2.2 wt % of the second cooling compound; and about 0.07 wt % to about 0.45 wt % of the second cooling salt; and wherein the wt % is based on the total weight of the double-covered yarn.

In a further aspect, the second cooling material can be present in the second cooling composition in an amount of about 0.01 wt % to about 0.9 wt %; and wherein the wt % is based on the total weight of the double-covered yarn. In a still further aspect, the second cooling material can be present in an amount of 0.05 wt % to about 0.9 wt %; and wherein the wt % is based on the total weight of the double-covered yarn. In a yet further aspect, the second cooling material can be present in an amount of about 0.07 wt % to about 0.5 wt %; and wherein the wt % is based on the total weight of the double-covered yarn. In an even further aspect, the second cooling material can be present in an amount of about 0.19 wt % to about 0.3 wt %; and wherein the wt % is based on the total weight of the double-covered yarn.

In a further aspect, the second cooling material can be present in the second cooling composition, based on the total weight of the double-covered yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.1 wt % to about 4.0 wt %; and wherein the wt % is based on the total weight of the double-covered yarn. In a still further aspect, the second cooling material can be present in an amount of about 0.1 wt % to about 4.0 wt %; and wherein the wt % is based on the total weight of the double-covered yarn. In a yet further aspect, the second cooling material can be present in an amount of about 0.1 wt % to about 2.5 wt %; and wherein the wt % is based on the total weight of the double-covered yarn. In a still further aspect, the second cooling material can be present in an amount of about 0.3 wt % to about 2.0 wt % of the second cooling material; and wherein the wt % is based on the total weight of the double-covered yarn. In an even further aspect, the second cooling material can be present in an amount of about 0.5 wt % to about 2.0 wt %; and wherein the wt % is based on the total weight of the double-covered yarn.

In a further aspect, the second cooling material can be present in the second cooling composition, based on the total weight of the double-covered yarn, in an amount of about 0.0 wt %, about 0.1 wt %; about 0.2 wt %; about 0.3 wt %;

about 0.4 wt %; about 0.5 wt %; about 0.6 wt %; about 0.7 wt %; about 0.8 wt %; about 0.9 wt %; about 1.0 wt %, about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, a sub-range with a range utilizing any of the foregoing values; or any set of values utilizing the foregoing values.

In a further aspect, the second cooling compound can be present in the second cooling polymer composition in an amount of about 0.001 wt % to about 0.05 wt %; about 0.005 wt % to about 0.03 wt %; about 0.007 wt % to about 0.03 wt %; about 0.007 wt % to about 0.20 wt %; and wherein the wt % is based on the total weight of the double-covered yarn.

In a further aspect, the second cooling compound can be present in the second cooling polymer composition, based on the total weight of the double-covered yarn, in an amount of about 0.001 wt %; about 0.002 wt %; about 0.003 wt %; about 0.004 wt %; about 0.005 wt %; about 0.010 wt %; about 0.015 wt %; about 0.020 wt %; about 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; about 0.075 wt %; about 0.080 wt %; about 0.085 wt %; about 0.090 wt %; about 0.090 wt %; about 0.095 wt %; about 0.100 wt %; about 0.110 wt %; about 0.115 wt %; about 0.120 wt %; about 0.125 wt %; about 0.130 wt %; about 0.135 wt %; about 0.140 wt %; about 0.145 wt %; about 0.150 wt %; about 0.155 wt %; about 0.160 wt %; about 0.165 wt %; about 0.170 wt %; about 0.175 wt %; about 0.180 wt %; about 0.185 wt %; about 0.190 wt %; about 0.190 wt %; about 0.195 wt %; about 0.200 wt %; a range utilizing any of the foregoing values; a sub-range with a range utilizing any of the foregoing values; or any set of values utilizing the foregoing values.

In a further aspect, the second cooling compound can be present in the second cooling polymer composition in an amount of about 0.1 wt % to about 5.0 wt %; about 0.1 wt % to about 4.0 wt %; about 0.1 wt % to about 3.0 wt %; about 0.1 wt % to about 2.5 wt %; about 0.5 wt % to about 2.2 wt %; and wherein the wt % is based on the total weight of the double-covered yarn.

In a further aspect, the second cooling compound can be present in the second cooling polymer composition, based on the total weight of the double-covered yarn, in an amount of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the second cooling composition comprises a second cooling salt present in an amount, based on the total weight of the double-covered yarn, of about 0.0001 wt % to about 0.005 wt %; about 0.0003 wt % to about 0.003 wt %; about 0.007 wt % to about 0.03 wt %; about 0.0001 wt % to about 0.003 wt %; a range utilizing any of the foregoing values; a sub-range with a range utilizing any of the foregoing values; or any set of values utilizing the foregoing values.

In a further aspect, the second cooling composition comprises a second cooling salt present in an amount, based on the total weight of the double-covered yarn, of about 0.0001 wt %; about 0.0002 wt %; about 0.0003 wt %; about 0.0004 wt %; about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; a range utilizing any of the foregoing values; a sub-range with a range utilizing any of the foregoing values; or any set of values utilizing the foregoing values.

In various aspects, the second cooling composition comprises a second cooling salt present in an amount, based on the total weight of the double-covered yarn, of about 0.01 wt % to about 2.0 wt %; about 0.01 wt % to about 1.0 wt %; about 0.01 wt % to about 0.75 wt %; about 0.05 wt % to about 0.5 wt %; about 0.07 wt % to about 0.45 wt %; or a sub-range within any of the foregoing ranges.

In a further aspect, the second cooling composition comprises a second cooling salt present in an amount, based on the total weight of the double-covered yarn, of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %;

about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.000 wt %; about 1.01 wt %; about 1.02 wt %; about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %; about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

E. Fabrics

In various aspects, the disclosure relates to a woven fabric comprising a disclosed double covered yarn. More specifically, in one aspect, the present disclosure relates to a woven fabric comprising: a weft yarn comprising a disclosed double covered yarn; and a warp yarn comprising cotton fibers. In a further aspect, the disclosed woven fabric is a denim fabric.

In various aspects, the woven fabric can be a warp-faced fabric. In some aspects, the disclosed woven fabric is a right-handed twill weave; and wherein the right-handed twill weave has diagonals run from the left to the right of the fabric. The disclosed woven fabric can have a weave pattern that is a 3 by 1 weave; and wherein 3 warp yarns are woven over and under a weft yarn.

In various aspects, a disclosed woven fabric comprises about 50 wt % to about 90 wt % cotton yarn; about 0.5 wt % to about 10 wt % of an elastic yarn; about 5 wt % to about 30 wt % of first yarn comprising a disclosed composite yarn; and about 5 wt % to about 30 wt % of a second yarn comprising a woven fabric-covered yarn. In a further aspect, a disclosed woven fabric comprises about 60 wt % to about 80 wt % cotton yarn; about 0.5 wt % to about 7.5 wt % of an elastic yarn; about 5 wt % to about 20 wt % of first yarn comprising a disclosed composite yarn; and about 5 wt % to about 20 wt % of a second yarn comprising a cellulosic fiber; and wherein the weight percent is based upon the total weight of the woven fabric. In a still further aspect, a disclosed woven fabric comprises about 65 wt % to about 80 wt % cotton yarn; about 0.5 wt % to about 5.0 wt % of an elastic yarn; about 5 wt % to about 15 wt % of first yarn comprising a disclosed composite yarn; and about 7.5 wt % to about 20 wt % of a second yarn comprising a cellulosic fiber; and wherein the weight percent is based upon the total weight of the woven fabric.

In a further aspect, a disclosed woven fabric comprises a cotton in a weight percent amount based on the total weight of the disclosed woven fabric of about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; about 81 wt %; about 82 wt %; about 83 wt %; about 84 wt %; about 85 wt %; about 86 wt %; about 87 wt %; about 88 wt %; about 89 wt %; about 90 wt %; a range utilizing any of the foregoing values; a sub-range with a range utilizing any of the foregoing values; or any set of values utilizing the foregoing values.

In a further aspect, a disclosed woven fabric comprises an elastic yarn in a weight percent amount based on the total weight of the disclosed woven fabric of about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, a disclosed woven fabric comprises a first yarn in a weight percent amount based on the total weight of the disclosed woven fabric of about 5 wt %; about 6 wt %; about 7 wt %; about 8 wt %; about 9 wt %; about 10 wt %; about 11 wt %; about 12 wt %; about 13 wt %; about 14 wt %; about 15 wt %; about 16 wt %; about 17 wt %; about 18 wt %; about 19 wt %; about 20 wt %; about 21 wt %; about 22 wt %; about 23 wt %; about 24 wt %; about 25 wt %; about 26 wt %; about 27 wt %; about 28 wt %; about 29 wt %; about 30 wt %; a range utilizing any of the foregoing values; a sub-range with a range utilizing any of the foregoing values; or any set of values utilizing the foregoing values.

In a further aspect, a disclosed woven fabric comprises a second yarn in a weight percent amount based on the total weight of the disclosed woven fabric of about 5 wt %; about 6 wt %; about 7 wt %; about 8 wt %; about 9 wt %; about 10 wt %; about 11 wt %; about 12 wt %; about 13 wt %; about 14 wt %; about 15 wt %; about 16 wt %; about 17 wt %; about 18 wt %; about 19 wt %; about 20 wt %; about 21 wt %; about 22 wt %; about 23 wt %; about 24 wt %; about 25 wt %; about 26 wt %; about 27 wt %; about 28 wt %; about 29 wt %; about 30 wt %; a range utilizing any of the foregoing values; a sub-range with a range utilizing any of the foregoing values; or any set of values utilizing the foregoing values.

In a further aspect, the warp yarn of the disclosed woven fabric can comprise a cotton yarn having a weight of about 8's to about 50's. In a further aspect, the cotton yarn can have a weight of about 8's, about 9's, about 10's, about 11's, about 12's, about 13's, about 14's, about 15's, about 16's, about 17's, about 18's, about 19's, about 20's, about 21's, about 22's, about 23's, about 24's, about 25's, about 26's, about 27's, about 28's, about 29's, about 30's, about 31's, about 32's, about 33's, about 34's, about 35's, about 36's, about 37's, about 38's, about 39's, about 40's, about 41's, about 42's, about 43's, about 44's, about 45's, about 46's, about 47's, about 48's, about 49's, about 50's, any combination of the foregoing values, or any range encompassed by two or more of the foregoing values.

In various aspects, the disclosed woven fabric comprises about 50 wt % to about 70 wt % cotton fibers; about 1 wt % to about 15 wt % of a polyester polymer; about 1 wt % to about 10 wt % of a polyamide polymer; and about 0.1 wt % to about 5 wt % of an elastic fiber or elastic filament. In a further aspect, the disclosed woven fabric comprises about 55 wt % to about 70 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament. In a still further aspect, the disclosed woven fabric comprises about 60 wt % to about 70 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

In a further aspect, the disclosed woven fabric has a weight of about 4 oz/sy to about 10 oz/sy; about 5 oz/sy to about 8 oz/sy; about 5 oz/sy to about 7 oz/sy; about 5.5 oz/sy to about 6.5 oz/sy; or a sub-range within or overlapping any of the foregoing ranges.

In a further aspect, the disclosed woven fabric has a weight of about 6.20 oz/sy±10%; about 6.20 oz/sy±5%; about 6.20 oz/sy±3%; about 6.21 oz/sy±10%; about 6.21 oz/sy±5%; about 6.21 oz/sy±3%; about 6.22 oz/sy±10%; about 6.22 oz/sy±5%; about 6.22 oz/sy±3%; about 6.23 oz/sy±10%; about 6.23 oz/sy±5%; about 6.23 oz/sy±3%; about 6.24 oz/sy±10%; about 6.24 oz/sy±5%; about 6.24 oz/sy±3%; about 6.25 oz/sy±10%; about 6.25 oz/sy±5%; about 6.25 oz/sy±3%; about 6.27 oz/sy±10%; about 6.27 oz/sy±5%; about 6.27 oz/sy±3%; about 6.28 oz/sy±10%; about 6.28 oz/sy±5%; about 6.28 oz/sy±3%; about 6.29 oz/sy±10%; about 6.29 oz/sy±5%; about 6.29 oz/sy±3%; about 6.30 oz/sy±10%; about 6.30 oz/sy±5%; about 6.30 oz/sy±3%; about 6.40 oz/sy±10%; about 6.40 oz/sy±5%; about 6.40 oz/sy±3%; about 6.50 oz/sy±10%; about 6.50 oz/sy±5%; about 6.50 oz/sy±3%; about 6.60 oz/sy±10%; about 6.60 oz/sy±5%; about 6.60 oz/sy±3%; about 6.70 oz/sy±10%; about 6.70 oz/sy±5%; about 6.70 oz/sy±3%; about 6.80 oz/sy±10%; about 6.80 oz/sy±5%; about 6.80 oz/sy±3%; about 6.90 oz/sy±10%; about 6.90 oz/sy±5%; about 6.90 oz/sy±3%; about 7.00 oz/sy±10%; about 7.00 oz/sy±5%; about 7.00 oz/sy±3%; a range utilizing any of the foregoing values; a sub-range with a range utilizing any of the foregoing values; or any set of values utilizing the foregoing values.

In a further aspect, the disclosed woven fabric has a Qmax value of about 0.15 to about 0.50 when determined in accordance with FTTS-FA-019 as specified by Committee of Conformity Assessment of Accreditation and Certification on Functional and Technical Textiles (Taiwan). In a still further aspect, the disclosed woven fabric has a Qmax value of about 0.17 to about 0.25 when determined in accordance with FTTS-FA-019 as specified by Committee of Conformity Assessment of Accreditation and Certification on Functional and Technical Textiles (Taiwan).

In a further aspect, the disclosed woven fabric has a Qmax value, when determined in accordance with FTTS-FA-019 as specified by Committee of Conformity Assessment of Accreditation and Certification on Functional and Technical Textiles (Taiwan), of about 0.10±10%; about 0.10±5%; about 0.10±3%; about 0.11±10%; about 0.11±5%; about 0.11±3%; about 0.12±10%; about 0.12±5%; about 0.12±3%; about 0.13±10%; about 0.13±5%; about 0.13±3%; about 0.14±10%; about 0.14±5%; about 0.14±3%; about 0.15±10%; about 0.15±5%; about 0.15±3%; about 0.16±10%; about 0.16±5%; about 0.16±3%; about 0.17±10%; about 0.17±5%; about 0.17±3%; about 0.18±10%; about 0.18±5%; about 0.18±3%; about 0.19±10%; about 0.19±5%; about 0.19±3%; about 0.20±10%; about 0.20±5%; about 0.20±3%; about 0.21±10%; about 0.21±5%; about 0.21±3%; about 0.22±10%; about 0.22±5%; about 0.22±3%; about 0.23±10%; about 0.23±5%; about 0.23±3%; about 0.24±10%; about 0.24±5%; about 0.24±3%; about 0.25±10%; about 0.25±5%; about 0.25±3%; about 0.26±10%; about 0.26±5%; about 0.26±3%; about 0.27±10%; about 0.27±5%; about 0.27±3%; about 0.28±10%; about 0.28±5%; about 0.28±3%; about 0.29±10%; about 0.29±5%; about 0.29±3%; about 0.30±10%; about 0.30±5%; about 0.30±3%; a range utilizing any of the foregoing values; a sub-range with a range utilizing any of the foregoing values; or any set of values utilizing the foregoing values.

In a further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 20% greater than the Qmax value for a reference denim fabric. In this context, it is to be understood that the reference denim fabric consists essentially of cotton yarn, having a fabric weight that is ±10% of the fabric, and the same weave pattern as the fabric. In a still further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 25% greater than the Qmax value for a reference denim fabric. In a yet further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 30% greater than the Qmax value for a reference denim fabric.

In a further aspect, the disclosed woven fabric has a wicking time, when determined in accordance with AATCC Test Method 197, of less than about 5 minutes. In a still further aspect, the disclosed woven fabric has a wicking time, when determined in accordance with AATCC Test Method 197, of less than about 4.9 minutes, less than about 4.8 minutes, less than about 4.7 minutes, less than about 4.6 minutes, less than about 4.5 minutes, less than about 4.4 minutes, less than about 4.3 minutes, less than about 4.2 minutes, less than about 4.1 minutes, less than about 4.0 minutes, less than about 3.9 minutes, less than about 3.8 minutes, less than about 3.7 minutes, less than about 3.6 minutes, less than about 3.5 minutes, less than about 3.4 minutes, less than about 3.3 minutes, less than about 3.2 minutes, less than about 3.1 minutes, less than about 3.0 minutes, less than about 2.9 minutes, less than about 2.8 minutes, less than about 2.7 minutes, less than about 2.6 minutes, less than about 2.5 minutes, less than about 2.4 minutes, less than about 2.3 minutes, less than about 2.2 minutes, less than about 2.1 minutes, less than about 2.0 minutes, less than about 1.9 minutes, less than about 1.8 minutes, less than about 1.7 minutes, less than about 1.6 minutes, less than about 1.5 minutes, less than about 1.4 minutes, less than about 1.3 minutes, less than about 1.2 minutes, less than about 1.1 minutes, or less than about 1.0 minutes.

In a further aspect, the disclosed woven fabric has a wicking time, when determined in accordance with AATCC Test Method 197, from about 0.5 minutes to about 4.9 minutes, about 0.5 minutes to about 4.8 minutes, about 0.5 minutes to about 4.7 minutes, about 0.5 minutes to about 4.6 minutes, about 0.5 minutes to about 4.5 minutes, about 0.5 minutes to about 4.4 minutes, about 0.5 minutes to about 4.3 minutes, about 0.5 minutes to about 4.2 minutes, about 0.5 minutes to about 4.1 minutes, about 0.5 minutes to about 4.0 minutes, about 0.5 minutes to about 3.9 minutes, about 0.5 minutes to about 3.8 minutes, about 0.5 minutes to about 3.7 minutes, about 0.5 minutes to about 3.6 minutes, about 0.5 minutes to about 3.5 minutes, about 0.5 minutes to about 3.4 minutes, about 0.5 minutes to about 3.3 minutes, about 0.5 minutes to about 3.2 minutes, about 0.5 minutes to about 3.1 minutes, about 0.5 minutes to about 3.0 minutes, about 0.5 minutes to about 2.9 minutes, about 0.5 minutes to about 2.8 minutes, about 0.5 minutes to about 2.7 minutes, about 0.5 minutes to about 2.6 minutes, about 0.5 minutes to about 2.5 minutes, about 0.5 minutes to about 2.4 minutes, about 0.5 minutes to about 2.3 minutes, about 0.5 minutes to about 2.2 minutes, about 0.5 minutes to about 2.1 minutes, about 0.5 minutes to about 2.0 minutes, about 0.5 minutes to about 1.9 minutes, about 0.5 minutes to about 1.8 minutes, about 0.5 minutes to about 1.7 minutes, about 0.5 minutes to about 1.6 minutes, about 0.5 minutes to about 1.5 minutes, about 0.5 minutes to about 1.4 minutes, about 0.5 minutes to about 1.3 minutes, about 0.5 minutes to about 1.2 minutes, about 0.5 minutes to about 1.1 minutes, about 0.5 minutes to about 1.0 minutes, a sub-range of any of the foregoing ranges, or any value or set of values within the foregoing ranges.

In a further aspect, the disclosed woven fabric has a wicking time, when determined in accordance with AATCC Test Method 197, from about 1.0 minutes to about 4.9 minutes, about 1.0 minutes to about 4.8 minutes, about 1.0 minutes to about 4.7 minutes, about 1.0 minutes to about 4.6 minutes, about 1.0 minutes to about 4.5 minutes, about 1.0 minutes to about 4.4 minutes, about 1.0 minutes to about 4.3 minutes, about 1.0 minutes to about 4.2 minutes, about 1.0 minutes to about 4.1 minutes, about 1.0 minutes to about 4.0 minutes, about 1.0 minutes to about 3.9 minutes, about 1.0 minutes to about 3.8 minutes, about 1.0 minutes to about 3.7 minutes, about 1.0 minutes to about 3.6 minutes, about 1.0 minutes to about 3.5 minutes, about 1.0 minutes to about 3.4 minutes, about 1.0 minutes to about 3.3 minutes, about 1.0 minutes to about 3.2 minutes, about 1.0 minutes to about 3.1 minutes, about 1.0 minutes to about 3.0 minutes, about 1.0 minutes to about 2.9 minutes, about 1.0 minutes to about 2.8 minutes, about 1.0 minutes to about 2.7 minutes, about 1.0 minutes to about 2.6 minutes, about 1.0 minutes to about 2.5 minutes, about 1.0 minutes to about 2.4 minutes, about 1.0 minutes to about 2.3 minutes, about 1.0 minutes to about 2.2 minutes, about 1.0 minutes to about 2.1 minutes, about 1.0 minutes to about 2.0 minutes, about 1.0 minutes to about 1.9 minutes, about 1.0 minutes to about 1.8 minutes, about 1.0 minutes to about 1.7 minutes, about 1.0 minutes to about 1.6 minutes, about 1.0 minutes to about 1.5 minutes, about 1.0 minutes to about 1.4 minutes, about 1.0 minutes to about 1.3 minutes, about 1.0 minutes to about 1.2 minutes, about 1.0 minutes to about 1.1 minutes, a sub-range of any of the foregoing ranges, or any value or set of values within the foregoing ranges.

In a further aspect, the disclosed woven fabric has a wicking time, when determined in accordance with AATCC Test Method 197, from about 1.5 minutes to about 4.9 minutes, about 1.5 minutes to about 4.8 minutes, about 1.5 minutes to about 4.7 minutes, about 1.5 minutes to about 4.6 minutes, about 1.5 minutes to about 4.5 minutes, about 1.5 minutes to about 4.4 minutes, about 1.5 minutes to about 4.3 minutes, about 1.5 minutes to about 4.2 minutes, about 1.5 minutes to about 4.1 minutes, about 1.5 minutes to about 4.0 minutes, about 1.5 minutes to about 3.9 minutes, about 1.5 minutes to about 3.8 minutes, about 1.5 minutes to about 3.7 minutes, about 1.5 minutes to about 3.6 minutes, about 1.5 minutes to about 3.5 minutes, about 1.5 minutes to about 3.4 minutes, about 1.5 minutes to about 3.3 minutes, about 1.5 minutes to about 3.2 minutes, about 1.5 minutes to about 3.1 minutes, about 1.5 minutes to about 3.0 minutes, about 1.5 minutes to about 2.9 minutes, about 1.5 minutes to about 2.8 minutes, about 1.5 minutes to about 2.7 minutes, about 1.5 minutes to about 2.6 minutes, about 1.5 minutes to about 2.5 minutes, about 1.5 minutes to about 2.4 minutes, about 1.5 minutes to about 2.3 minutes, about 1.5 minutes to about 2.2 minutes, about 1.5 minutes to about 2.1 minutes, about 1.5 minutes to about 2.0 minutes, about 1.5 minutes to about 1.9 minutes, about 1.5 minutes to about 1.8 minutes, about 1.5 minutes to about 1.7 minutes, about 1.5 minutes to about 1.6 minutes, a sub-range of any of the foregoing ranges, or any value or set of values within the foregoing ranges.

In a further aspect, the disclosed woven fabric has a wicking time, when determined in accordance with AATCC Test Method 197, from about 2.0 minutes to about 4.9 minutes, about 2.0 minutes to about 4.8 minutes, about 2.0 minutes to about 4.7 minutes, about 2.0 minutes to about 4.6 minutes, about 2.0 minutes to about 4.5 minutes, about 2.0 minutes to about 4.4 minutes, about 2.0 minutes to about 4.3 minutes, about 2.0 minutes to about 4.2 minutes, about 2.0 minutes to about 4.1 minutes, about 2.0 minutes to about 4.0 minutes, about 2.0 minutes to about 3.9 minutes, about 2.0 minutes to about 3.8 minutes, about 2.0 minutes to about 3.7 minutes, about 2.0 minutes to about 3.6 minutes, about 2.0 minutes to about 3.5 minutes, about 2.0 minutes to about 3.4 minutes, about 2.0 minutes to about 3.3 minutes, about 2.0 minutes to about 3.2 minutes, about 2.0 minutes to about 3.1 minutes, about 2.0 minutes to about 3.0 minutes, about 2.0 minutes to about 2.9 minutes, about 2.0 minutes to about 2.8 minutes, about 2.0 minutes to about 2.7 minutes, about 2.0 minutes to about 2.6 minutes, about 2.0 minutes to about 2.5 minutes, about 2.0 minutes to about 2.4 minutes, about 2.0 minutes to about 2.3 minutes, about 2.0 minutes to about 2.2 minutes, about 2.0 minutes to about 2.1 minutes, a sub-range of any of the foregoing ranges, or any value or set of values within the foregoing ranges.

In various aspects, the disclosed woven fabric has a wicking time, when determined in accordance with AATCC Test Method 197, that is at least about 100% faster than the wicking time for a reference denim fabric. In this context, it is to be understood that the reference denim fabric consists essentially of cotton yarn, having a fabric weight that is ±10% of the fabric, and the same weave pattern as the fabric.

In a further aspect, the disclosed woven fabric has a wicking time, when determined in accordance with AATCC Test Method 197, that is at least about 50% faster than the wicking time for a reference denim fabric; at least about 55% faster than the wicking time for a reference denim fabric; at least about 60% faster than the wicking time for a reference denim fabric; at least about 65% faster than the wicking time for a reference denim fabric; at least about 70% faster than the wicking time for a reference denim fabric; at least about 75% faster than the wicking time for a reference denim fabric; at least about 80% faster than the wicking time for a reference denim fabric; at least about 85% faster than the wicking time for a reference denim fabric; at least about 90% faster than the wicking time for a reference denim fabric; at least about 95% faster than the wicking time for a reference denim fabric; at least about 100% faster than the wicking time for a reference denim fabric; at least about 110% faster than the wicking time for a reference denim fabric; at least about 115% faster than the wicking time for a reference denim fabric; at least about 120% faster than the wicking time for a reference denim fabric; at least about 125% faster than the wicking time for a reference denim fabric; at least about 130% faster than the wicking time for a reference denim fabric; at least about 135% faster than the wicking time for a reference denim fabric; at least about 140% faster than the wicking time for a reference denim fabric; at least about 145% faster than the wicking time for a reference denim fabric; at least about 150% faster than the wicking time for a reference denim fabric; at least about 155% faster than the wicking time for a reference denim fabric; at least about 160% faster than the wicking time for a reference denim fabric; at least about 165% faster than the wicking time for a reference denim fabric; at least about 170% faster than the wicking time for a reference denim fabric; at least about 175% faster than the wicking time for a reference denim fabric; at least about 180% faster than the wicking time for a reference denim fabric; at least about 185% faster than the wicking time for a reference denim fabric; at least about 190% faster than the wicking time for a reference denim fabric; at least about 195% faster than the wicking time for a reference denim fabric; or at least about 200% faster than the wicking time for a reference denim fabric.

In a further aspect, the disclosed woven fabric has a drying time, when determined in accordance with AATCC Test Method 79, of less than about 60 secs. In a still further aspect, the disclosed woven fabric has a drying time, when determined in accordance with AATCC Test Method 79, of about 8 secs to about 30 secs; about 10 secs to about 20 secs; about 10 secs to about 15 secs; or a sub-range of within any of the foregoing ranges.

In a further aspect, the disclosed woven fabric has a drying time, when determined in accordance with AATCC Test Method 79 that is at least about 100% faster than the drying time for a reference denim fabric. In this context, it is to be understood that the reference denim fabric consists essentially of cotton yarn, having a fabric weight that is ±10% of the fabric, and the same weave pattern as the fabric. In a still further aspect, the disclosed woven fabric has a drying time, when determined in accordance with AATCC Test Method 79, that is faster than the drying time for the reference denim fabric by about 100%; about 200%; about 300%, about 400%; about 500%; or range encompassed by any combination of the foregoing values.

In a further aspect, the disclosed woven fabric has a drying rate, when determined in accordance with AATCC Test Method 201 that is less than about 2.5 ml/hr. In a still further aspect, the disclosed woven fabric has a drying rate, when determined in accordance with AATCC Test Method 201 that is about 0.5 ml/hr to about 1.5 ml/hr; about 0.5 ml/hr to about 1.0 ml/hr; about 0.5 ml/hr to about 0.7 ml/hr; or a sub-range within any of the foregoing ranges.

In a further aspect, the disclosed woven fabric has a UPF test value, when tested in accordance with AATCC Test Method 183, of at least about 1500 for dry evaluation and of at least about 3500 for wet evaluation. In a still further aspect, the disclosed woven fabric has a UPF test value, when tested in accordance with AATCC Test Method 183, of about 1500 to about 3000 for dry evaluation and of about 3500 to about 4500 for wet evaluation; about 1700 to about 2800 for dry evaluation and of about 3700 to about 4300 for wet evaluation; about 2000 to about 2700 for dry evaluation and of about 3800 to about 4200 for wet evaluation; or a sub-range within any of the foregoing ranges. In a yet further aspect, the disclosed woven fabric has a UPF test value, when tested in accordance with AATCC Test Method 183, of about 2500±10% for dry evaluation and of about 4100±10% for wet evaluation; about 2500±5% for dry evaluation and of about 4100±5% for wet evaluation; about 2500±3% for dry evaluation and of about 4100±3% for wet evaluation.

In a further aspect, the disclosed woven fabric has a UPF test value, when tested in accordance with AATCC Test Method 183, that is about 100% greater and for wet evaluation that is about 100% greater than for a reference denim fabric. In this context, it is understood that the reference denim fabric consists essentially of cotton yarn, having a fabric weight that is ±10% of the fabric, and the same weave pattern as the fabric. In a still further aspect, the disclosed woven fabric has a UPF test value, when tested in accordance with AATCC Test Method 183, that is about 150% greater and for wet evaluation that is about 150% greater than for the reference denim fabric. In a yet further aspect, the disclosed woven fabric has a UPF test value, when tested in accordance with AATCC Test Method 183, that is about 200% greater and for wet evaluation that is about 200% greater than for the reference denim fabric. In an even further aspect, the disclosed woven fabric has a UPF test value, when tested in accordance with AATCC Test Method 183, that is about 250% greater and for wet evaluation that is about 250% greater than for the reference denim fabric. In a still further aspect, the disclosed woven fabric has a UPF test value, when tested in accordance with AATCC Test Method 183, that is about 300% greater and for wet evaluation that is about 300% greater than for the reference denim fabric.

In an aspect, the first cooling composition can be present in an amount of about 0.005 wt % to about 0.2 wt % based on the total weight of the woven fabric. In a further aspect, the first cooling composition can be present in an amount, based on the total weight of the woven fabric of about 0.005 wt %; about 0.006 wt %; about 0.007 wt %; about 0.008 wt %; about 0.009 wt %; about 0.011 wt %; about 0.012 wt %;

about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the first cooling composition can be present in an amount of about 0.1 wt % to about 2.0 wt % based on the total weight of the woven fabric. In a further aspect, the first cooling composition can be present in an amount, based on the total weight of the woven fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the first cooling composition can comprise, based on the total weight of the woven fabric, about 0.005 wt % to about 0.150 wt % of the first cooling material; about 0.0001 wt % to about 0.009 wt % of the first cooling compound; about 0.00005 wt % to about 0.002 wt % of the first cooling salt; or combinations thereof; and wherein the wt % is based on the total weight of the woven fabric. In a still further aspect, the first cooling composition can comprise, based on the total weight of the woven fabric, about 0.007 wt % to about 0.150 wt % of the first cooling material; about 0.0005 wt % to about 0.007 wt % of the first cooling compound; about 0.00005 wt % to about 0.0015 wt % of the first cooling salt; or combinations thereof; and wherein the wt % is based on the total weight of the woven fabric. In a yet further aspect, the first cooling composition can comprise, based on the total weight of the woven fabric, about 0.010 wt % to about 0.100 wt % of the first cooling material; about 0.0007 wt % to about 0.005 wt % of the first cooling compound; and about 0.00005 wt % to about 0.001 wt % of the first cooling salt; and wherein the wt % is based on the total weight of the woven fabric. In an even further aspect, the first cooling composition can comprise, based on the total weight of the woven fabric, about 0.010 wt % to about 0.090 wt % of the first cooling material; about 0.0010 wt % to about 0.0060 wt % of the first cooling compound; and about 0.0001 wt % to about 0.0003 wt % of the first cooling salt; and wherein the wt % is based on the total weight of the woven fabric.

In a further aspect, the first cooling composition can comprise, based on the total weight of the woven fabric, about 0.01 wt % to about 1.0 wt % of the first cooling material; about 0.01 wt % to about 1.5 wt % of the first cooling compound; about 0.001 wt % to about 0.20 wt % of the first cooling salt; or combinations thereof; and wherein the wt % is based on the total weight of the woven fabric. In a still further aspect, the first cooling composition can comprise, based on the total weight of the woven fabric, about 0.05 wt % to about 1.0 wt % of the first cooling material; about 0.05 wt % to about 1.0 wt % of the first cooling compound; about 0.005 wt % to about 0.15 wt % of the first cooling salt; or combinations thereof; and wherein the wt % is based on the total weight of the woven fabric. In a yet further aspect, the first cooling composition can comprise, based on the total weight of the woven fabric, about 0.1 wt % to about 0.75 wt % of the first cooling material; about 0.1 wt % to about 0.9 wt % of the first cooling compound; and about 0.01 wt % to about 0.15 wt % of the first cooling salt; and wherein the wt % is based on the total weight of the woven fabric. In an even further aspect, the first cooling composition can comprise, based on the total weight of the woven fabric, about 0.15 wt % to about 0.50 wt % of the first cooling material; about 0.15 wt % to about 0.75 wt % of the first cooling compound; and about 0.01 wt % to about 0.15 wt % of the first cooling salt; and wherein the wt % is based on the total weight of the woven fabric.

In a further aspect, the first cooling material can be present in the first cooling composition in an amount of about 0.005 wt % to about 0.150 wt %; and wherein the wt % is based on the total weight of the woven fabric. In a still further aspect, the first cooling material can be present in an amount of about 0.007 wt % to about 0.150 wt %; and wherein the wt % is based on the total weight of the woven fabric. In a yet further aspect, the first cooling material can be present in an amount of about 0.010 wt % to about 0.100 wt %; and wherein the wt % is based on the total weight of the woven fabric. In an even further aspect, the first cooling material can be present in an amount of about 0.010 wt % to about 0.090 wt %; and wherein the wt % is based on the total weight of the woven fabric.

In a further aspect, the first cooling material can be present in the first cooling composition, based on the total weight of the woven fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.01 wt % to about 1.0 wt %; and wherein the wt % is based on the total weight of the woven fabric. In a still further aspect, the first cooling material can be present in an amount of about 0.05 wt % to about 1.0 wt %; and wherein the wt % is based on the total weight of the woven fabric. In a yet further aspect, the first cooling material can be present in an amount of about 0.1 wt % to about 0.75 wt %; and wherein the wt % is based on the total weight of the woven fabric. In a still further aspect, the first cooling material can be present in an amount of about 0.15 wt % to about 0.50 wt % of the first cooling material; and wherein the wt % is based on the total weight of the woven fabric.

In a further aspect, the first cooling material can be present in the first cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the first cooling compound can be present in the first cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the woven fabric.

In a further aspect, the first cooling compound can be present in the first cooling composition, based on the total weight of the woven fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the first cooling compound can be present in the first cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the woven fabric.

In a further aspect, the first cooling compound can be present in the first cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the woven fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the woven fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the first cooling salt can be present in the first cooling composition, based on the total weight of the woven fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the first cooling salt can be present in the first cooling composition, based on the total weight of the woven fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.101 wt %; about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

In an aspect, the second cooling composition can be present in an amount of about 0.005 wt % to about 0.2 wt % based on the total weight of the woven fabric. In a further aspect, the second cooling composition can be present in an amount, based on the total weight of the woven fabric of about 0.005 wt %; about 0.006 wt %; about 0.007 wt %; about 0.008 wt %; about 0.009 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %;

about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the second cooling composition can be present in an amount of about 0.1 wt % to about 2.0 wt % based on the total weight of the woven fabric. In a further aspect, the second cooling composition can be present in an amount, based on the total weight of the woven fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the second cooling composition can comprise, based on the total weight of the woven fabric, about 0.005 wt % to about 0.150 wt % of the second cooling material; about 0.0001 wt % to about 0.009 wt % of the second cooling compound; about 0.00005 wt % to about 0.002 wt % of the second cooling salt; or combinations thereof; and wherein the wt % is based on the total weight of the woven fabric. In a still further aspect, the second cooling composition can comprise, based on the total weight of the woven fabric, about 0.007 wt % to about 0.150 wt % of the second cooling material; about 0.0005 wt % to about 0.007 wt % of the second cooling compound; about 0.00005 wt % to about 0.0015 wt % of the second cooling salt; or combinations thereof; and wherein the wt % is based on the total weight of the woven fabric. In a yet further aspect, the second cooling composition can comprise, based on the total weight of the woven fabric, about 0.010 wt % to about 0.100 wt % of the second cooling material; about 0.0007 wt % to about 0.005 wt % of the second cooling compound; and about 0.00005 wt % to about 0.001 wt % of the second cooling salt; and wherein the wt % is based on the total weight of the woven fabric. In an even further aspect, the second cooling composition can comprise, based on the total weight of the woven fabric, about 0.010 wt % to about 0.090 wt % of the second cooling material; about 0.0010 wt % to about 0.0060 wt % of the second cooling compound; and about 0.0001 wt % to about 0.0003 wt % of the second cooling salt; and wherein the wt % is based on the total weight of the woven fabric.

In a further aspect, the second cooling composition can comprise, based on the total weight of the woven fabric, about 0.01 wt % to about 1.0 wt % of the second cooling material; about 0.01 wt % to about 1.5 wt % of the second cooling compound; about 0.001 wt % to about 0.20 wt % of the second cooling salt; or combinations thereof; and wherein the wt % is based on the total weight of the woven fabric. In a still further aspect, the second cooling composition can comprise, based on the total weight of the woven fabric, about 0.05 wt % to about 1.0 wt % of the second cooling material; about 0.05 wt % to about 1.0 wt % of the second cooling compound; about 0.005 wt % to about 0.15 wt % of the second cooling salt; or combinations thereof; and wherein the wt % is based on the total weight of the woven fabric. In a yet further aspect, the second cooling composition can comprise, based on the total weight of the woven fabric, about 0.1 wt % to about 0.75 wt % of the second cooling material; about 0.1 wt % to about 0.9 wt % of the second cooling compound; and about 0.01 wt % to about 0.15 wt % of the second cooling salt; and wherein the wt % is based on the total weight of the woven fabric. In an even further aspect, the second cooling composition can comprise, based on the total weight of the woven fabric, about 0.15 wt % to about 0.50 wt % of the second cooling material; about 0.15 wt % to about 0.75 wt % of the second cooling compound; and about 0.01 wt % to about 0.15 wt % of the second cooling salt; and wherein the wt % is based on the total weight of the woven fabric.

In a further aspect, the second cooling material can be present in the second cooling composition in an amount of about 0.005 wt % to about 0.150 wt %; and wherein the wt % is based on the total weight of the woven fabric. In a still further aspect, the second cooling material can be present in an amount of about 0.007 wt % to about 0.150 wt %; and wherein the wt % is based on the total weight of the woven fabric. In a yet further aspect, the second cooling material can be present in an amount of about 0.010 wt % to about 0.100 wt %; and wherein the wt % is based on the total weight of the woven fabric. In an even further aspect, the second cooling material can be present in an amount of about 0.010 wt % to about 0.090 wt %; and wherein the wt % is based on the total weight of the woven fabric.

In a further aspect, the second cooling material can be present in the second cooling composition, based on the total weight of the woven fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.01 wt % to about 1.0 wt %; and wherein the wt % is based on the total weight of the woven fabric. In a still further aspect, the second cooling material can be present in an amount of about 0.05 wt % to about 1.0 wt %; and wherein the wt % is based on the total weight of the woven fabric. In a yet further aspect, the second cooling material can be present in an amount of about 0.1 wt % to about 0.75 wt %; and wherein the wt % is based on the total weight of the woven fabric. In a still further aspect, the second cooling material can be present in an amount of about 0.15 wt % to about 0.50 wt % of the second cooling material; and wherein the wt % is based on the total weight of the woven fabric.

In a further aspect, the second cooling material can be present in the second cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the second cooling compound can be present in the second cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the woven fabric.

In a further aspect, the second cooling compound can be present in the second cooling composition, based on the total weight of the woven fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the second cooling compound can be present in the second cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the woven fabric.

In a further aspect, the second cooling compound can be present in the second cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the woven fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the woven fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the second cooling salt can be present in the second cooling composition, based on the total weight of the woven fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the second cooling salt can be present in the second cooling composition, based on the total weight of the woven fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.101 wt %; about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

F. Articles

In one aspect, the disclosure relates to articles comprising a disclosed composite yarn. In a further aspect, the article comprising the disclosed composite yarn is an article of clothing, including, but not limited to a pair of pants, a shirt, a jacket, a dress, a glove, a skirt, T-shirt, vest, poly top, pullover, male or female brief, underwear, long-john, night-wear such as pajamas, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed composite yarn is an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed composite yarn an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed composite yarn a floor covering. In a yet further aspect, the article comprising the disclosed composite yarn is a tote bag, a furniture cover, a tarpaulin, or a vehicle seat.

In one aspect, the disclosure relates to articles comprising a disclosed double covered yarn. In a further aspect, the article comprising the disclosed double covered yarn is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed double covered yarn an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed double covered yarn an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed double covered yarn a floor covering. In a yet further aspect, the article comprising the disclosed double covered yarn is a tote bag, a furniture cover, a tarpaulin, or a vehicle seat.

In one aspect, the disclosure relates to articles comprising a disclosed fabric. In a further aspect, the article comprising the disclosed fabric is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, boxing glove, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed fabric an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed fabric an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed fabric a floor covering. In a yet further aspect, the article comprising the disclosed fabric is a tote bag, a furniture cover, a tarpaulin, or a vehicle seat.

G. Disclosed Aspects

The following listing of exemplary aspects supports and is supported by the disclosure provided herein.

Aspect 1. A composite yarn comprising a core component and a sheath layer, where: (a) the core component comprises a polyester polymer and a first cooling composition; and (b) the sheath layer comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

Aspect 2. The composite yarn of Aspect 1, wherein the polyester polymer is a polyethylene terephthalate, a polytrimethylene terephthalate, or combinations thereof.

Aspect 3. The composite yarn of Aspect 2, wherein the polyester polymer is a polyethylene terephthalate.

Aspect 4. The composite yarn of any one of Aspects 1-3, wherein the first cooling composition can be present in an amount of about 0.001 wt % to about 5 wt % based on the total weight of the polyester polymer and the cooling composition.

Aspect 5. The composite yarn of any one of Aspects 1-4, wherein the first cooling composition comprises about 0.2 wt % to about 2 wt % of the first cooling material; about 0.02 wt % to about 0.07 wt % of the first cooling compound; about 0.001 wt % to about 0.02 wt % of the first cooling salt; or combinations thereof; and wherein the wt % is based on the total weight of the polyester polymer and the cooling composition.

Aspect 6. The composite yarn of any one of Aspects 1-5, wherein the first cooling composition comprises about 0.5 wt % to about 1 wt % of the first cooling material; about 0.03 wt % to about 0.05 wt % of the first cooling compound; about 0.001 wt % to about 0.01 wt % of the first cooling salt; or combinations thereof; and wherein the wt % is based on the total weight of the polyester polymer and the cooling composition.

Aspect 7. The composite yarn of any one of Aspects 1-6, wherein the first cooling composition comprises about 0.2 wt % to about 2 wt % of the first cooling material; about 0.02 wt % to about 0.07 wt % of the first cooling compound; and about 0.001 wt % to about 0.02 wt % of the first cooling salt; and wherein the wt % is based on the total weight of the polyester polymer and the cooling composition.

Aspect 8. The composite yarn of any one of Aspects 1-7, wherein the first cooling composition comprises about 0.5 wt % to about 1 wt % of the first cooling material; about 0.03 wt % to about 0.05 wt % of the first cooling compound; and about 0.001 wt % to about 0.01 wt % of the first cooling salt; and wherein the wt % is based on the total weight of the polyester polymer and the cooling composition.

Aspect 9. The composite yarn of any one of Aspects 1-8, wherein the first cooling material can be present in an amount of about 0.2 wt % to about 2 wt %; and wherein the wt % is based on the total weight of the polyester polymer and the cooling composition.

Aspect 10. The composite yarn of Aspect 9, wherein the first cooling material can be present in an amount of about 0.4 wt % to about 1 wt %; and wherein the wt % is based on the total weight of the polyester polymer and the cooling composition.

Aspect 11. The composite yarn of Aspect 9, wherein the first cooling material can be present in an amount of about 0.5 wt % to about 0.9 wt %; and wherein the wt % is based on the total weight of the polyester polymer and the cooling composition.

Aspect 12. The composite yarn of any one of Aspects 1-11, wherein the first cooling material is a metal, a metal alloy, a metal oxide, a carbon material, a ceramic material, a mineral, or combinations thereof.

Aspect 13. The composite yarn of Aspect 12, wherein the mineral comprises silicon, zirconium, titanium, or combinations thereof.

Aspect 14. The composite yarn of Aspect 13, wherein the mineral comprising zirconium is allendeite, baddeleyite, eudialyte, loranskite, menezesite, or combinations thereof.

Aspect 15. The composite yarn of Aspect 13, wherein the mineral comprising titanium is rutile, ilmenite, titanite, anatase, brookite, or combinations thereof.

Aspect 16. The composite yarn of Aspect 13, wherein the mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 17. The composite yarn of Aspect 13, wherein the mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 18. The composite yarn of Aspect 12, wherein the ceramic comprises aluminum oxide, aluminum titanate, zirconium oxide, aluminum nitride, silicon carbide, silicon nitride, silicon alumina nitride, or combinations thereof.

Aspect 19. The composite yarn of Aspect 12, wherein the metal comprises silver, aluminum, copper, or combinations thereof.

Aspect 20. The composite yarn of Aspect 19, wherein the metal comprises silver.

Aspect 21. The composite yarn of Aspect 19, wherein the metal comprises copper.

Aspect 22. The composite yarn of Aspect 19, wherein the metal comprises a mixture of copper and silver.

Aspect 23. The composite yarn of Aspect 12, wherein the metal alloy comprises silver, aluminum, copper, or combinations thereof.

Aspect 24. The composite yarn of Aspect 23, wherein in the metal alloy comprises silver.

Aspect 25. The composite yarn of Aspect 23, wherein in the metal alloy comprises copper.

Aspect 26. The composite yarn of Aspect 23, wherein in the metal alloy comprises silver and copper.

Aspect 27. The composite yarn of Aspect 12, wherein the metal oxide comprises gold (II) oxide, gold (Ill) oxide, silver (I) oxide, silver (II) oxide, silver (I, III) oxide, magnesium oxide, iron (II) oxide, iron (Ill) oxide, copper (I) oxide, copper (II) oxide, or combinations thereof.

Aspect 28. The composite yarn of Aspect 27, wherein the metal oxide comprises silver (I) oxide, copper (I) oxide, copper (II) oxide, or combinations thereof.

Aspect 29. The composite yarn of Aspect 27, wherein the metal oxide comprises silver (I) oxide.

Aspect 30. The composite yarn of any one of Aspects 4-26, wherein the first cooling material is a powder, a wire, a filament, a sheet, a particle, or combinations thereof.

Aspect 31. The composite yarn of Aspect 30, wherein the first cooling material is a particle, a powder, or combinations thereof.

Aspect 32. The composite yarn of Aspect 31, where the first cooling material is a particle.

Aspect 33. The composite yarn of Aspect 32, wherein the first cooling material is a nanoparticle, a microparticle, or combinations thereof.

Aspect 34. The composite yarn of Aspect 33, wherein the nanoparticle has a size of about 10 nm to about 100 nm.

Aspect 35. The composite yarn of Aspect 33, wherein the nanoparticle has a size of about 15 nm to about 50 nm.

Aspect 36. The composite yarn of Aspect 33, wherein the nanoparticle has a size of about 20 nm to about 40 nm.

Aspect 37. The composite yarn of Aspect 33, wherein the microparticle has a size of about 10 μm to about 200 μm.

Aspect 38. The composite yarn of Aspect 33, wherein the microparticle has a size of about 20 μm to about 100 μm.

Aspect 39. The composite yarn of Aspect 33, wherein the microparticle has a size of about 30 μm to about 90 μm.

Aspect 40. The composite yarn of Aspect 33, wherein the microparticle has a size of about 40 μm to about 80 μm.

Aspect 41. The composite yarn of Aspect 33, wherein the microparticle has a size of about 50 μm to about 70 μm.

Aspect 42. The composite yarn of any one of Aspects 1-41, wherein the first cooling compound can be present in an amount of about 0.02 wt % to about 0.07 wt % of the first cooling compound; and wherein the wt % is based on the total weight of the polyester polymer and the cooling composition.

Aspect 43. The composite yarn of any Aspect 42, wherein the first cooling compound can be present in an amount of about 0.03 wt % to about 0.07 wt % of the first cooling compound; and wherein the wt % is based on the total weight of the polyester polymer and the cooling composition.

Aspect 44. The composite yarn of any Aspect 42, wherein the first cooling compound can be present in an amount of about 0.03 wt % to about 0.06 wt % of the first cooling compound; and wherein the wt % is based on the total weight of the polyester polymer and the cooling composition.

Aspect 45. The composite yarn of any Aspect 42, wherein the first cooling compound can be present in an amount of about 0.03 wt % to about 0.05 wt % of the first cooling compound; and wherein the wt % is based on the total weight of the polyester polymer and the cooling composition.

Aspect 46. The composite yarn of any one of Aspects 1-45, wherein the first cooling compound comprises a transition metal oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 47. The composite yarn of Aspect 46, wherein the first cooling compound comprises aluminum oxide, silicon carbide, silicon dioxide, silicon carbide, silicon dioxide, titanium oxide, titanium dioxide, titanium trioxide, zirconium dioxide, or combinations thereof.

Aspect 48. The composite yarn of Aspect 47, wherein the first cooling compound comprises aluminum oxide, silicon dioxide, titanium dioxide, or combinations thereof.

Aspect 49. The composite yarn of Aspect 48, wherein the first cooling compound comprises titanium dioxide.

Aspect 50. The composite yarn of any one of Aspects 42-49, wherein the first cooling compound is a powder, a wire, a filament, a sheet, a particle, or combinations thereof.

Aspect 51. The composite yarn of Aspect 50, wherein the first cooling compound is a powder, a particle, or combinations thereof.

Aspect 52. The composite yarn of Aspect 51, wherein the first cooling compound is a particle.

Aspect 53. The composite yarn of Aspect 52, wherein the particle is a nanoparticle, a microparticle, or combinations thereof.

Aspect 54. The composite yarn of Aspect 53, wherein the nanoparticle has a size of about 10 nm to about 100 nm.

Aspect 55. The composite yarn of Aspect 53, wherein the nanoparticle has a size of about 15 nm to about 50 nm.

Aspect 56. The composite yarn of Aspect 53, wherein the nanoparticle has a size of about 20 nm to about 40 nm.

Aspect 57. The composite yarn of Aspect 53, wherein the microparticle has a size of about 10 μm to about 200 μm.

Aspect 58. The composite yarn of Aspect 53, wherein the microparticle has a size of about 20 μm to about 100 μm.

Aspect 59. The composite yarn of Aspect 53, wherein the microparticle has a size of about 30 μm to about 90 μm.

Aspect 60. The composite yarn of Aspect 53, wherein the microparticle has a size of about 40 μm to about 80 μm.

Aspect 61. The composite yarn of Aspect 53, wherein the microparticle has a size of about 50 μm to about 70 μm.

Aspect 62. The composite yarn of any one of Aspects 1-61, wherein the first cooling salt can be present in an amount of about 0.001 wt % to about 0.02 wt % of the first cooling salt; and wherein the wt % is based on the total weight of the polyester polymer and the cooling composition.

Aspect 63. The composite yarn of Aspect 62, wherein the first cooling salt can be present in an amount of about 0.001 wt % to about 0.01 wt % of the first cooling salt; and wherein the wt % is based on the total weight of the polyester polymer and the cooling composition.

Aspect 64. The composite yarn of Aspect 62, wherein the first cooling salt can be present in an amount of about 0.002 wt % to about 0.01 wt % of the first cooling salt; and wherein the wt % is based on the total weight of the polyester polymer and the cooling composition.

Aspect 65. The composite yarn of any one of Aspects 1-64, wherein the first cooling salt is a Group I salt, a Group II salt, a transition metal salt, or combinations thereof.

Aspect 66. The composite yarn of Aspect 65, wherein the first cooling salt is a Group I salt.

Aspect 67. The composite yarn of Aspect 65, wherein the first cooling salt is a Group II salt.

Aspect 68. The composite yarn of Aspect 65, wherein the first cooling salt is a transition metal salt Aspect 69. The composite yarn of Aspect 68, wherein the first cooling salt is a transition metal salt comprising a cation of silver, copper, titanium, iron, nickel, zinc, gold, or combinations thereof.

Aspect 70. The composite yarn of any one of Aspects 65-69, wherein the first cooling salt comprises a Group I carbonate, a Group I halide, a Group I nitrate, or combinations thereof.

Aspect 71. The composite yarn of any one of Aspects 65-69, wherein the first cooling salt comprises a Group II carbonate, a Group II halide, a Group II nitrate, or combinations thereof.

Aspect 72. The composite yarn of any one of Aspects 65-69, wherein the first cooling salt comprises a transition metal carbonate, a transition metal halide, a transition metal nitrate, or combinations thereof.

Aspect 73. The composite yarn of any one of Aspects 65-72, wherein the first cooling salt comprises a Group I carbonate, a Group II carbonate, transition metal carbonate, or combinations thereof.

Aspect 74. The composite yarn of Aspect 73, wherein the first cooling salt comprises calcium carbonate.

Aspect 75. The composite yarn of any one of Aspects 62-74, wherein the first cooling salt is a powder, a wire, a filament, a sheet, a particle, or combinations thereof.

Aspect 76. The composite yarn of Aspect 75, wherein the first cooling salt is a powder, a particle, or combinations thereof.

Aspect 77. The composite yarn of Aspect 76, wherein the first cooling salt is a particle.

Aspect 78. The composite yarn of Aspect 77, wherein the particle has a size of about 10 μm to about 1000 μm.

Aspect 79. The composite yarn of Aspect 77, wherein the particle has a size of about 30 μm to about 500 μm.

Aspect 80. The composite yarn of Aspect 76, wherein the particle is a nanoparticle, a microparticle, or combinations thereof.

Aspect 81. The composite yarn of Aspect 80, wherein the nanoparticle has a size of about 10 nm to about 100 nm.

Aspect 82. The composite yarn of Aspect 80, wherein the nanoparticle has a size of about 15 nm to about 50 nm.

Aspect 83. The composite yarn of Aspect 80, wherein the nanoparticle has a size of about 20 nm to about 40 nm.

Aspect 84. The composite yarn of Aspect 80, wherein the microparticle has a size of about 10 μm to about 200 μm.

Aspect 85. The composite yarn of Aspect 80, wherein the microparticle has a size of about 20 μm to about 100 μm.

Aspect 86. The composite yarn of Aspect 80, wherein the microparticle has a size of about 30 μm to about 90 μm.

Aspect 87. The composite yarn of Aspect 80, wherein the microparticle has a size of about 40 μm to about 80 μm.

Aspect 88. The composite yarn of Aspect 80, wherein the microparticle has a size of about 50 μm to about 70 μm.

Aspect 89. The composite yarn of any one of Aspects 1-88, wherein the polyamide polymer is a nylon 6, nylon 4/6, nylon 6/6, nylon 6/10, nylon 6/12, nylon 11, nylon 12, or combinations thereof.

Aspect 90. The composite yarn of Aspect 89, wherein the polyamide polymer is a nylon 6/6.

Aspect 91. The composite yarn of any one of Aspects 1-90, wherein the second cooling composition can be present in an amount of about 1 wt % to about 20 wt % based on the total weight of the polyamide polymer and the cooling composition.

Aspect 92. The composite yarn of any one of Aspects 1-91, wherein the second cooling composition comprises about 1 wt % to about 10 wt % of the second cooling material; about 1 wt % to about 15 wt % of the second cooling compound; about 0.1 wt % to about 5 wt % of the second cooling salt; or combinations thereof; and wherein the wt % is based on the total weight of the polyamide polymer and the cooling composition.

Aspect 93. The composite yarn of any one of Aspects 1-92, wherein the second cooling composition comprises about 4 wt % to about 8 wt % of the second cooling material; about 5 wt % to about 10 wt % of the second cooling compound; about 0.3 wt % to about 2.5 wt % of the second cooling salt; or combinations thereof; and wherein the wt % is based on the total weight of the polyamide polymer and the cooling composition.

Aspect 94. The composite yarn of any one of Aspects 1-93, wherein the second cooling composition comprises about 1 wt % to about 10 wt % of the second cooling material; about 1 wt % to about 15 wt % of the second cooling compound; about 0.1 wt % to about 5 wt % of the second cooling salt; and wherein the wt % is based on the total weight of the polyamide polymer and the cooling composition.

Aspect 95. The composite yarn of any one of Aspects 1-94, wherein the second cooling composition comprises about 4 wt % to about 8 wt % of the second cooling material; about 5 wt % to about 10 wt % of the second cooling compound; about 0.3 wt % to about 2.5 wt % of the second cooling salt; and wherein the wt % is based on the total weight of the polyamide polymer and the cooling composition.

Aspect 96. The composite yarn of any one of Aspects 1-95, wherein the second cooling material can be present in an amount of about 1 wt % to about 10 wt %; and wherein the wt % is based on the total weight of the polyamide polymer and the cooling composition.

Aspect 97. The composite yarn of Aspect 96, wherein the second cooling material can be present in an amount of about 4 wt % to about 8 wt %; and wherein the wt % is based on the total weight of the polyamide polymer and the cooling composition.

Aspect 98. The composite yarn of Aspect 96, wherein the second cooling material can be present in an amount of about 5 wt % to about 7 wt %; and wherein the wt % is based on the total weight of the polyamide polymer and the cooling composition.

Aspect 99. The composite yarn of any one of Aspects 1-98, wherein the second cooling material is a metal, a metal alloy, a metal oxide, a carbon material, a ceramic material, a mineral, or combinations thereof.

Aspect 100. The composite yarn of Aspect 99, wherein the mineral comprises silicon, zirconium, titanium, or combinations thereof.

Aspect 101. The composite yarn of Aspect 100, wherein the mineral comprising zirconium is allendeite, baddeleyite, eudialyte, loranskite, menezesite, or combinations thereof.

Aspect 102. The composite yarn of Aspect 100, wherein the mineral comprising titanium is rutile, ilmenite, titanite, anatase, brookite, or combinations thereof.

Aspect 103. The composite yarn of Aspect 100, wherein the mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 104. The composite yarn of Aspect 100, wherein the mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 105. The composite yarn of Aspect 99, wherein the ceramic comprises aluminum oxide, aluminum titanate, zirconium oxide, aluminum nitride, silicon carbide, silicon nitride, silicon alumina nitride, or combinations thereof.

Aspect 106. The composite yarn of Aspect 99, wherein the metal comprises silver, aluminum, copper, or combinations thereof.

Aspect 107. The composite yarn of Aspect 106, wherein the metal comprises silver.

Aspect 108. The composite yarn of Aspect 106, wherein the metal comprises copper.

Aspect 109. The composite yarn of Aspect 106, wherein the metal comprises a mixture of silver and copper.

Aspect 110. The composite yarn of Aspect 99, wherein the metal alloy comprises silver, aluminum, copper, or combinations thereof.

Aspect 111. The composite yarn of Aspect 110, wherein in the metal alloy comprises silver.

Aspect 112. The composite yarn of Aspect 110, wherein in the metal alloy comprises copper.

Aspect 113. The composite yarn of Aspect 110, wherein in the metal alloy comprises silver and copper.

Aspect 114. The composite yarn of Aspect 99, wherein the metal oxide comprises gold (II) oxide, gold (Ill) oxide, silver (I) oxide, silver (II) oxide, silver (I, III) oxide, magnesium oxide, iron (II) oxide, iron (Ill) oxide, copper (I) oxide, copper (II) oxide, or combinations thereof.

Aspect 115. The composite yarn of Aspect 114, wherein the metal oxide comprises silver (I) oxide, copper (I) oxide, copper (II) oxide, or combinations thereof.

Aspect 116. The composite yarn of Aspect 114, wherein the metal oxide comprises silver (I) oxide.

Aspect 117. The composite yarn of any one of Aspects 91-116, wherein the second cooling material is a powder, a wire, a filament, a sheet, a particle, or combinations thereof.

Aspect 118. The composite yarn of Aspect 117, wherein the second cooling material is a particle, a powder, or combinations thereof.

Aspect 119. The composite yarn of Aspect 118, where the second cooling material is a particle.

Aspect 120. The composite yarn of Aspect 119, wherein the particle is a nanoparticle, a microparticle, or combinations thereof.

Aspect 121. The composite yarn of Aspect 120, wherein the nanoparticle has a size of about 10 nm to about 100 nm.

Aspect 122. The composite yarn of Aspect 120, wherein the nanoparticle has a size of about 15 nm to about 50 nm.

Aspect 123. The composite yarn of Aspect 120, wherein the nanoparticle has a size of about 20 nm to about 40 nm.

Aspect 124. The composite yarn of Aspect 120, wherein the microparticle has a size of about 10 μm to about 200 μm.

Aspect 125. The composite yarn of Aspect 120, wherein the microparticle has a size of about 20 μm to about 100 μm.

Aspect 126. The composite yarn of Aspect 120, wherein the microparticle has a size of about 30 μm to about 90 μm.

Aspect 127. The composite yarn of Aspect 120, wherein the microparticle has a size of about 40 μm to about 80 μm.

Aspect 128. The composite yarn of Aspect 120, wherein the microparticle has a size of about 50 μm to about 70 μm.

Aspect 129. The composite yarn of any one of Aspects 1-128, wherein the second cooling compound can be present in an amount of about 1 wt % to about 15 wt % of the second cooling compound; and wherein the wt % is based on the total weight of the polyamide polymer and the cooling composition.

Aspect 130. The composite yarn of any Aspect 121, wherein the second cooling compound can be present in an amount of about 4 wt % to about 12 wt % of the second cooling compound; and wherein the wt % is based on the total weight of the polyamide polymer and the cooling composition.

Aspect 131. The composite yarn of any Aspect 121, wherein the second cooling compound can be present in an amount of about 5 wt % to about 11 wt % of the second cooling compound; and wherein the wt % is based on the total weight of the polyamide polymer and the cooling composition.

Aspect 132. The composite yarn of any Aspect 121, wherein the second cooling compound can be present in an amount of about 6 wt % to about 10 wt % of the second cooling compound; and wherein the wt % is based on the total weight of the polyamide polymer and the cooling composition.

Aspect 133. The composite yarn of any one of Aspects 1-132, wherein the second cooling compound comprises a transition metal oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 134. The composite yarn of Aspect 133, wherein the second cooling compound comprises aluminum oxide, silicon carbide, silicon dioxide, silicon carbide, silicon dioxide, titanium oxide, titanium dioxide, titanium trioxide, zirconium dioxide, or combinations thereof.

Aspect 135. The composite yarn of Aspect 134, wherein the second cooling compound comprises aluminum oxide, silicon dioxide, titanium dioxide, or combinations thereof.

Aspect 136. The composite yarn of Aspect 135, wherein the second cooling compound comprises titanium dioxide.

Aspect 137. The composite yarn of any one of Aspects 129-136, wherein the first cooling compound is a powder, a wire, a filament, a sheet, a particle, or combinations thereof.

Aspect 138. The composite yarn of Aspect 137, wherein the first cooling compound is a powder, a particle, or combinations thereof.

Aspect 139. The composite yarn of Aspect 138, wherein the first cooling compound is a particle.

Aspect 140. The composite yarn of Aspect 139, wherein the particle is a nanoparticle, a microparticle, or combinations thereof.

Aspect 141. The composite yarn of Aspect 140, wherein the nanoparticle has a size of about 10 nm to about 100 nm.

Aspect 142. The composite yarn of Aspect 140, wherein the nanoparticle has a size of about 15 nm to about 50 nm.

Aspect 143. The composite yarn of Aspect 140, wherein the nanoparticle has a size of about 20 nm to about 40 nm.

Aspect 144. The composite yarn of Aspect 140, wherein the microparticle has a size of about 10 μm to about 200 μm.

Aspect 145. The composite yarn of Aspect 140, wherein the microparticle has a size of about 20 μm to about 100 μm.

Aspect 146. The composite yarn of Aspect 140, wherein the microparticle has a size of about 30 μm to about 90 μm.

Aspect 147. The composite yarn of Aspect 140, wherein the microparticle has a size of about 40 μm to about 80 μm.

Aspect 148. The composite yarn of Aspect 140, wherein the microparticle has a size of about 50 μm to about 70 μm.

Aspect 149. The composite yarn of any one of Aspects 1-148, wherein the second cooling salt can be present in an amount of about 0.1 wt % to about 5 wt % of the second cooling salt; and wherein the wt % is based on the total weight of the polyester polymer and the cooling composition.

Aspect 150. The composite yarn of Aspect 149, wherein the second cooling salt can be present in an amount of about 0.3 wt % to about 2.5 wt % of the second cooling salt; and wherein the wt % is based on the total weight of the polyester polymer and the cooling composition.

Aspect 151. The composite yarn of Aspect 149, wherein the second cooling salt can be present in an amount of about 0.5 wt % to about 2 wt % of the second cooling salt; and wherein the wt % is based on the total weight of the polyester polymer and the cooling composition.

Aspect 152. The composite yarn of any one of Aspects 1-151, wherein the second cooling salt is a Group I salt, a Group II salt, a transition metal salt, or combinations thereof.

Aspect 153. The composite yarn of Aspect 152, wherein the second cooling salt is a Group I salt.

Aspect 154. The composite yarn of Aspect 152, wherein the second cooling salt is a Group II salt.

Aspect 155. The composite yarn of Aspect 152, wherein the second cooling salt is a transition metal salt.

Aspect 156. The composite yarn of Aspect 155, wherein the second cooling salt is a transition metal salt comprising a cation of silver, copper, titanium, iron, nickel, zinc, gold, or combinations thereof.

Aspect 157. The composite yarn of any one of Aspects 152-156, wherein the second cooling salt comprises a Group I carbonate, a Group I halide, a Group I nitrate, or combinations thereof.

Aspect 158. The composite yarn of any one of Aspects 152-156, wherein the second cooling salt comprises a Group II carbonate, a Group II halide, a Group II nitrate, or combinations thereof.

Aspect 159. The composite yarn of any one of Aspects 152-156, wherein the second cooling salt comprises a transition metal carbonate, a transition metal halide, a transition metal nitrate, or combinations thereof.

Aspect 160. The composite yarn of any one of Aspects 152-156, wherein the second cooling salt comprises a Group I carbonate, a Group II carbonate, transition metal carbonate, or combinations thereof.

Aspect 161. The composite yarn of Aspect 160, wherein the second cooling salt comprises calcium carbonate.

Aspect 162. The composite yarn of any one of Aspects 149-161, wherein the second cooling salt is a powder, a wire, a filament, a sheet, a particle, or combinations thereof.

Aspect 163. The composite yarn of Aspect 162, wherein the second cooling salt is a powder, a particle, or combinations thereof.

Aspect 164. The composite yarn of Aspect 163, wherein the second cooling salt is a particle.

Aspect 165. The composite yarn of Aspect 164, wherein the particle has a size of about 10 μm to about 1000 μm.

Aspect 166. The composite yarn of Aspect 164, wherein the particle has a size of about 30 μm to about 500 μm.

Aspect 167. The composite yarn of Aspect 164, wherein the particle is a nanoparticle, a microparticle, or combinations thereof.

Aspect 168. The composite yarn of Aspect 167, wherein the nanoparticle has a size of about 10 nm to about 100 nm.

Aspect 169. T The composite yarn of Aspect 167, wherein the nanoparticle has a size of about 15 nm to about 50 nm.

Aspect 170. The composite yarn of Aspect 167, wherein the nanoparticle has a size of about 20 nm to about 40 nm.

Aspect 171. The composite yarn of Aspect 167, wherein the microparticle has a size of about 10 μm to about 200 μm.

Aspect 172. The composite yarn of Aspect 167, wherein the microparticle has a size of about 20 μm to about 100 μm.

Aspect 173. The composite yarn of Aspect 167, wherein the microparticle has a size of about 30 μm to about 90 μm.

Aspect 174. The composite yarn of Aspect 167, wherein the microparticle has a size of about 40 μm to about 80 μm.

Aspect 175. The composite yarn of Aspect 167, wherein the microparticle has a size of about 50 μm to about 70 μm.

Aspect 176. The composite yarn of any one of Aspects 1-175, wherein the composite yarn has a weight of about 70 d/30 f to about 80 d/40 f.

Aspect 177. The composite yarn of Aspect 152, wherein the composite yarn has a weight of about 75 d/36 f±10%.

Aspect 178. The composite yarn of Aspect 152, wherein the composite yarn has a weight of about 75 d/36 f±5%.

Aspect 179. The composite yarn of Aspect 152, wherein the composite yarn has a weight of about 75 d/36 f±3%.

Aspect 180. The composite yarn of any one of Aspects 1-179, wherein the composite yarn comprises about 30 wt % to about 60 wt % of the polyester and the first cooling composition, and about 30 wt % to about 60 wt % of the polyamide and the second cooling composition.

Aspect 181. The composite yarn of Aspect 180, wherein the composite yarn comprises about 45 wt % to about 55 wt % of the polyester and the first cooling composition, and about 45 wt % to about 55 wt % of the polyamide and the second cooling composition.

Aspect 182. The composite yarn of Aspect 180, wherein the composite yarn comprises about 48 wt % to about 52 wt % of the polyester and the first cooling composition, and about 48 wt % to about 52 wt % of the polyamide and the second cooling composition.

Aspect 183. The composite yarn of Aspect 180, wherein the composite yarn comprises about 50 wt % of the polyester and the first cooling composition, and about 50 wt % of the polyamide and the second cooling composition.

Aspect 184. An article comprising the composite yarn of any one of Aspects 1-183.

Aspect 185. The article of Aspect 184, wherein the article is an article of clothing.

Aspect 186. The article of Aspect 185, wherein the article of clothing is a pair of pants, a shirt, a jacket, a dress, or a skirt.

Aspect 187. The article of Aspect 184, wherein the article is an article of sportswear.

Aspect 188. The article of Aspect 184, wherein is the article is an article of drapery.

Aspect 189. The article of Aspect 184, wherein is the article is a floor covering.

Aspect 190. The article of Aspect 184, wherein is the article is a tote bag, a furniture cover, a tarpaulin, or a vehicle seat.

Aspect 191. A double covered yarn comprising: (a) an elastic core comprising an elastic yarn; (b) a first yarn comprising the composite yarn of any one of Aspects 1-183; and (c) a second yarn comprising a cellulosic fiber; wherein the first yarn is wound around the core yarn to form a single covered yarn; and wherein the second yarn is wound around the single covered yarn to form a double covered yarn.

Aspect 192. The double covered yarn of Aspect 191, wherein the elastic core comprises a spandex yarn, a polyester yarn, or combinations thereof.

Aspect 193. The double covered yarn of Aspect 192, wherein the polyester yarn is a yarn comprising polyethylene terephthalate, a polytrimethylene terephthalate, or combinations thereof.

Aspect 194. The double covered yarn of Aspect 193, wherein the polyester yarn comprises a composite filament of polyethylene terephthalate and polytrimethylene terephthalate; and wherein the filament has the polyethylene terephthalate and polytrimethylene terephthalate arranged side-by-side.

Aspect 195. The double covered yarn of Aspect 192-194, wherein the elastic core comprises a spandex yarn and a polyester yarn comprising polyethylene terephthalate, a polytrimethylene terephthalate, or combinations thereof.

Aspect 196. The double covered yarn of Aspects 191-196, wherein the elastic yarn has a weight of about 30 denier to about 50 denier.

Aspect 197. The double covered yarn of Aspect 196, wherein the elastic yarn has a weight of about 35 denier to about 45 denier.

Aspect 198. The double covered yarn of Aspect 196, wherein the elastic yarn has a weight of about 36 denier to about 44 denier.

Aspect 199. The double covered yarn of Aspect 196, wherein the elastic yarn has a weight of about 37 denier to about 43 denier.

Aspect 200. The double covered yarn of Aspect 196, wherein the elastic yarn has a weight of about 38 denier to about 42 denier.

Aspect 201. The double covered yarn of Aspect 196, wherein the elastic yarn has a weight of about 39 denier to about 41 denier.

Aspect 202. The double covered yarn of any one of Aspects 191-201, wherein the stretch rate is about 2.5 to about 5.

Aspect 203. The double covered yarn of Aspect 202, wherein the stretch rate is about 3 to about 4.

Aspect 204. The double covered yarn of Aspect 202, wherein the stretch rate is about 3.2 to about 3.8.

Aspect 205. The double covered yarn of any one of Aspects 191-204, the cellulosic fiber is a viscose fiber.

Aspect 206. The double covered yarn of Aspect 205, wherein the viscose fiber is a viscose rayon, a viscose silk, or combinations thereof.

Aspect 207. The double covered yarn of Aspect 205, wherein the viscose fiber is a viscose rayon.

Aspect 208. The double covered yarn of any one of Aspects 191-207, wherein the second yarn has a weight of about 105 d/20 f to about 130 d/40 f.

Aspect 209. The double covered yarn of Aspect 208, wherein the second yarn has a weight of about 115 d/25 f to about 135 d/35 f.

Aspect 210. The double covered yarn of Aspect 208, wherein the second yarn has a weight of about 120 d/30 f±10%.

Aspect 211. The double covered yarn of Aspect 208, wherein the second yarn has a weight of about 120 d/30 f±5%.

Aspect 212. The double covered yarn of Aspect 208, wherein the second yarn has a weight of about 120 d/30 f±3%.

Aspect 213. The double covered yarn of any one of Aspects 191-212, wherein the double covered yarn has a weight of about 250 denier to about 350 denier.

Aspect 214. The double covered yarn of Aspect 213, wherein the double covered yarn has a weight of about 270 denier to about 330 denier.

Aspect 215. The double covered yarn of Aspect 213, wherein the double covered yarn has a weight of about 280 denier to about 320 denier.

Aspect 216. The double covered yarn of Aspect 213, wherein the double covered yarn has a weight of about 285 denier to about 310 denier.

Aspect 217. The double covered yarn of Aspect 213, wherein the double covered yarn has a weight of about 290 denier±10%.

Aspect 218. The double covered yarn of Aspect 213, wherein the double covered yarn has a weight of about 290 denier±5%.

Aspect 219. The double covered yarn of Aspect 213, wherein the double covered yarn has a weight of about 290 denier±3%.

Aspect 220. The double covered yarn of any one of Aspects 191-212, wherein the double covered yarn has a weight of about 250 denier to about 360 denier.

Aspect 221. The double covered yarn of Aspect 213, wherein the double covered yarn has a weight of about 270 denier to about 360 denier.

Aspect 222. The double covered yarn of Aspect 213, wherein the double covered yarn has a weight of about 280 denier to about 360 denier.

Aspect 223. The double covered yarn of Aspect 213, wherein the double covered yarn has a weight of about 285 denier to about 360 denier.

Aspect 224. The double covered yarn of Aspect 213, wherein the double covered yarn has a weight of about 350 denier±10%.

Aspect 225. The double covered yarn of Aspect 213, wherein the double covered yarn has a weight of about 350 denier±5%.

Aspect 226. The double covered yarn of Aspect 213, wherein the double covered yarn has a weight of about 350 denier±3%.

Aspect 227. An article comprising the double covered yarn of any one of Aspects 191-226.

Aspect 228. The article of Aspect 227, wherein the article is an article of clothing.

Aspect 229. The article of Aspect 228, wherein the article of clothing is a pair of pants, a shirt, a jacket, a dress, or a skirt.

Aspect 230. The article of Aspect 227, wherein the article is an article of sportswear.

Aspect 231. The article of Aspect 227, wherein is the article is an article of drapery.

Aspect 232. The article of Aspect 227, wherein is the article is a floor covering.

Aspect 233. The article of Aspect 227, wherein is the article is a tote bag, a furniture cover, a tarpaulin, or a vehicle seat.

Aspect 234. A fabric comprising: a weft yarn comprising the double covered yarn of any one of Aspects 191-219; and a warp yarn comprising cotton fibers.

Aspect 235. The fabric of Aspect 234, wherein the warp yarn is a cotton yarn having a weight of about 8's to about 50's.

Aspect 236. The fabric of Aspects 234 or 235, wherein the fabric is a warp-faced fabric.

Aspect 237. The fabric of any one of Aspects 234-236, wherein the fabric is a left-handed twill weave; and wherein the left-handed twill weave has diagonals run from the right to the left of the fabric.

Aspect 238. The fabric of any one of Aspects 234-236, wherein the fabric is a right-handed twill weave; and wherein the-handed twill weave has diagonals run from the left to the right of the fabric.

Aspect 239. The fabric of any one of Aspects 234-238, wherein the weave pattern is a 3 by 1 weave; and wherein 3 warp yarns are woven over and under a weft yarn.

Aspect 240. The fabric of any one of Aspects 234-239, wherein the fabric comprises about 50 wt % to about 80 wt % cotton fibers; about 1 wt % to about 15 wt % of a polyester polymer; about 1 wt % to about 10 wt % of a polyamide polymer; and about 0.1 wt % to about 5 wt % of an elastic fiber or elastic filament.

Aspect 241. The fabric of Aspect 240, wherein the fabric comprises about 55 wt % to about 75 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament.

Aspect 242. The fabric of Aspect 240, wherein the fabric comprises about 60 wt % to about 75 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

Aspect 243. The fabric of Aspect 240, wherein the fabric comprises about 55 wt % to about 70 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament.

Aspect 244. The fabric of Aspect 240, wherein the fabric comprises about 60 wt % to about 70 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

Aspect 245. The fabric of any one of Aspects 234-244, wherein the fabric has a weight of about 4 oz/sy to about 12 oz/sy.

Aspect 246. The fabric of Aspect 245, wherein the fabric has a weight of about 5 oz/sy to about 10 oz/sy.

Aspect 247. The fabric of Aspect 245, wherein the fabric has a weight of about 6 oz/sy to about 10 oz/sy.

Aspect 248. The fabric of Aspect 245, wherein the fabric has a weight of about 9.5 oz/sy to about 10.5 oz/sy.

Aspect 249. The fabric of Aspect 245, wherein the fabric has a weight of about 10 oz/sy±10%.

Aspect 250. The fabric of Aspect 245, wherein the fabric has a weight of about 10 oz/sy±5%.

Aspect 251. The fabric of Aspect 245, wherein the fabric has a weight of about 10 oz/sy±3%.

Aspect 252. The fabric of Aspect 245, wherein the fabric has a weight of about 4 oz/sy to about 10 oz/sy.

Aspect 253. The fabric of Aspect 245, wherein the fabric has a weight of about 5 oz/sy to about 8 oz/sy.

Aspect 254. The fabric of Aspect 245, wherein the fabric has a weight of about 5 oz/sy to about 7 oz/sy.

Aspect 255. The fabric of Aspect 245, wherein the fabric has a weight of about 5.5 oz/sy to about 6.5 oz/sy.

Aspect 256. The fabric of Aspect 245, wherein the fabric has a weight of about 6.25 oz/sy±10%.

Aspect 257. The fabric of Aspect 245, wherein the fabric has a weight of about 6.25 oz/sy±5%.

Aspect 258. The fabric of Aspect 245, wherein the fabric has a weight of about 6.25 oz/sy±3%.

Aspect 259. The fabric of any one of Aspects 234-258, wherein the fabric has a Qmax value of about 0.15 to about 0.50 when determined in accordance with FTTS-FA-019 as specified by Committee of Conformity Assessment of Accreditation and Certification on Functional and Technical Textiles (Taiwan).

Aspect 260. The fabric of Aspect 259, wherein the fabric has a Qmax value of about 0.16 to about 0.25.

Aspect 261. The fabric of Aspect 260, wherein the fabric has a Qmax value of about 0.16±10%.

Aspect 262. The fabric of Aspect 260, wherein the fabric has a Qmax value of about 0.16±5%.

Aspect 263. The fabric of Aspect 260, wherein the fabric has a Qmax value of about 0.16±3%.

Aspect 264. The fabric of Aspect 259, wherein the fabric has a Qmax value of about 0.17 to about 0.25.

Aspect 265. The fabric of Aspect 264, wherein the fabric has a Qmax value of about 0.20±10%.

Aspect 266. The fabric of Aspect 264, wherein the fabric has a Qmax value of about 0.20±5%.

Aspect 267. The fabric of Aspect 264, wherein the fabric has a Qmax value of about 0.20±3%.

Aspect 268. The fabric of any one of Aspects 234-267, wherein the fabric has a Qmax value that is about 20% greater than the Qmax value for a reference denim fabric; and wherein the reference denim fabric consists essentially of cotton yarn, having a fabric weight that is ±10% of the fabric, and the same weave pattern as the fabric.

Aspect 269. The fabric of Aspect 268, wherein the fabric has a Qmax value that is about 25% greater than the Qmax value for a reference denim fabric.

Aspect 270. The fabric of Aspect 268, wherein the fabric has a Qmax value that is about 30% greater than the Qmax value for a reference denim fabric.

Aspect 271. The fabric of any one of Aspects 234-270, wherein the fabric has a Qmax value that is about 20% greater than the Qmax value for a reference denim fabric; and wherein the reference denim fabric consists essentially of cotton yarn, having a fabric weight that is ±10% of the fabric, and the same weave pattern as the fabric.

Aspect 272. The fabric of Aspect 271, wherein the fabric has a drying time of about 8 secs to about 30 secs.

Aspect 273. The fabric of Aspect 271, wherein the fabric has a drying time of about 10 secs to about 20 secs.

Aspect 274. The fabric of Aspect 271, wherein the fabric has a drying time of about 10 secs to about 15 secs.

Aspect 275. The fabric of any one of Aspects 234-274, wherein the fabric has a wicking time of less than about 5 minutes for water to rise 20 mm in length when determined in accordance with AATCC Test Method 197.

Aspect 276. The fabric of Aspect 275, wherein the fabric has a wicking time of about 2 minutes for the water to rise 20 mm in length.

Aspect 277. The fabric of Aspect 275, wherein the fabric has a wicking time of about 5 minutes for the water to rise 20 mm in length.

Aspect 278. The fabric of Aspect 275, wherein the fabric has a wicking time of about 1 minutes for the water to rise 20 mm in length.

Aspect 279. The fabric of any one of Aspects 234-278, wherein the fabric has a drying time that is at least about 100% faster than the drying time for a reference denim fabric when determined in accordance with AATCC Test Method 201; and wherein the reference denim fabric consists essentially of cotton yarn, having a fabric weight that is ±10% of the fabric, and the same weave pattern as the fabric.

Aspect 280. The fabric of Aspect 275, wherein the fabric has a drying time that is at least about 20% faster than the drying time for the reference denim fabric.

Aspect 281. The fabric of Aspect 275, wherein the fabric has a drying time that is at least about 25% faster than the drying time for the reference denim fabric.

Aspect 282. The fabric of Aspect 275, wherein the fabric has a drying time that is at least about 30% faster than the drying time for the reference denim fabric.

Aspect 283. The fabric of Aspect 275, wherein the fabric has a drying time that is at least about 40% faster than the drying time for the reference denim fabric.

Aspect 284. The fabric of Aspect 275, wherein the fabric has a drying time that is at least about 50% faster than the drying time for the reference denim fabric.

Aspect 285. The fabric of any one of Aspects 234-284, wherein the fabric has a drying rate of less than about 2.5 ml/hr when determined in accordance with AATCC Test Method 201.

Aspect 286. The fabric of Aspect 271, wherein the fabric has a drying rate of about 0.5 ml/hr to about 1.5 ml/hr.

Aspect 287. The fabric of Aspect 271, wherein the fabric has a drying rate of about 0.5 ml/hr to about 1.0 ml/hr.

Aspect 288. The fabric of Aspect 271, wherein the fabric has a drying rate of about 0.7 ml/hr to about 1.0 ml/hr.

Aspect 289. The fabric of Aspect 271, wherein the fabric has a drying rate of about 0.5 ml/hr to about 0.7 ml/hr.

Aspect 290. The fabric of any one of Aspects 234-289, wherein the fabric has a UPF test value of at least about 1500 for dry evaluation and of at least about 3500 for wet evaluation when tested in accordance with AATCC Test Method 183.

Aspect 291. The fabric of Aspect 290, wherein the fabric has a UPF test value of about 1500 to about 3000 for dry evaluation and of about 3500 to about 4500 for wet evaluation.

Aspect 292. The fabric of Aspect 290, wherein the fabric has a UPF test value of about 1700 to about 2800 for dry evaluation and of about 3700 to about 4300 for wet evaluation.

Aspect 293. The fabric of Aspect 290, wherein the fabric has a UPF test value of about 2000 to about 2700 for dry evaluation and of about 3800 to about 4200 for wet evaluation.

Aspect 294. The fabric of Aspect 290, wherein the fabric has a UPF test value of about 2500±10% for dry evaluation and of about 4100±10% for wet evaluation.

Aspect 295. The fabric of Aspect 290, wherein the fabric has a UPF test value of about 2500±5% for dry evaluation and of about 4100±5% for wet evaluation.

Aspect 296. The fabric of Aspect 290, wherein the fabric has a UPF test value of about 2500±3% for dry evaluation and of about 4100±3% for wet evaluation.

Aspect 297. The fabric of any one of Aspects 234-296, wherein the fabric has a UPF test value for dry evaluation that is about 100% greater and for wet evaluation that is about 100% greater than for a reference denim fabric when determined in accordance with AATCC Test Method 183; and wherein the reference denim fabric consists essentially of cotton yarn, having a fabric weight that is ±10% of the fabric, and the same weave pattern as the fabric.

Aspect 298. The fabric of Aspect 297, wherein the fabric has a UPF test value for dry evaluation that is about 200% greater and for wet evaluation that is about 200% greater than for the reference denim fabric.

Aspect 299. The fabric of Aspect 297, wherein the fabric has a UPF test value for dry evaluation that is about 200% greater and for wet evaluation that is about 200% greater than for the reference denim fabric.

Aspect 300. The fabric of Aspect 297, wherein the fabric has a UPF test value for dry evaluation that is about 300% greater and for wet evaluation that is about 300% greater than for the reference denim fabric.

Aspect 301. An article comprising the fabric of any one of Aspects 234-300.

Aspect 302. The article of Aspect 301, wherein the article is an article of clothing.

Aspect 303. The article of Aspect 302, wherein the article of clothing is a pair of pants, a shirt, a jacket, a dress, or a skirt.

Aspect 304. The article of Aspect 301, wherein the article is an article of sportswear.

Aspect 305. The article of Aspect 301, wherein is the article is an article of drapery.

Aspect 306. The article of Aspect 301, wherein is the article is a floor covering.

Aspect 307. The article of Aspect 301, wherein is the article is a tote bag, a furniture cover, a tarpaulin, or a vehicle seat.

Aspect 308. A cooling polymer composition comprising a polymer and a cooling composition comprising a cooling material, a cooling compound, a salt, or combinations thereof.

Aspect 309. The cooling polymer composition of Aspect 308, wherein the polymer comprises a polyester polymer.

Aspect 310. The cooling polymer composition of Aspects 308 or 309, wherein the polymer comprises a polyethylene terephthalate, a polytrimethylene terephthalate, or combinations thereof.

Aspect 311. The cooling polymer composition of any one of Aspects 308-310, wherein the polymer comprises a polyethylene terephthalate.

Aspect 312. The cooling polymer composition of Aspect 308, wherein the polymer comprises a polyamide.

Aspect 313. The cooling polymer composition of Aspects 308 or 312, wherein the polyamide polymer is a nylon 6, nylon 4/6, nylon 6/6, nylon 6/10, nylon 6/12, nylon 11, nylon 12, or combinations thereof.

Aspect 314. The cooling polymer composition of Aspects 308 or 312-313, wherein the polyamide polymer is a nylon 6/6.

Aspect 315. The cooling polymer composition of any one of Aspects 308-314, wherein the cooling composition can be present in an amount of about 0.001 wt % to about 5 wt % based on the total weight of the polymer and the cooling composition.

Aspect 316. The cooling polymer composition of any one of Aspects 308-315, wherein the cooling composition comprises about 0.2 wt % to about 2 wt % of the first cooling material; about 0.02 wt % to about 0.07 wt % of the first cooling compound; about 0.001 wt % to about 0.02 wt % of the first cooling salt; or combinations thereof; and wherein the wt % is based on the total weight of the polymer and the cooling composition.

Aspect 317. The cooling polymer composition of any one of Aspects 308-316, wherein the cooling composition comprises about 0.5 wt % to about 1 wt % of the first cooling material; about 0.03 wt % to about 0.05 wt % of the first cooling compound; about 0.001 wt % to about 0.01 wt % of the first cooling salt; or combinations thereof; and wherein the wt % is based on the total weight of the polymer and the cooling composition.

Aspect 318. The cooling polymer composition of any one of Aspects 308-317, wherein the cooling composition comprises about 0.2 wt % to about 2 wt % of the first cooling material; about 0.02 wt % to about 0.07 wt % of the first cooling compound; and about 0.001 wt % to about 0.02 wt % of the first cooling salt; and wherein the wt % is based on the total weight of the polymer and the cooling composition.

Aspect 319. The cooling polymer composition of any one of Aspects 308-318, wherein the cooling composition comprises about 0.5 wt % to about 1 wt % of the first cooling material; about 0.03 wt % to about 0.05 wt % of the first cooling compound; and about 0.001 wt % to about 0.01 wt % of the first cooling salt; and wherein the wt % is based on the total weight of the polymer and the cooling composition.

Aspect 320. The cooling polymer composition of any one of Aspects 308-319, wherein the cooling material can be present in an amount of about 0.2 wt % to about 2 wt %; and wherein the wt % is based on the total weight of the polymer and the cooling composition.

Aspect 321. The cooling polymer composition of Aspect 320, wherein the cooling material can be present in an amount of about 0.4 wt % to about 1 wt %; and wherein the wt % is based on the total weight of the polymer and the cooling composition.

Aspect 322. The cooling polymer composition of Aspect 320, wherein the cooling material can be present in an amount of about 0.5 wt % to about 0.9 wt %; and wherein the wt % is based on the total weight of the polymer and the cooling composition.

Aspect 323. The cooling polymer composition of any one of Aspects 308-322, wherein the cooling material is a metal, a metal alloy, a carbon material, a ceramic material, a mineral, or combinations thereof.

Aspect 324. The cooling polymer composition of Aspect 323, wherein the metal is silver, aluminum, copper, or combinations thereof.

Aspect 325. The cooling polymer composition of Aspect 324, wherein the metal is silver.

Aspect 326. The cooling polymer composition of Aspect 323, wherein the metal alloy comprises silver, aluminum, copper, or combinations thereof.

Aspect 327. The cooling polymer composition of Aspect 326, wherein in the metal alloy comprises silver.

Aspect 328. The cooling polymer composition of Aspects 324 or 326, wherein the metal or metal alloy is a powder, a wire, a filament, a sheet, a particle, or combinations thereof.

Aspect 329. The cooling polymer composition of Aspect 328, wherein the metal or metal alloy is a particle, a powder, or combinations thereof.

Aspect 330. The cooling polymer composition of Aspect 329, where the metal or metal alloy is a particle.

Aspect 331. The cooling polymer composition of Aspect 330, wherein the metal is a nanoparticle, a microparticle, or combinations thereof.

Aspect 332. The cooling polymer composition of Aspect 331, wherein the nanoparticle has a size of about 10 nm to about 100 nm.

Aspect 333. The cooling polymer composition of Aspect 331, wherein the nanoparticle has a size of about 15 nm to about 50 nm.

Aspect 334. The cooling polymer composition of Aspect 331, wherein the nanoparticle has a size of about 20 nm to about 40 nm.

Aspect 335. The cooling polymer composition of any one of Aspects 308-334, wherein the cooling compound can be present in an amount of about 0.02 wt % to about 0.07 wt % of the cooling compound; and wherein the wt % is based on the total weight of the polymer and the cooling composition.

Aspect 336. The cooling polymer composition of any Aspect 335, wherein first cooling compound can be present in an amount of about 0.03 wt % to about 0.07 wt % of cooling compound; and wherein wt % is based on the total weight of the polymer and the cooling composition.

Aspect 337. The cooling polymer composition of any Aspect 335, wherein cooling compound can be present in an amount of about 0.03 wt % to about 0.06 wt % of the cooling compound; and wherein the wt % is based on the total weight of the polymer and the cooling composition.

Aspect 338. The cooling polymer composition of any Aspect 335, wherein cooling compound can be present in an amount of about 0.03 wt % to about 0.05 wt % of the cooling compound; and wherein the wt % is based on the total weight of the polymer and the cooling composition.

Aspect 339. The cooling polymer composition of any one of Aspects 308-338, wherein the cooling compound comprises a transition metal oxide, a Group 13 oxide, a Group 14 oxide, a Group 13 carbide, Group 14 carbide, or mixtures thereof.

Aspect 340. The cooling composition of Aspect 339, wherein the cooling compound comprises magnesium oxide, aluminum oxide, silicon carbide, silicon dioxide, silicon carbide, silicon dioxide, titanium dioxide, or combinations thereof.

Aspect 341. The cooling polymer composition of Aspect 339, wherein the cooling compound comprises titanium dioxide.

Aspect 342. The cooling polymer composition of any one of Aspects 339-341, wherein the cooling material is a powder, a particle, or combinations thereof.

Aspect 343. The cooling polymer composition of Aspect 342, wherein the particle is a nanoparticle, a microparticle, or combinations thereof.

Aspect 344. The cooling polymer composition of Aspects 342 or 343, wherein the particle has a size of about 10 μm to about 200 μm.

Aspect 345. The cooling polymer composition of Aspects 342 or 343, wherein the particle has a size of about 20 μm to about 100 μm.

Aspect 346. The cooling polymer composition of Aspects 342 or 343, wherein the particle has a size of about 30 μm to about 90 μm.

Aspect 347. The cooling polymer composition of Aspects 342 or 343, wherein the particle has a size of about 40 μm to about 80 μm.

Aspect 348. The cooling polymer composition of Aspects 342 or 343, wherein the particle has a size of about 50 μm to about 70 μm.

Aspect 349. The cooling polymer composition of any one of Aspects 308-348, wherein the salt can be present in an amount of about 0.001 wt % to about 0.02 wt % of the salt; and wherein the wt % is based on the total weight of the polymer and the cooling composition.

Aspect 350. The cooling polymer composition of Aspect 349, wherein the salt can be present in an amount of about 0.001 wt % to about 0.01 wt % of the salt; and wherein the wt % is based on the total weight of the polymer and the cooling composition.

Aspect 351. The cooling polymer composition of Aspect 349, wherein the salt can be present in an amount of about 0.002 wt % to about 0.01 wt % of the salt; and wherein the wt % is based on the total weight of the polymer and the cooling composition.

Aspect 352. The cooling polymer composition of any one of Aspects 308-351, wherein the salt is a Group I salt, a Group II salt, or combinations thereof.

Aspect 353. The cooling polymer composition of Aspect 352, wherein the salt is a Group I salt.

Aspect 354. The cooling polymer composition of Aspect 352, wherein the salt is a Group II salt.

Aspect 355. The cooling polymer composition of any one of Aspects 352-354, wherein the salt comprises a Group I carbonate, a Group I halide, a Group I nitrate, or combinations thereof.

Aspect 356. The cooling polymer composition of any one of Aspects 352-354, wherein the salt comprises a Group II carbonate, a Group II halide, a Group II nitrate, or combinations thereof.

Aspect 357. The cooling polymer composition of any one of Aspects 352-356, wherein the salt comprises a Group I carbonate, a Group II carbonate, or combinations thereof.

Aspect 358. The cooling polymer composition of any one of Aspects 352-356, wherein the salt comprises calcium carbonate.

Aspect 359. The cooling polymer composition of any one of Aspects 352-358, wherein the salt is a powder, a particle, or combinations thereof.

Aspect 360. The cooling polymer composition of Aspect 359, wherein the particle has a size of about 10 μm to about 1000 μm.

Aspect 361. The cooling polymer composition of Aspect 359, wherein the particle has a size of about 30 μm to about 500 μm.

Before proceeding to the Examples, it is to be understood that this disclosure is not limited to particular aspects described, and as such may, of course, vary. Other systems, methods, features, and advantages of the disclosed cooling compositions, yarns, and fabrics will be or become apparent to one with skill in the art upon examination of the following drawings and detailed description. It is intended that all such additional systems, methods, features, and advantages be included within this description, be within the scope of the present disclosure, and be protected by the accompanying claims. It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

H. EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the disclosure and are not intended to limit the scope of what the inventors regard as their disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1

Exemplary Disclosed Fabric. A representative disclosed fabric sample was prepared With the following characteristics: 48"×6.25 oz/sy; aggregate fiber content of 67% Cotton 15% Rayon, 9% Polyester, 6% Nylon, 3% Spandex; warp faced fabric with a 3/1 twill weave pattern. The fabric had a warp yarn comprised cotton fibers; and the weft yarn comprised a disclosed double-covered yarn. The yarn count for warp yarn was 62.0 Tex (9.5's/1) and weft yarn is 40.0 Tex (360.0 Denier). The double-covered yarn in the weft yarn comprised a composite yarn comprising a core component and sheath layer that comprised: (a) core component of polyester yarn comprising titanium oxide (0.034-0.05% by weight based on the total weight of the core component; particle size 50-70 μm), silver oxide (0.5-0.912% by weight based on the total weight of the core component; particle size: 20-35.5 nm), and calcium carbonate (0.002-0.01% by weight based on the total weight of the core component; particle size 35-500 μm); and (b) sheath layer of nylon yarn comprising titanium oxide (6.7-10.0% by weight based on the total weight of the sheath layer; particle size 50-70 μm), silver oxide (5-7.0% by weight based on the total weight of the sheath layer; particle size 20-35.5 nm), and calcium carbonate (0.59-2.0% by weight based on the total weight of the sheath layer; particle size 35-500 μm).

The foregoing cooling composition amounts are those as determined in the sheath layer and core component by elemental analysis and quantitative compositional analysis performed using field emission scanning electron microscope (FESEM) carried out with a FEI Teneo scanning electron microscope (FEI, Inc., Hillsboro, Oreg., US) equipped with an extremely large area detector for energy-dispersive spectroscopy (INCA Energy detector; Oxford Instruments, Concord, Mass., US). Elemental analysis capability was provided using the OXFORD XMAX software (Oxford Instruments). The area of analysis was chosen under "Scan Image" option. The raw elemental analysis was carried out under the "Acquire spectra" option and the final average analysis was presented under the "Fitted spectra tool."

Standard Denim Fabric. A comparator denim sample representative of a commonly available standard denim fabric was prepared with the following characteristics: 52"×6.5 oz/sy; aggregate fiber content was 100% cotton; warp faced fabric with a 3/1 twill weave pattern.

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 200 ("Drying Rate of Textiles at their Absorbent Capacity: Air Flow Method") and AATCC 201 ("Drying Rate of Fabrics: Heated Plate Method"); and (c) UPF dry and wet evaluation were determined in accordance with AATCC 183 ("Transmittance or Blocking of Erythemally Weighted Ultraviolet Radiation through Fabrics"). The data obtained in these tests are given below in Table 1. All tests were conducted by Intertek Testing Services Taiwan Ltd. (8F, No. 423, Ruiguang Rd., Neihu District, Taipei 11492, Taiwan (R.O.C.).

TABLE 1

| Test Sample | Q max | DRY TIME (secs) | DRY RATE (ml/hr) | UV dry | UV wet |
|---|---|---|---|---|---|
| Representative disclosed fabric sample | 0.201 | 11.9 | 0.65 | 2490 | 4093 |

TABLE 1-continued

| Test Sample | Q max | DRY TIME (secs) | DRY RATE (ml/hr) | UV dry | UV wet |
|---|---|---|---|---|---|
| Comparator denim sample | 0.15 | >60 | N/A* | 592 | 798 |

*Not applicable per AATCC 200 standards, i.e., fabric took greater than 30 seconds for absorbency.

The data in Table 1 show that a representative disclosed fabric, i.e., a disclosed denim fabric, has surprisingly superior thermal characteristics as exhibited in the 34% enhanced Qmax value; and markedly improved drying and UPF characteristics. For example, the representative disclosed fabric is 500% faster in moisture wicking compared to a standard denim sample (cf. a dry time of 11.9 seconds for the representative disclosed fabric versus over 60 seconds for a standard denim sample), and much improved drying rates (cf. a drying rate of 0.65 ml/hr for the representative disclosed fabric versus a non-measurable drying rate for a standard denim sample under the conditions of the test, i.e., the standard denim sample showed absorbency greater than 30 seconds, so a determination of ml/hour could not be made). Moreover, with regard to UPF properties, the representative disclosed fabric show a 320% improvement in the dry evaluation and a 413% improvement in the wet evaluation. The foregoing improvements were attainable while using a 100% cotton yarn in the warp weave, but incorporating a disclosed double covered yarn in the weft weave.

Figure 2A:
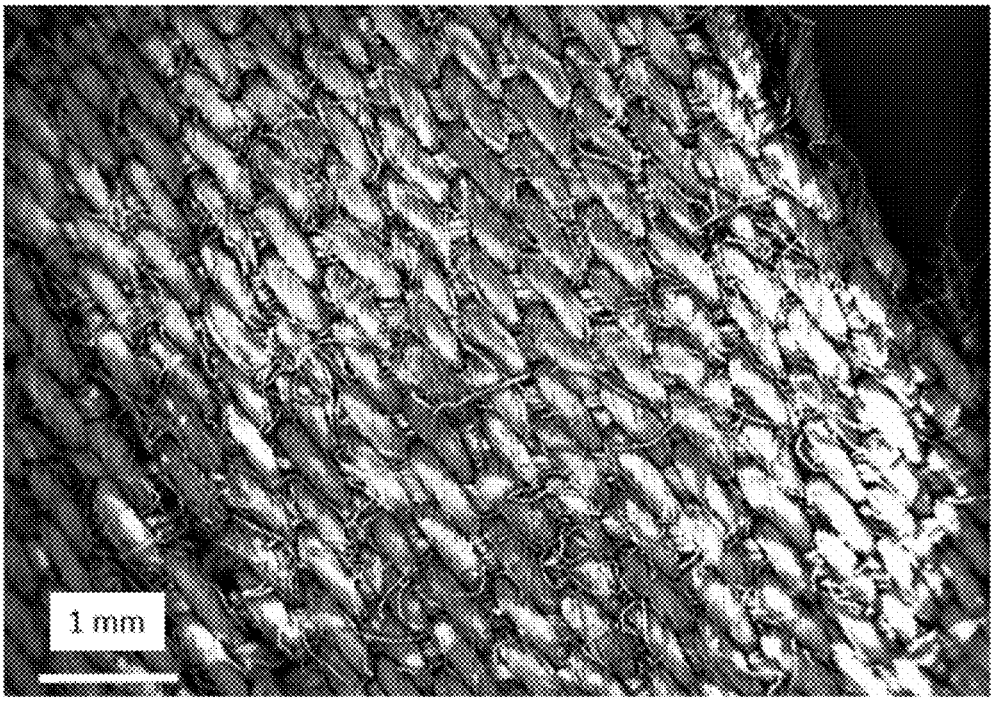
FIGS. 2A-2B show representative scanning electron micrograph (SEM) images of a disclosed fabric comprising a twill weave comprising a weft yarn comprising a disclosed double covered yarn; and a warp yarn comprising a cotton yarn.
Figure 2B:
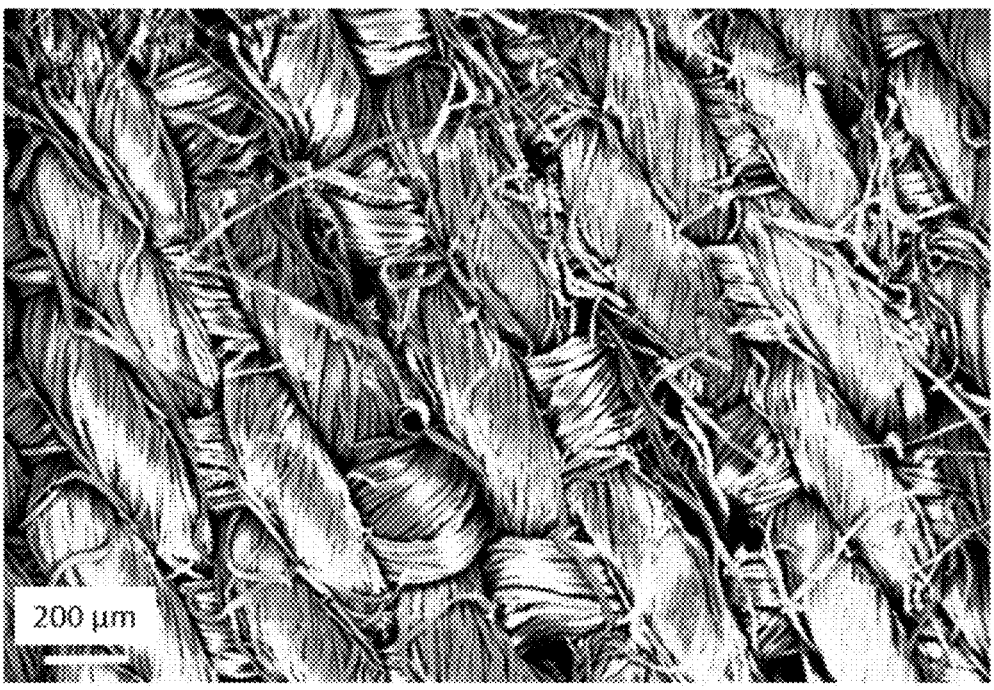
Figure 3A:
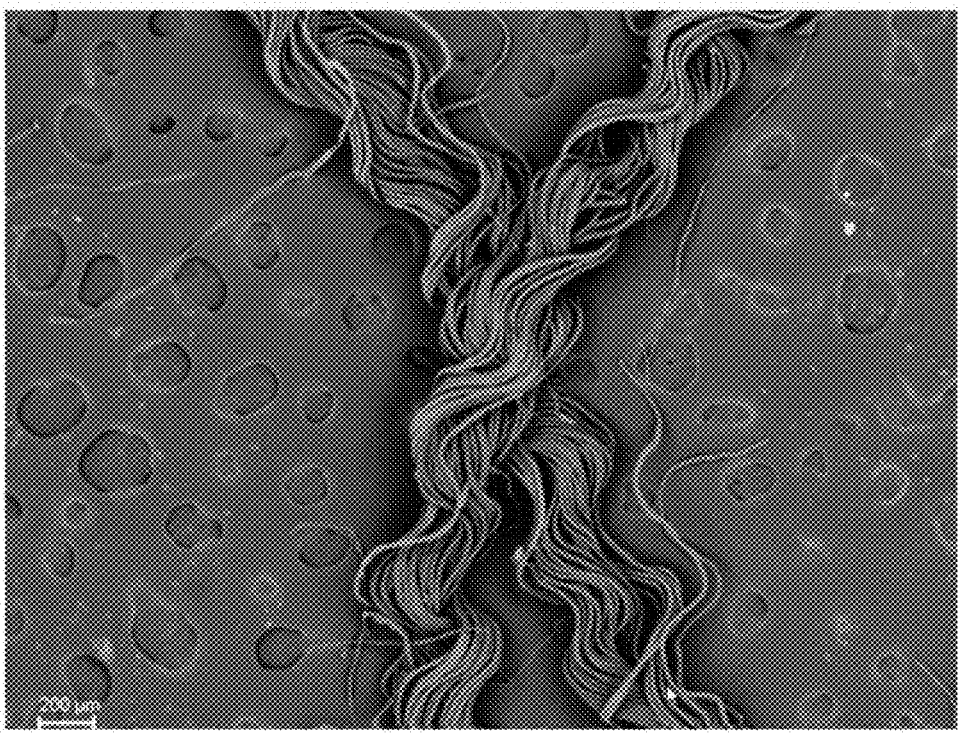
FIGS. 3A-3B show representative scanning electron micrograph (SEM) images of a disclosed warp yarn comprising a disclosed cotton yarn.
Figure 3B:
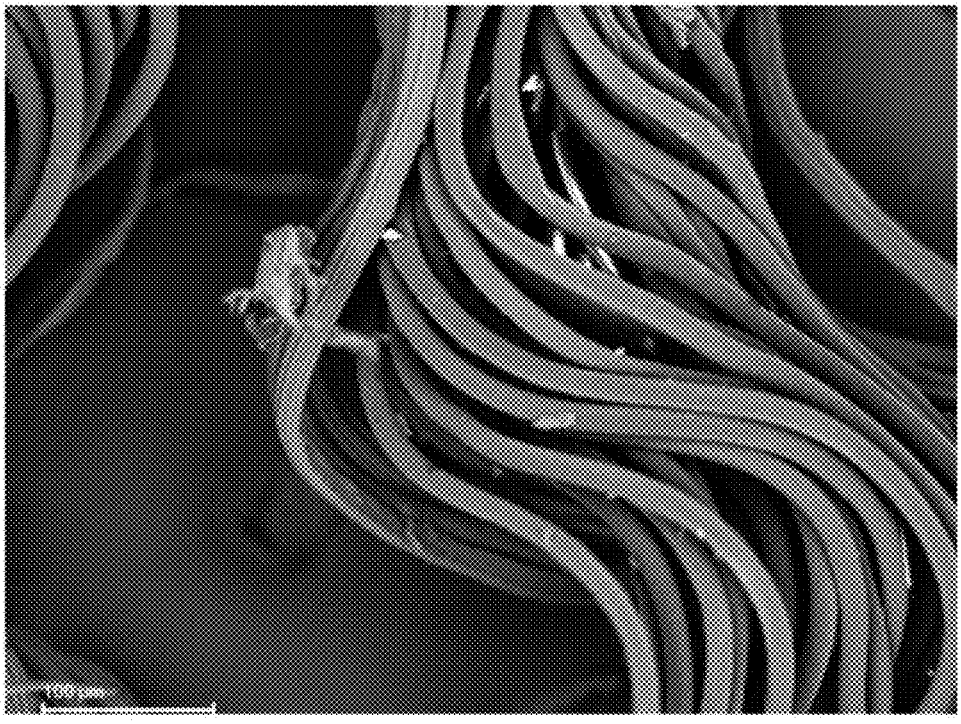
Figure 4A:
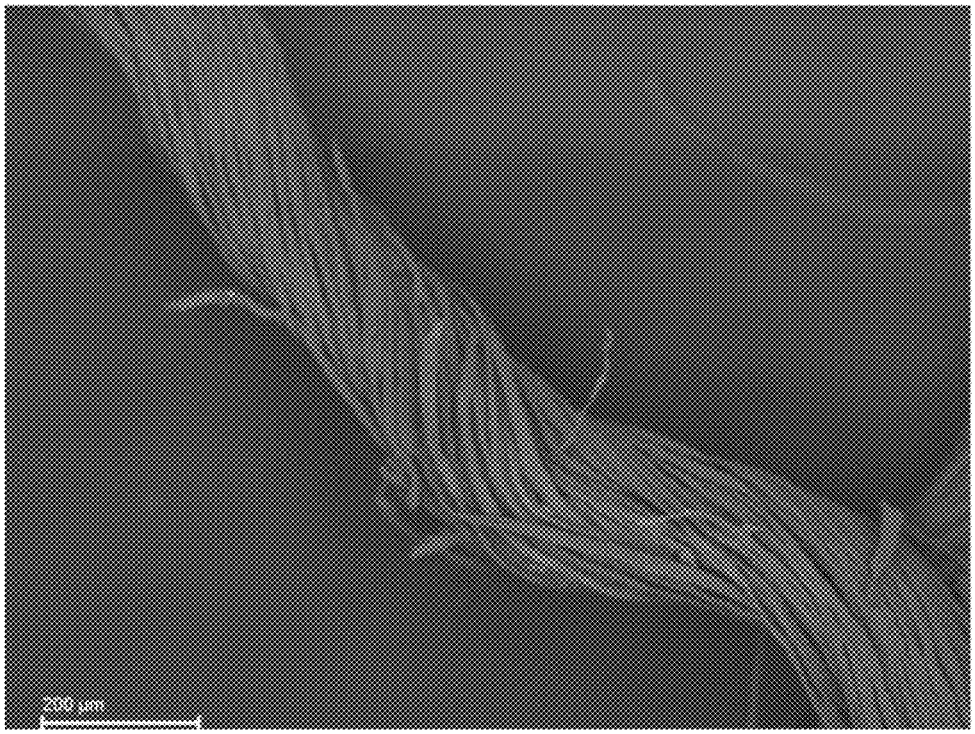
FIGS. 4A-4C show representative scanning electron micrograph (SEM) images of a disclosed weft yarn comprising a disclosed double covered yarn.
Figure 4B:
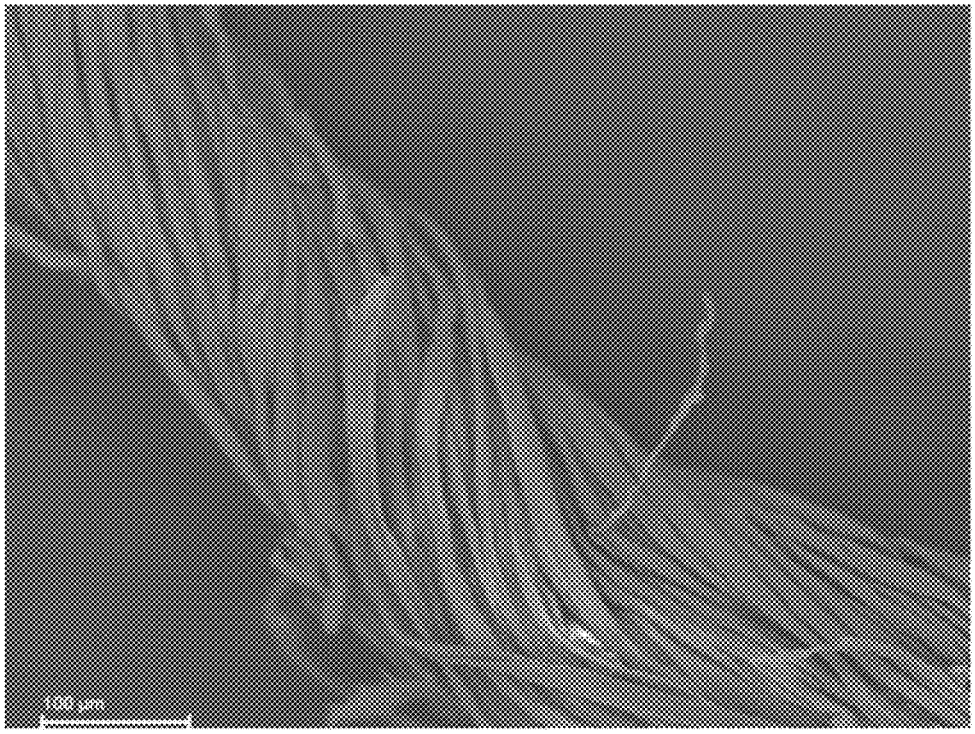
Figure 4C:
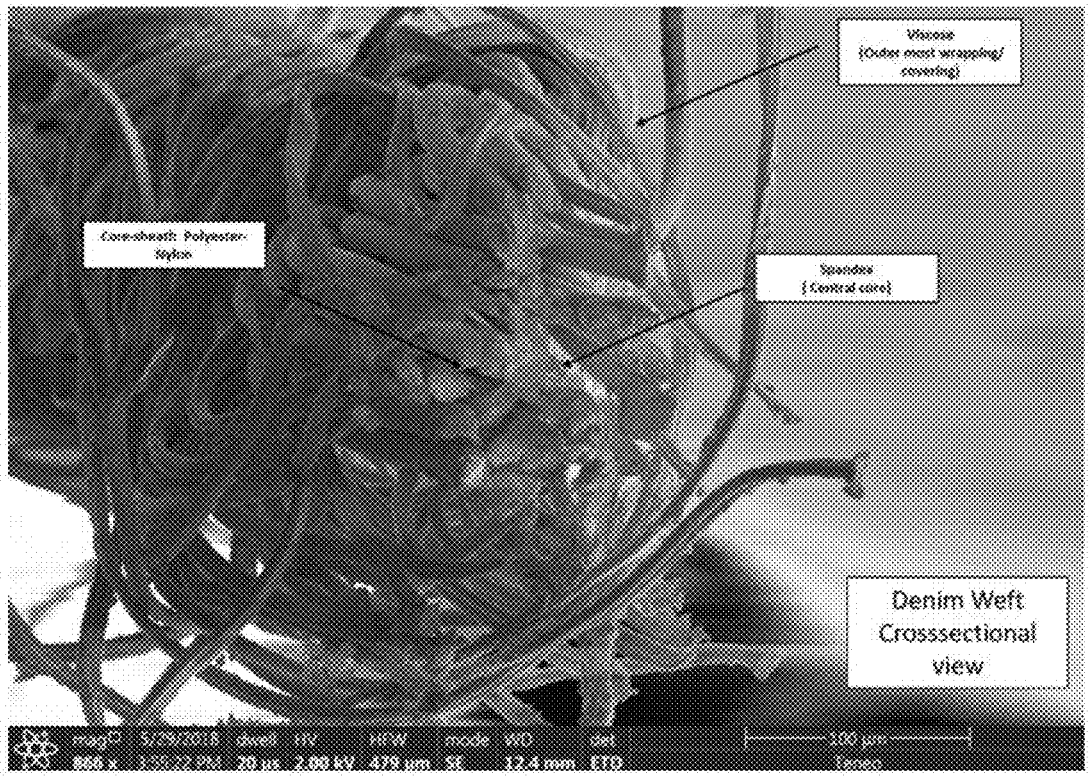
Figure 5:
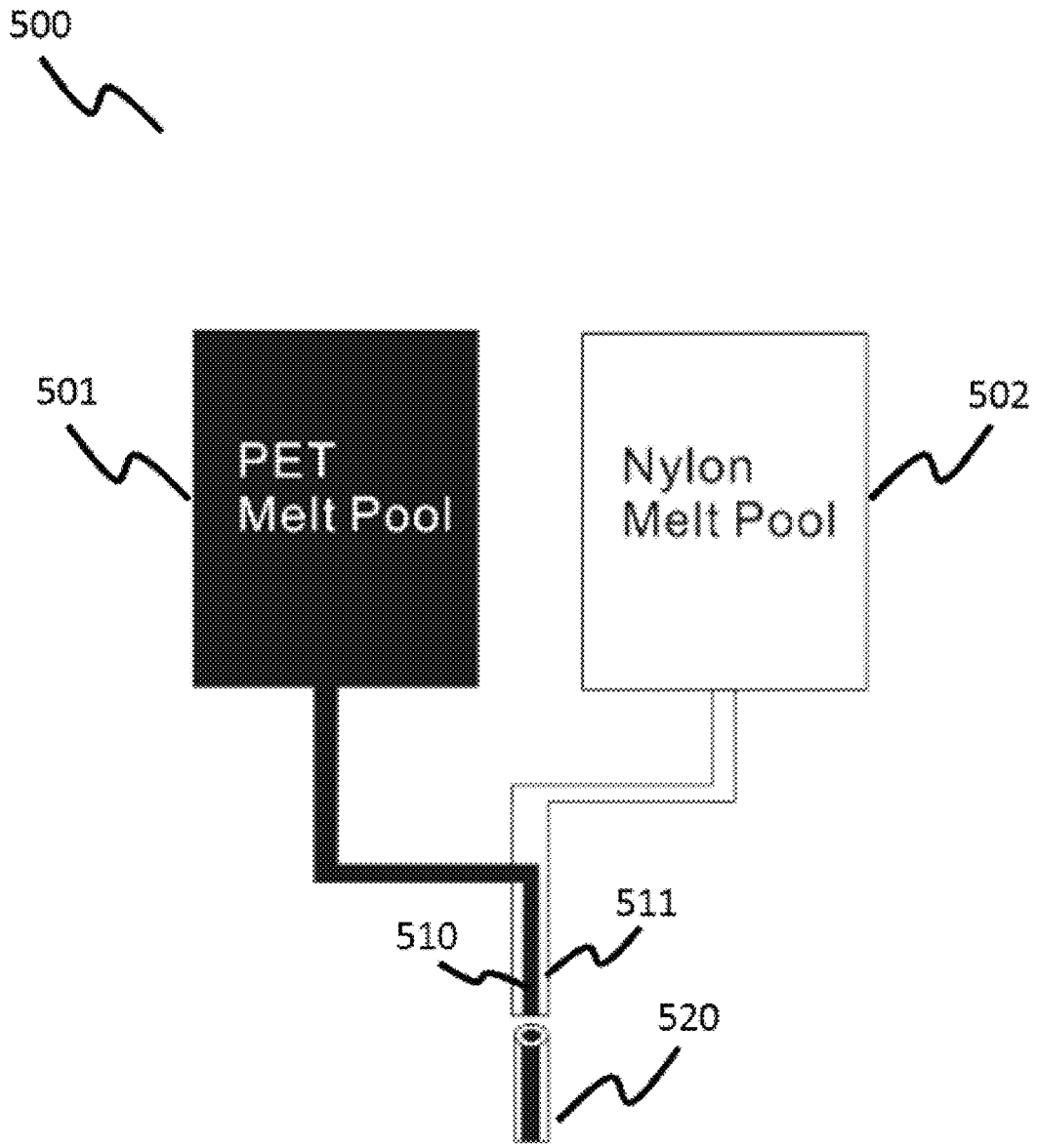
FIG. 5 shows a representative schematic view of a disclosed process, 500, to prepare a disclosed composite yarn with indicia numbers as follows: a reservoir, such as a hopper, having a polyester polymer ("PET") melt pool comprising a PET and a first cooling composition, 501; a reservoir, such as a hopper, having a polyamide polymer ("PA," e.g., a nylon) melt pool comprising a PA and a second cooling composition, 502; an inner spinneret assembly, 510, for ejecting the core component of a composite yarn; an outer spinneret assembly, 511, for ejecting the sheath layer around the core component of a composite yarn; and the composite yarn, 520, formed by the process.

Representative scanning electron micrograph (SEM) images are shown in FIGS. 2A-2B of the representative disclosed fabric sample used in this example. Representative SEM images are shown in FIGS. 3A-3B of the warp yarn used in representative disclosed fabric sample of this example. Representative SEM images are shown in FIGS. 4A-4B of the weft yarn used in representative disclosed fabric sample of this example. All SEM images were obtained at the Georgia Electron Microscopy Center (University of Georgia, 151 Barrow Hall, 115 D.W. Brooks Drive, Athens Ga. 30602, USA).

Example 2

Exemplary Disclosed Fabric. A representative disclosed fabric sample was prepared with the following characteristics: 52"×10 oz/sy; aggregate fiber content 72% Cotton, 8% Polyester, 5% Nylon, 13% Rayon, 2% Spandex; warp faced fabric with a 3/1 twill weave pattern with a fabric count of 89×46. The fabric had a warp yarn comprised cotton fibers; and the weft yarn comprised a disclosed double-covered yarn. The yarn count for warp yarn was 62.0 Tex (9.5's/1) and weft yarn is 40.0 Tex (360.0 Denier). The double-covered yarn in the weft yarn comprised a composite yarn comprising a core component and sheath layer that comprised: (a) core component comprising polyester and a cooling composition comprising titanium oxide (0.034-0.05% by weight based on the total weight of the core component; particle size 50-70 μm), silver oxide (0.5-0.912% by weight based on the total weight of the core component; particle size: 20-35.5 nm), and calcium carbonate (0.002-0.01% by weight based on the total weight of the core component; particle size 35-500 μm); and (b) sheath layer of nylon yarn comprising titanium oxide (6.7-10.0% by weight based on the total weight of the sheath layer; particle size 50-70 μm), silver oxide (5-7.0% by weight based on the total weight of the sheath layer; particle size 20-35.5 nm), and calcium carbonate (0.59-2.0% by weight based on the total weight of the sheath layer; particle size 35-500 μm).

The foregoing cooling composition amounts are those as determined in the sheath layer and core component by elemental analysis and quantitative compositional analysis performed using field emission scanning electron microscope (FESEM) carried out with a FEI Teneo scanning electron microscope (FEI, Inc., Hillsboro, Oreg., US) equipped with an extremely large area detector for energy-dispersive spectroscopy (INCA Energy detector; Oxford Instruments, Concord, Mass., US). Elemental analysis capability was provided using the OXFORD XMAX software (Oxford Instruments). The area of analysis was chosen under "Scan Image" option. The raw elemental analysis was carried out under the "Acquire spectra" option and the final average analysis was presented under the "Fitted spectra tool."

Representative scanning electron micrograph (SEM) images are shown in FIGS. 2A-2B of the representative disclosed fabric sample used in this example. Representative SEM images are shown in FIGS. 3A-3B of the warp yarn used in representative disclosed fabric sample of this example. Representative SEM images are shown in FIGS. 4A-4B of the weft yarn used in representative disclosed fabric sample of this example. All SEM images were obtained at the Georgia Electron Microscopy Center (University of Georgia, 151 Barrow Hall, 115 D.W. Brooks Drive, Athens Ga. 30602, USA).

Comparator Fabrics. Comparator fabric used, and shown in Table 2 below, was representative of a commonly available conventional denim fabric. The conventional denim fabric used was: 98.0% cotton, 2.0% spandex, with a 3/1 twill weave pattern with a fabric count of 78×61 and a weight of 10 ounces/square yard; a yarn count for warp yarn of 67.8 Tex (8.7's/1) and weft yarn was 67.3 Tex (15.8's/1).

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 201 ("Drying Rate of Fabrics: Heated Plate Method"); (c) thermal resistance was determined in accordance with ISO 11092:2014 ("Textiles—Physiological effects—Measurement of thermal and water-vapour resistance under steady-state conditions (sweating guarded-hotplate test)"); and (d) Vertical Wicking was determined in accordance with AATCC 197. The data obtained in these tests are given below in Table 2. All testing was conducted by Intertek Testing Services Taiwan Ltd. (8F, No. 423, Ruiguang Rd., Neihu District, Taipei 11492, Taiwan (R.O.C.).

TABLE 2

| Test Sample | Q max[1] | Thermal Resistance[2] | Air permeability[‡] |
|---|---|---|---|
| Representative disclosed fabric sample | 0.181 | 0.018 | 19.6 |
| Conventional denim fabric sample | 0.155 | n.d. | n.d. |

| Test Sample | Drying Time[†] | Drying Rate[††] | Wicking* | Wicking** |
|---|---|---|---|---|
| Representative disclosed fabric sample | 11.65 | 1.03 | 2 | 2 |
| Conventional denim fabric sample | 22.53 | 0.53 | 13 | 21 |
| Representative disclosed fabric sample | 11.65 | 1.03 | 2 | 2 |
| Comparator Fabric A | 14.42 | 0.83 | 4 | 19 |
| Comparator Fabric B | 17.17 | 0.70 | 4 | 4 |

[1]Reported in W/cm$^2$ and carried out per FTTS-FA-019.
[2]Reported in Km$^2$/W and carried out per ISO 11092: 2014.
[‡]Reported in cfm and carried out per ASTM 737.
[†]Reported in minutes and carried out per AATCC 201.
[††]Reported in ml/hr and carried out per AATCC 201.
*Reported in time (minutes) for water level to reach 20 mm in the length direction and carried out per AATCC 197.
**Reported in time (minutes) for water level to reach 20 mm in the width direction per AATCC 197.

The data in Table 2 show that a representative disclosed fabric, i.e., a disclosed denim fabric comprising a disclosed double covered yarn and a cotton yarn, has surprisingly superior fabric characteristics as exhibited in the Q max, moisture wicking and drying characteristics. For example, the representative disclosed fabric had a 500% faster rate in moisture wicking compared to a standard denim fabric (cf. a wicking time of 2 minutes for the representative disclosed fabric versus 13 minutes for a standard denim sample), and much improved drying rates (cf. a drying rate of 1.03 ml/hr for the representative disclosed fabric versus 0.53 ml/hr for standard denim fabric under the conditions of the test.

Moreover, the data in Table 2 show an improved Qmax value for the disclosed representative fabric compared to standard denim fabric. In particular, the Qmax value was improved 16.8% compared to standard denim fabric.

In the aggregate, the disclosed representative fabric showed a surprisingly significant improvement in a number of characteristics and properties compared to a conventional denim fabric.

Example 3

Exemplary Disclosed Fabric. As described above for Example 2.

Comparator Fabrics. Comparator fabrics used, and shown in Table 3 below, were representative of a commonly available standard denim fabric or other cooling fabrics. Comparator Fabric A: 9.7 oz/sy; aggregate fiber content was 75% Cotton, 23% Polyester, 2% Lycra Elastane; warp faced fabric with a 3/1 twill weave pattern with fabric count of 116×66. Comparator Fabric B: 11 oz/sy; aggregate fiber content was 70% Cotton, 28% Polyester, 2% Spandex; warp faced fabric with a 3/1 twill weave pattern with fabric count of 80×51.

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 201 ("Drying Rate of Fabrics: Heated Plate Method"); (c) thermal resistance was determined in accordance with ISO 11092:2014 ("Textiles—Physiological effects—Measurement of thermal and water-vapour resistance under steady-state conditions (sweating guarded-hotplate test)"); and (d) Vertical Wicking was determined in accordance with AATCC 197. The data obtained in these tests are given below in Table 2. All testing was conducted by Intertek Testing Services Taiwan Ltd. (8F, No. 423, Ruiguang Rd., Neihu District, Taipei 11492, Taiwan (R.O.C.).

TABLE 3

| Test Sample | Q max[1] | Thermal Resistance[2] | Air permeability[‡] |
|---|---|---|---|
| Representative disclosed fabric sample | 0.181 | 0.018 | 19.6 |
| Comparator Fabric A | 0.124 | n.d. | 6.27 |
| Comparator Fabric B | 0.115 | n.d. | 7.77 |

[1]Reported in W/cm$^2$ and carried out per FTTS-FA-019.
[2]Reported in Km$^2$/W and carried out per ISO 11092: 2014.
[‡]Reported in cfm and carried out per ASTM 737.
[†]Reported in minutes and carried out per AATCC 201.
[††]Reported in ml/hr and carried out per AATCC 201.
*Reported in time (minutes) for water level to reach 20 mm in the length direction and carried out per AATCC 197.
**Reported in time (minutes) for water level to reach 20 mm in the width direction per AATCC 197.

The data in Table 2 show that a representative disclosed fabric, i.e., a disclosed denim fabric comprising a disclosed double covered yarn and a cotton yarn, has surprisingly superior fabric characteristics as exhibited in the thermal resistance, air permeability, and improved drying and wicking characteristics. For example, the representative disclosed denim fabric had a 48-57% improvement in Qmax value compared to the comparator conventional cooling denim fabrics, i.e., Comparator Fabrics A and B. It should be noted that the Qmax method determines the maximum heat lost or instantaneous cooling feeling of the fabric between the temperature of 25° C. and 35° C., i.e., a cooling characteristic associated with a short time period.

Moreover, the representative disclosed denim fabric had 50% improvement in moisture wicking compared to the comparator conventional cooling denim fabrics (cf. a wicking time of 2 minutes for the representative disclosed fabric versus 4 minutes for a comparator cooling denim fabrics), and much improved drying rates (cf. a drying rate of 1.03 ml/hr for the representative disclosed fabric versus 0.83 ml/hr for Comparator Fabric A under the conditions of the test).

In the aggregate, the disclosed representative fabric showed a surprisingly significant improvement in a number of characteristics and properties compared to conventional.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A composite yarn comprising a core component and a sheath layer, wherein:

(a) the core component comprises a polyester polymer and a first cooling composition; and (b) the sheath layer comprises a polyamide polymer and a second cooling composition;

wherein the first cooling composition comprises a first cooling material, a first cooling compound, and a first cooling salt;

wherein the first cooling composition comprises about 0.2 wt % to about 2 wt % of the first cooling material; about 0.02 wt % to about 0.07 wt % of the first cooling compound; and about 0.001 wt % to about 0.02 wt % of the first cooling salt; and wherein the wt % is based on the total weight of the polyester polymer and the cooling composition;

wherein the second cooling composition comprises a second cooling material, a second cooling compound, and a second cooling salt; and wherein the second cooling composition comprises about 1 w t% to about 10wt % of the second cooling material; about 1 wt % to about 15 wt % of the second cooling compound; and about 0.1 wt % to about 5 wt % of the second cooling salt; and wherein the wt % is based on the total weight of the polyamide polymer and the cooling composition.

2. The composite yarn of claim 1, wherein the first cooling material comprises silver oxide, aluminum oxide, copper oxide, or combinations thereof.

3. The composite yarn of claim 1, wherein the first cooling material comprises a nanoparticle; and wherein the nanoparticle has a size of about 10 nm to about 100 nm.

4. The composite yarn of claim 1, wherein the first cooling compound comprises magnesium oxide, silicon carbide, silicon dioxide, silicon carbide, silicon dioxide, titanium dioxide, or combinations thereof.

5. The composite yarn of claim 1, wherein the first cooling compound is a particle; and wherein the particle has a size of about 10 μm to about 200 μm.

6. The composite yarn claim 1, wherein the first cooling salt comprises a Group II carbonate, a Group II halide, a Group II nitrate, or combinations thereof.

7. The composite yarn of claim 1, wherein the first cooling salt comprises a particle having a size of about 10 μm to about 1000 μm.

8. The composite yarn of claim 1, wherein the polyamide polymer is a nylon 6,nylon 4/6, nylon 6/6, nylon 6/10, nylon 6/12, nylon 11, nylon 12, or combinations thereof.

9. The composite yarn of claim 1, wherein the yarn has a weight of about 75 denier/36 filament ±10%.

10. The composite yarn of claim 1, wherein the yarn the yarn comprises about 45wt % to about 55 wt % of the polyester and the first cooling composition, and about 45 wt % to about 55 wt % of the polyamide and the second cooling composition.

11. A fabric comprising:

a weft yarn comprising a double-covered yarn; and a warp yarn comprising cotton fibers;

wherein the double-covered yarn comprises:

(a) an elastic core comprising an elastic yarn;

(b) a first yarn comprising a composite yarn; and (c) a second yarn comprising a cellulosic fiber;

wherein the composite yarn comprises:

(a) a core component comprising a polyester polymer and a first cooling composition; and (b) a sheath layer comprising a polyamide polymer and a second cooling composition;

wherein the first cooling composition comprises a first cooling material, a first cooling compound, a first cooling salt, or combinations thereof; and wherein the second cooling composition comprises a second cooling material, a second cooling compound, a second cooling salt, or combinations thereof;

wherein the first yarn is wound around the core yarn to form a single covered yarn;

wherein the second yarn is wound around the single covered yarn to form a double covered yarn.

12. The fabric of claim 11, wherein the fabric comprises about 50 wt % to about 70wt % cotton fibers; about 1 wt % to about 15 wt % of a polyester polymer; about 1 wt % to about 10 wt % of a polyamide polymer; and about 0.1 wt % to about 5 wt % of an elastic fiber or elastic filament.

13. The fabric of claim 11, wherein the fabric has a weight of about 4 oz/sy to about 10 oz/sy.

14. The fabric of claim 11, wherein the fabric has a Qmax value of about 0.15 to about 0.50 when determined in accordance with FTTS-FA-019 as specified by Committee of Conformity Assessment of Accreditation and Certification on Functional and Technical Textiles (Taiwan).

15. The fabric of claim 11, wherein the fabric has a Qmax value that is about 20% greater than the Qmax value for a reference denim fabric; wherein the Qmax value is determined in accordance with FTTS-FA-019 as specified by Committee of Conformity Assessment of Accreditation and Certification on Functional and Technical Textiles (Taiwan); and wherein the reference denim fabric consists essentially of cotton yarn, having a fabric weight that is ±10% of the fabric , and the same weave pattern as the fabric.

16. The fabric of claim 11, wherein the fabric has a wicking time of less than about 60 secs when determined in accordance with AATCC Test Method 197.

17. The fabric of claim 11, wherein the fabric has a drying rate of less than about 2.5 ml/hr when determined in accordance with AATCC Test Method 200.

18. An article of clothing comprising the fabric of claim 11.

* * * * *